US010702740B2

(12) United States Patent
Tarkington et al.

(10) Patent No.: US 10,702,740 B2
(45) Date of Patent: Jul. 7, 2020

(54) PORTABLE DEVICES FOR EXERCISING MUSCLES IN THE ANKLE, FOOT, AND/OR LEG, AND RELATED METHODS

(71) Applicant: TS MEDICAL LLC, McLean, VA (US)

(72) Inventors: Mary Anne Tarkington, McLean, VA (US); David G. Matsuura, Solana Beach, CA (US); Jacob A. Moebius, Encinitas, CA (US); Louis John Stack, Calgary (CA); Scott Michael Cline, New Albany, OH (US); Donald C. Meves, Columbus, OH (US); Emily Kathryn Stokes, Columbus, OH (US)

(73) Assignee: TS MEDICAL LLC, McLean, VA (US)

( * ) Notice: Subject to any disclaimer, the term of this patent is extended or adjusted under 35 U.S.C. 154(b) by 0 days.

(21) Appl. No.: 16/570,742

(22) Filed: Sep. 13, 2019

(65) Prior Publication Data

US 2020/0086172 A1 Mar. 19, 2020

Related U.S. Application Data

(60) Provisional application No. 62/731,647, filed on Sep. 14, 2018.

(51) Int. Cl.
*A63B 23/08* (2006.01)
*A63B 21/02* (2006.01)
(Continued)

(52) U.S. Cl.
CPC ..... *A63B 23/08* (2013.01); *A63B 21/022* (2015.10); *A63B 21/0442* (2013.01);
(Continued)

(58) Field of Classification Search
CPC ... A63B 21/022; A63B 21/0442; A63B 21/05; A63B 21/0557; A63B 21/151;
(Continued)

(56) References Cited

U.S. PATENT DOCUMENTS 1,509,793 A 9/1924 Thompson et al.
2,021,801 A * 11/1935 Meyer ..... A63B 23/08 482/79
(Continued)

FOREIGN PATENT DOCUMENTS

DE 548527 C 10/1932
DE 20221403 U1 11/2005
(Continued)

OTHER PUBLICATIONS

Office Action in U.S. Appl. No. 13/482,844, dated Aug. 31, 2012.
(Continued)

*Primary Examiner* — Joshua Lee
(74) *Attorney, Agent, or Firm* — Jones Robb, PLLC

(57) ABSTRACT

A portable exercise device includes a pedal pivotably connected to a pair of supports. The pedal has a neutral position relative to a pivot axis. The pedal is configured to rotate about the pivot axis in a first direction toward one support and in a second direction, opposite the first direction, toward the other support. The exercise device also includes a resistance mechanism configured to exert a force on the pedal about the pivot axis in a direction opposite to the respective direction of rotation of the pedal about the pivot axis. The device is movable between an open, in-use configuration, where the pedal is disposed in the neutral position to receive a foot of a user and the pair of supports together form a triangular base, and a closed configuration, where the pair of supports are flush against the pedal.

27 Claims, 59 Drawing Sheets

(51) Int. Cl.

| | |
|---|---|
| ***A63B 21/055*** | (2006.01) |
| ***A63B 21/05*** | (2006.01) |
| ***A63B 21/00*** | (2006.01) |
| ***A63B 21/22*** | (2006.01) |
| ***A63B 21/04*** | (2006.01) |
| *A63B 23/10* | (2006.01) |

(52) U.S. Cl.
CPC ..... *A63B 21/05* (2013.01); *A63B 21/0557* (2013.01); *A63B 21/151* (2013.01); *A63B 21/22* (2013.01); *A63B 23/10* (2013.01); *A63B 2210/50* (2013.01); *A63B 2210/52* (2013.01); *A63B 2210/54* (2013.01); *A63B 2210/56* (2013.01); *A63B 2210/58* (2013.01)

(58) Field of Classification Search
CPC ..... A63B 21/22; A63B 23/08; A63B 23/10; A63B 2210/50; A63B 2210/52; A63B 2210/54; A63B 2210/56; A63B 2210/58
See application file for complete search history.

(56) References Cited

U.S. PATENT DOCUMENTS 3,259,385 A * 7/1966 Boren ..... A63B 22/0694 482/60
3,286,709 A 11/1966 Hoyer et al.
3,318,304 A 5/1967 Vladimir et al.
3,421,760 A 1/1969 Freeman et al.
3,741,540 A * 6/1973 Shimizu ..... A63B 22/0056 482/80
4,111,416 A 9/1978 Jinotti
4,199,137 A 4/1980 Giguere
4,306,714 A 12/1981 Loomis et al.
4,337,939 A 7/1982 Hoyle et al.
4,370,977 A 2/1983 Mauldin et al.
4,422,635 A 12/1983 Herod et al.
4,429,868 A * 2/1984 LeBlanc ..... A63B 23/03516 482/131
4,501,421 A * 2/1985 Kane ..... A63B 23/085 482/118
4,605,220 A 8/1986 Troxel
4,637,379 A 1/1987 Saringer
4,669,722 A 6/1987 Rangaswamy
4,694,684 A * 9/1987 Campbell, III ..... A63C 11/26 280/809
4,718,665 A 1/1988 Airy et al.
4,733,859 A 3/1988 Kock et al.
4,739,986 A * 4/1988 Kucharik ..... A63B 23/08 482/146
4,795,148 A 1/1989 Rangaswamy
4,801,138 A 1/1989 Airy et al.
4,816,920 A 3/1989 Paulsen
4,822,039 A * 4/1989 Gonzales ..... A63B 21/04 482/128
4,836,531 A 6/1989 Niks
4,979,737 A 12/1990 Kock
5,014,690 A 5/1991 Hepburn et al.
5,038,758 A 8/1991 Iams et al.
5,052,379 A 10/1991 Airy et al.
5,108,092 A * 4/1992 Hurst ..... A63B 22/0005 482/60
5,129,872 A 7/1992 Dalton et al.
5,209,716 A 5/1993 Frydman et al.
5,215,508 A 6/1993 Bastow
5,230,681 A 7/1993 Hannum et al.
5,263,911 A 11/1993 Frydman et al.
5,306,222 A 4/1994 Wilkinson
5,337,737 A 8/1994 Rubin et al.
5,352,185 A 10/1994 Blauth et al.
5,368,536 A 11/1994 Stodgell
5,454,769 A 10/1995 Chen
5,465,428 A 11/1995 Earl
5,489,251 A 2/1996 Robles, Jr.
5,520,627 A 5/1996 Malewicz
5,570,472 A 11/1996 Dicker
5,606,745 A 3/1997 Gray
5,611,770 A 3/1997 Tesch
5,645,516 A 7/1997 Foster
5,722,919 A 3/1998 Timmer
5,727,254 A 3/1998 Dicker
5,733,249 A 3/1998 Katzin et al.
5,743,837 A 4/1998 Dias et al.
5,755,651 A * 5/1998 Homyonfer ..... A63B 22/16 482/123
5,788,618 A 8/1998 Joutras
5,839,122 A 11/1998 Dicker et al.
5,842,959 A 12/1998 Wilkinson
5,851,166 A * 12/1998 Bernardson ..... A63B 22/16 482/79
5,857,947 A 1/1999 Dicker et al.
5,867,826 A 2/1999 Wilkinson
5,873,847 A 2/1999 Bennett et al.
5,879,276 A 3/1999 Miller
5,897,464 A 4/1999 Mcleod
6,010,468 A 1/2000 Grove et al.
6,024,714 A 2/2000 Katzin
6,047,406 A 4/2000 Dicker et al.
6,063,013 A 5/2000 Vathappallil
6,206,807 B1 3/2001 Cowans et al.
6,217,488 B1 4/2001 Bernardson
6,244,992 B1 * 6/2001 James ..... A61H 1/0237 482/19
6,254,034 B1 7/2001 Carpenter
6,261,253 B1 7/2001 Katzin
6,277,057 B1 8/2001 Hayden
6,283,897 B1 9/2001 Patton
6,390,957 B1 5/2002 Knight
6,436,058 B1 8/2002 Krahner et al.
6,569,213 B1 * 5/2003 Busch ..... A63B 21/026 48/79
6,572,514 B1 6/2003 Calafato
6,589,141 B1 7/2003 Flaggs
6,656,097 B2 12/2003 Karecki
6,705,975 B2 3/2004 Kuo
6,780,142 B1 8/2004 Takizawa et al.
6,796,928 B1 9/2004 Christopher et al.
6,808,476 B2 10/2004 Zagone
6,821,235 B1 11/2004 Johnson et al.
6,837,831 B2 1/2005 Lee
7,008,357 B2 3/2006 Winkler
7,074,204 B2 7/2006 Fujii et al.
7,160,231 B2 * 1/2007 Kazemi ..... A63B 22/0056 482/60
7,294,114 B1 11/2007 Clement et al.
7,316,637 B2 1/2008 German et al.
7,322,904 B2 1/2008 Takizawa et al.
7,364,534 B2 4/2008 Zoller et al.
7,452,340 B2 11/2008 Cook et al.
7,481,739 B2 1/2009 Takizawa et al.
7,481,751 B1 1/2009 Arnold
7,485,074 B2 2/2009 Chen
7,500,324 B1 3/2009 Power et al.
7,537,555 B2 5/2009 Soletski
7,641,591 B2 1/2010 Takizawa et al.
7,771,327 B1 8/2010 Reams
7,775,941 B2 8/2010 Nguyen et al.
7,883,451 B2 2/2011 Hand
7,892,154 B1 2/2011 Alexa
7,918,813 B2 4/2011 Drake et al.
8,029,420 B1 10/2011 Thati
8,092,350 B2 1/2012 Chinag
8,123,663 B2 2/2012 Fey et al.
8,231,508 B1 7/2012 Rousseau
8,246,522 B2 8/2012 Piaget et al.
8,267,839 B1 9/2012 Bartolotta
8,312,566 B2 11/2012 Weir et al.
8,353,854 B2 1/2013 Horst et al.
8,360,940 B2 1/2013 Kole et al.
8,366,591 B2 2/2013 Patoglu
8,403,817 B2 3/2013 Ferguson et al.
8,430,796 B1 * 4/2013 Tarkington ..... A63B 23/03541 482/51

(56) References Cited

U.S. PATENT DOCUMENTS

| | | | | |
|---|---|---|---|---|
| 8,460,163 | B2 | 6/2013 | Gibbons | |
| 8,480,546 | B2 | 7/2013 | Spencer | |
| 8,678,979 | B2 | 3/2014 | Stark et al. | |
| D712,044 | S | 8/2014 | Mathew et al. | |
| 8,827,873 | B2 | 9/2014 | Amstein | |
| 8,840,530 | B2 | 9/2014 | Baker et al. | |
| 8,986,177 | B2 | 3/2015 | von Hoffmann et al. | |
| D726,844 | S | 4/2015 | Mathew et al. | |
| 9,095,177 | B2 | 8/2015 | Ota et al. | |
| 9,114,277 | B2 | 8/2015 | Goeckel | |
| 9,192,806 | B2 | 11/2015 | Mial | |
| 9,230,057 | B2 | 1/2016 | Stark et al. | |
| 9,247,784 | B2 | 2/2016 | Stewart | |
| 9,295,303 | B2 | 3/2016 | Baker et al. | |
| 9,302,137 | B1 | 4/2016 | Yelvington | |
| 9,327,156 | B2 | 5/2016 | von Hoffmann et al. | |
| 9,377,079 | B2 | 6/2016 | DeHarde | |
| 9,433,814 | B2 | 9/2016 | von Hoffmann et al. | |
| 9,474,673 | B2 | 10/2016 | Horst et al. | |
| D776,211 | S | 1/2017 | Gebhard et al. | |
| 9,539,135 | B2 | 1/2017 | Romo et al. | |
| 9,566,469 | B1 * | 2/2017 | Rector | A63B 22/0005 |
| 9,592,416 | B2 | 3/2017 | Thorpe | |
| 9,603,768 | B1 | 3/2017 | Widmer et al. | |
| 9,656,117 | B2 | 5/2017 | von Hoffmann et al. | |
| 9,737,753 | B2 * | 8/2017 | Chuang | A63B 21/023 |
| 9,770,617 | B2 | 9/2017 | von Hoffmann et al. | |
| 9,814,273 | B2 | 11/2017 | Nordstrom et al. | |
| 9,849,328 | B1 | 12/2017 | Fulks | |
| 9,872,789 | B2 | 1/2018 | Sorrenti et al. | |
| 9,873,017 | B2 | 1/2018 | Barel | |
| 9,895,569 | B2 | 2/2018 | Yao | |
| 9,914,009 | B2 * | 3/2018 | Tarkington | A63B 23/03541 |
| 10,004,937 | B2 | 6/2018 | Matsuura et al. | |
| 10,076,460 | B2 | 9/2018 | Harry et al. | |
| 10,118,063 | B2 | 11/2018 | DeYoung | |
| 10,124,205 | B2 | 11/2018 | Matsuura et al. | |
| 10,143,878 | B2 | 12/2018 | Gottfried | |
| 10,179,078 | B2 | 1/2019 | Bhugra et al. | |
| 10,434,357 | B2 * | 10/2019 | McCarthy | A63B 21/4047 |
| 2002/0165069 | A1 * | 11/2002 | Ravikumar | A63B 23/10 482/80 |
| 2002/0193210 | A1 | 12/2002 | Turner | |
| 2003/0060339 | A1 | 3/2003 | Ravikumar et al. | |
| 2004/0087419 | A1 | 5/2004 | Ware et al. | |
| 2005/0251067 | A1 | 11/2005 | Terry | |
| 2005/0261113 | A1 | 11/2005 | Wilkinson | |
| 2006/0103219 | A1 | 5/2006 | Sardana | |
| 2006/0122040 | A1 | 6/2006 | Nguyen et al. | |
| 2006/0276736 | A1 | 12/2006 | Devreese | |
| 2007/0135279 | A1 | 6/2007 | Purdy et al. | |
| 2008/0083055 | A1 | 4/2008 | Onda | |
| 2009/0192024 | A1 * | 7/2009 | Wu | A63B 21/015 482/57 |
| 2010/0145233 | A1 | 6/2010 | Zhang et al. | |
| 2010/0222180 | A1 | 9/2010 | Takizawa | |
| 2010/0323859 | A1 | 12/2010 | von Hoffmann et al. | |
| 2011/0046524 | A1 | 2/2011 | Mihara et al. | |
| 2011/0077560 | A1 | 3/2011 | Jacofsky et al. | |
| 2011/0111927 | A1 * | 5/2011 | Kim | A63B 21/00192 482/52 |
| 2011/0112447 | A1 | 5/2011 | Hsiao-Wecksler et al. | |
| 2011/0172578 | A1 | 7/2011 | Chiu et al. | |
| 2011/0314590 | A1 | 12/2011 | Perron et al. | |
| 2013/0041302 | A1 | 2/2013 | Williams | |
| 2013/0079686 | A1 | 3/2013 | Sessions | |
| 2013/0184617 | A1 | 7/2013 | Inaba | |
| 2013/0237386 | A1 * | 9/2013 | Tsai | A63B 21/015 482/60 |
| 2014/0179497 | A1 | 6/2014 | von Hoffmann et al. | |
| 2014/0196190 | A1 | 7/2014 | Brown | |
| 2014/0302971 | A1 | 10/2014 | Vining | |
| 2014/0325732 | A1 | 11/2014 | Anderson | |
| 2014/0336009 | A1 | 11/2014 | Piaget et al. | |
| 2015/0165260 | A1 | 6/2015 | Tarkington et al. | |
| 2015/0223526 | A1 | 8/2015 | Nolan | |
| 2015/0314157 | A1 | 11/2015 | Lampert et al. | |
| 2016/0095367 | A1 | 4/2016 | Curran | |
| 2016/0183606 | A1 | 6/2016 | Shriver | |
| 2016/0279012 | A1 * | 9/2016 | Hurtado | A61H 1/0237 |
| 2016/0361222 | A1 | 12/2016 | Publicover et al. | |
| 2017/0072250 | A1 | 3/2017 | Heiskanen | |
| 2017/0246501 | A1 * | 8/2017 | Palmer | A63B 21/00069 |
| 2017/0246502 | A1 * | 8/2017 | Palmer | A63B 22/0605 |
| 2017/0246503 | A1 * | 8/2017 | Palmer | A63B 21/16 |
| 2017/0252601 | A1 | 9/2017 | McKenzie | |
| 2017/0274249 | A1 | 9/2017 | Moebius et al. | |
| 2017/0361151 | A1 | 12/2017 | Mottern | |
| 2018/0093121 | A1 | 4/2018 | Matsuura et al. | |
| 2018/0093122 | A1 | 4/2018 | Stevenson et al. | |
| 2018/0098707 | A1 | 4/2018 | Salamon et al. | |
| 2018/0104536 | A1 | 4/2018 | Stewart | |
| 2018/0111016 | A1 | 4/2018 | Brockway, Jr. et al. | |
| 2018/0207477 | A1 | 7/2018 | Barel | |
| 2019/0001176 | A1 | 1/2019 | Gustafson | |
| 2019/0029336 | A1 | 1/2019 | Collins et al. | |
| 2019/0160322 | A1 * | 5/2019 | McCarthy | A63B 21/00069 |

FOREIGN PATENT DOCUMENTS

| | | | |
|---|---|---|---|
| EP | 2854958 | A1 | 4/2015 |
| FR | 3024838 | A3 | 2/2016 |
| GB | 2372458 | A | 8/2002 |
| GB | 2404877 | A | 2/2005 |
| GB | 2460039 | A | 11/2009 |
| JP | 2009254700 | A | 11/2009 |
| WO | 2009128565 | A1 | 10/2009 |
| WO | 2013035905 | A1 | 3/2013 |
| WO | 2013181063 | A1 | 12/2013 |
| WO | 2019164633 | A2 | 8/2019 |
| WO | 2019194885 | A1 | 10/2019 |

OTHER PUBLICATIONS

Office Action in CA Appln No. 2,874,237, dated Dec. 10, 2015.
Communication in EP Appln No. 13727007.0, dated Mar. 20, 2017.
International Search Report in PCT Appln No. PCT/US2019/015031, dated Aug. 30, 2019.
International Search Report in PCT Appln No. PCT/US2019/015030, dated Jul. 1, 2019.
Related U.S. Appl. No. 16/570,817, entitled "Portable Devices for Exercising Muscles in the Ankle, Foot, and/or Leg, and Related Methods", filed Sep. 13, 2019.

* cited by examiner

PORTABLE DEVICES FOR EXERCISING MUSCLES IN THE ANKLE, FOOT, AND/OR LEG, AND RELATED METHODS

CROSS-REFERENCE TO RELATED APPLICATIONS

This application claims priority to U.S. Provisional Patent Application No. 62/731,647, filed Sep. 14, 2018, and entitled "Portable Devices for Exercising Muscles in the Ankle, Foot, and/or Leg, and Related Methods," the entire content of which is incorporated by reference herein. This application is filed on a date concurrently herewith, and entitled Portable Devices for Exercising Muscles in the Ankle, Foot, and/or Leg, and Related Methods," the entire content of which is incorporated by reference herein.

TECHNICAL FIELD

The present disclosure relates to portable devices for exercising muscles in the ankle, foot, and/or leg, and related methods. More particularly, the present disclosure relates to portable devices, and related methods, for exercising muscles in the ankle, foot, and/or leg of a user to increase blood circulation, which may, for example, assist in preventing venous thromboembolism.

INTRODUCTION

The section headings used herein are for organizational purposes only and are not to be construed as limiting the subject matter described in any way.

Venous thromboembolism (VTE) occurs when red blood cells, fibrin and, to a lesser extent, platelets and leukocytes, form a mass (i.e., clot) within an intact vein. The thrombus (i.e., blood clot) is referred to as a deep venous thrombosis (DVT) when formed within the deep veins of the legs or in the pelvic veins. A pulmonary embolism (PE) results when a piece of thrombus detaches from a vein wall, travels to the lungs, and lodges within the pulmonary arteries.

VTE is often a concern in situations where an individual is immobile and/or relatively nonambulatory for a relatively long period of time, such as, for example, during hospitalization, after surgery, during pregnancy and/or in the postpartum period, while traveling (e.g., in a car, plane and/or train), at work, and/or in a more sedentary lifestyle (e.g., the elderly and/or obese). Blood returning to the heart does so through veins. Large veins, such as those found in the legs, lie near and between muscles and contain valves that maintain the flow of blood in the direction of the heart by preventing backflow and stasis. The contraction of these muscles (e.g., through walking) forces the blood through the veins in the direction of the heart, usually against the force of gravity, thereby preventing blood from accumulating in the extremities. If these muscles are not used and/or minimally (e.g., infrequently) used for an extended period of time, however, the lower limbs may swell with stationary blood, greatly increasing the risk of VTE.

Because of this potential danger, preventative measures against VTE have become standard, for example, in prolonged hospitalizations and postoperative care. Consequently, in conjunction with early ambulation, a number of prophylaxis devices have been developed to help prevent VTE, including, for example, graduated compression stockings, intermittent pneumatic compression devices, and pneumatic compression devices. Such compressive techniques, however, fail to treat and articulate a patient's ankle and/or knee joints, or otherwise contract the ankle, foot and/or leg (e.g., calf) muscles. These devices and methods, therefore have limited exercise and therapy capabilities, and are generally impractical for use outside of a hospital setting.

Various additional exercise devices serve to articulate a patient's joints, thereby providing joint therapy while contracting the muscles of the ankle, foot, and/or leg to prevent blood from accumulating in the lower extremities of the body. Such devices, however, often fail to allow both full flexion and extension of a user's ankle, to provide both plantar flexion (i.e., movement which increases the approximate 90° angle between the front part of the foot and the shin, thereby contracting the calf muscle) and dorsiflexion motion (i.e., movement which decreases the angle between the front part of the foot and the shin, thereby stretching the calf muscle). Furthermore, many of these devices are bulky, cumbersome, complex and expensive; being impractical for use during transition care or between care locations, or for use by other VTE at-risk groups, such as, for example, travelers.

Due to growing concerns over the continued prevalence of VTE related medical cases, it may be desirable to provide a relatively simple, inexpensive device and method with full exercise and therapy capabilities, which allows for full flexion and extension of a user's ankle joint, while also being lightweight and compact. It also may be desirable to provide a device that is portable, being useful for all VTE at-risk individuals.

SUMMARY

The present disclosure may solve one or more of the above-mentioned problems and/or may demonstrate one or more of the above-mentioned desirable features. Other features and/or advantages may become apparent from the description that follows.

In accordance with various exemplary embodiments of the present disclosure a portable exercise device includes a pedal pivotably connected to a pair of supports. The pedal has a neutral position relative to a pivot axis. The pedal is configured to rotate about the pivot axis in a first direction toward one support and in a second direction, opposite the first direction, toward the other support. The exercise device also includes a resistance mechanism configured to exert a force on the pedal about the pivot axis in a direction opposite to the respective direction of rotation of the pedal about the pivot axis. The device is movable between an open, in-use configuration, where the pedal is disposed in the neutral position to receive a foot of a user and the pair of supports together form a triangular base, and a closed configuration, where the pair of supports are flush against the pedal.

In accordance with various additional exemplary embodiments of the present disclosure a method of exercising an ankle, foot, and/or leg of a user includes positioning a foot of a user onto a pedal of an exercise device. The pedal is pivotably connected to a pair of supports and has a neutral position relative to a pivot axis of the device. The method also includes rotating the pedal about the pivot axis in a first direction, toward a first support of the pair of supports, with the foot, against a first resistive force. The method further includes rotating the pedal about the pivot axis in a second direction, toward the second support of the pair of supports and away from the first support, with the foot, against a second resistive force.

In accordance with various further exemplary embodiments of the present disclosure a method of exercising an ankle, foot, and/or leg of a user includes positioning a foot of a user onto a pedal of an exercise device. The pedal is pivotably connected to a pair of supports and has a neutral position relative to a pivot axis of the device. The method also includes applying a first force to the pedal with the foot to rotate the pedal about the pivot axis in a first direction, toward a first support of the pair of supports. The method also includes resisting movement of the pedal toward the first support with a resistance mechanism of the exercise device. The method additionally includes applying a second force to the pedal with the foot to rotate the pedal about the pivot axis in a second direction, opposite the first direction, toward the second support of the pair of supports and away from the first support. The method further includes resisting movement of the pedal toward the second support with the resistance mechanism of the device.

Additional objects and advantages will be set forth in part in the description which follows, and in part will be obvious from the description, or may be learned by practice of the present disclosure. The objects and advantages may be realized and attained by means of the elements and combinations particularly pointed out in the appended claims and their equivalents.

It is to be understood that both the foregoing general description and the following detailed description are exemplary and explanatory only and are not restrictive of the present disclosure and claims.

BRIEF DESCRIPTION OF THE DRAWINGS

The present disclosure can be understood from the following detailed description either alone or together with the accompanying drawings. The drawings are included to provide a further understanding, and are incorporated in and constitute a part of this specification. The drawings illustrate one or more exemplary embodiments of the present disclosure and together with the description serve to explain various principles and operations.

DESCRIPTION OF VARIOUS EXEMPLARY EMBODIMENTS

Figure 1:
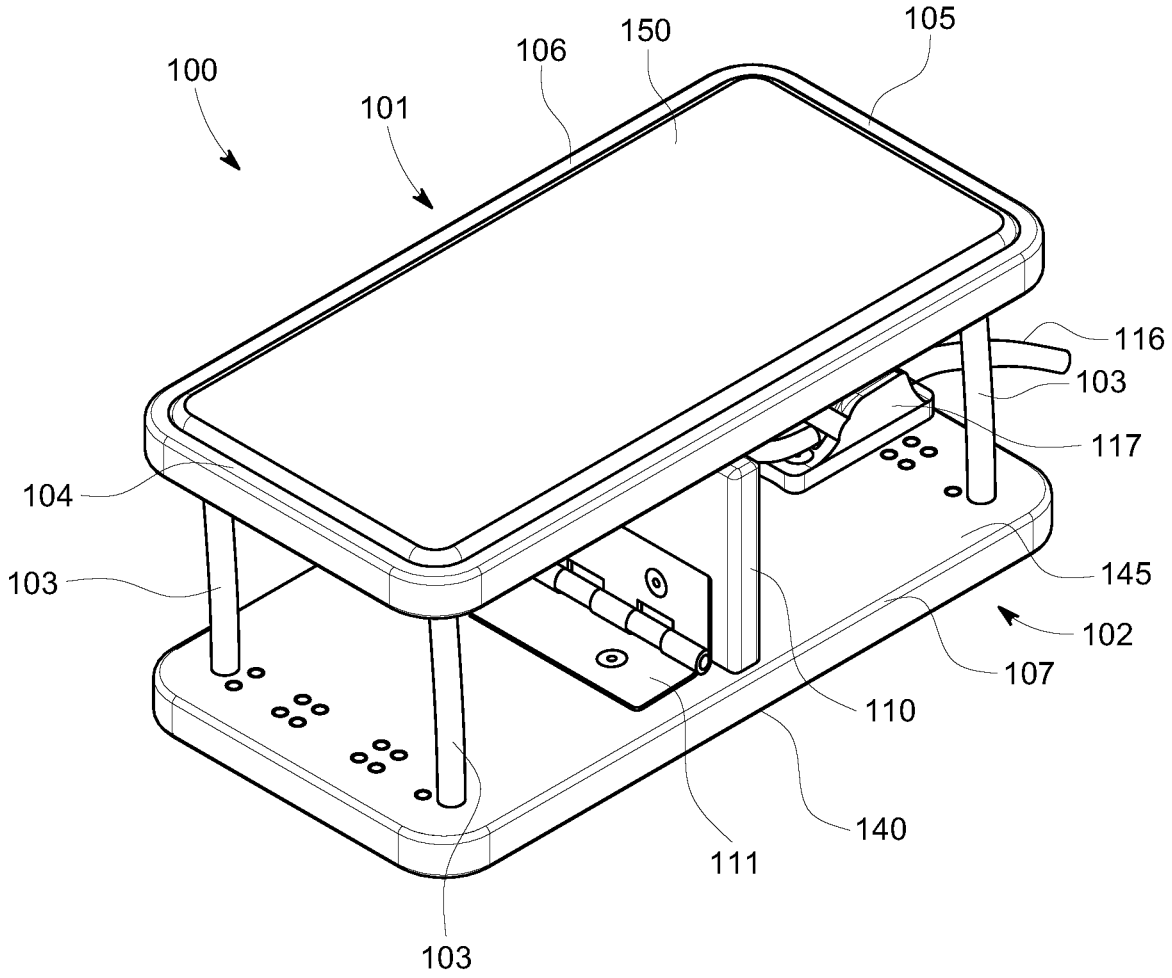
FIG. 1 is a perspective top, front view of an exemplary embodiment of a portable exercise device, in an open configuration, in accordance with the present disclosure.
Figure 2:
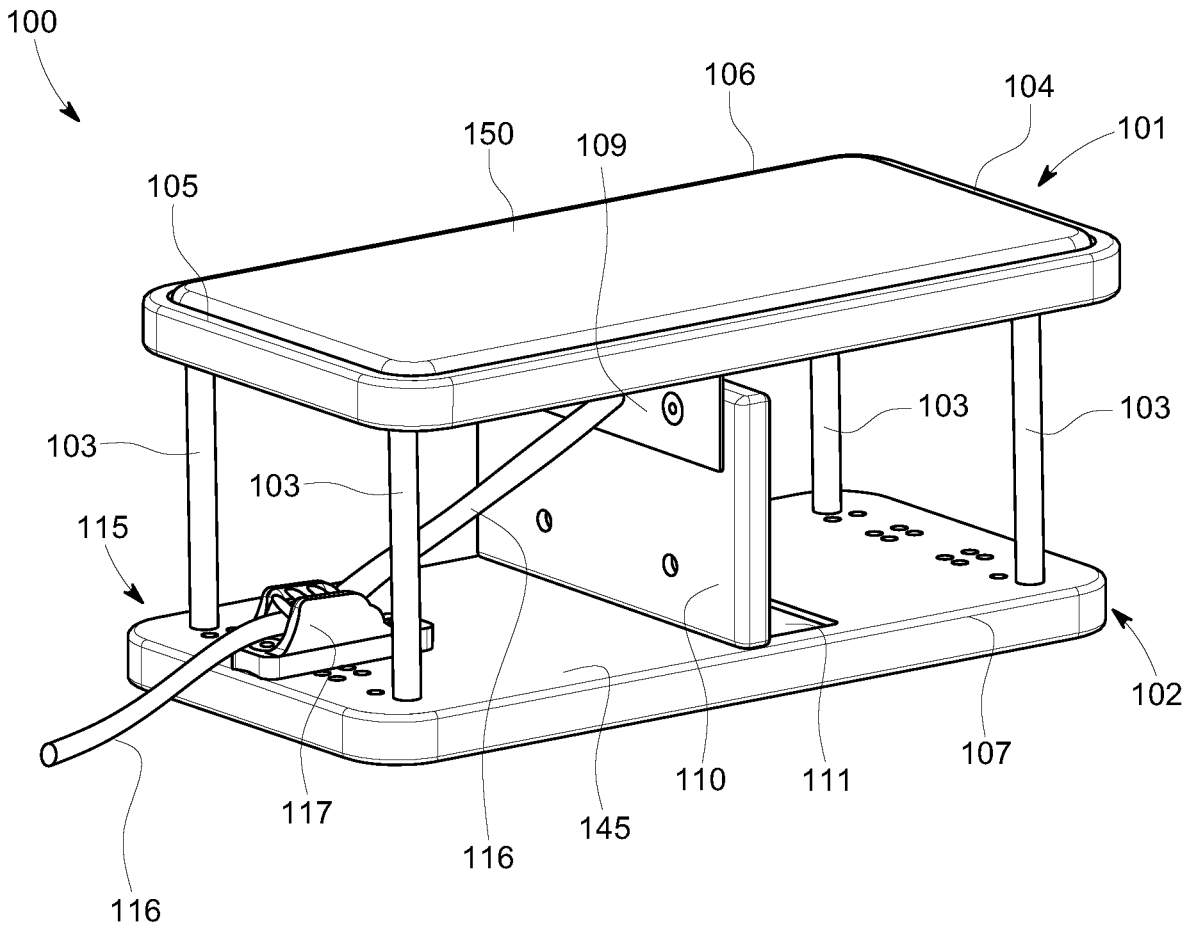
FIG. 2 is a perspective side, back view of the device of FIG. 1 in the open configuration.
Figure 3:
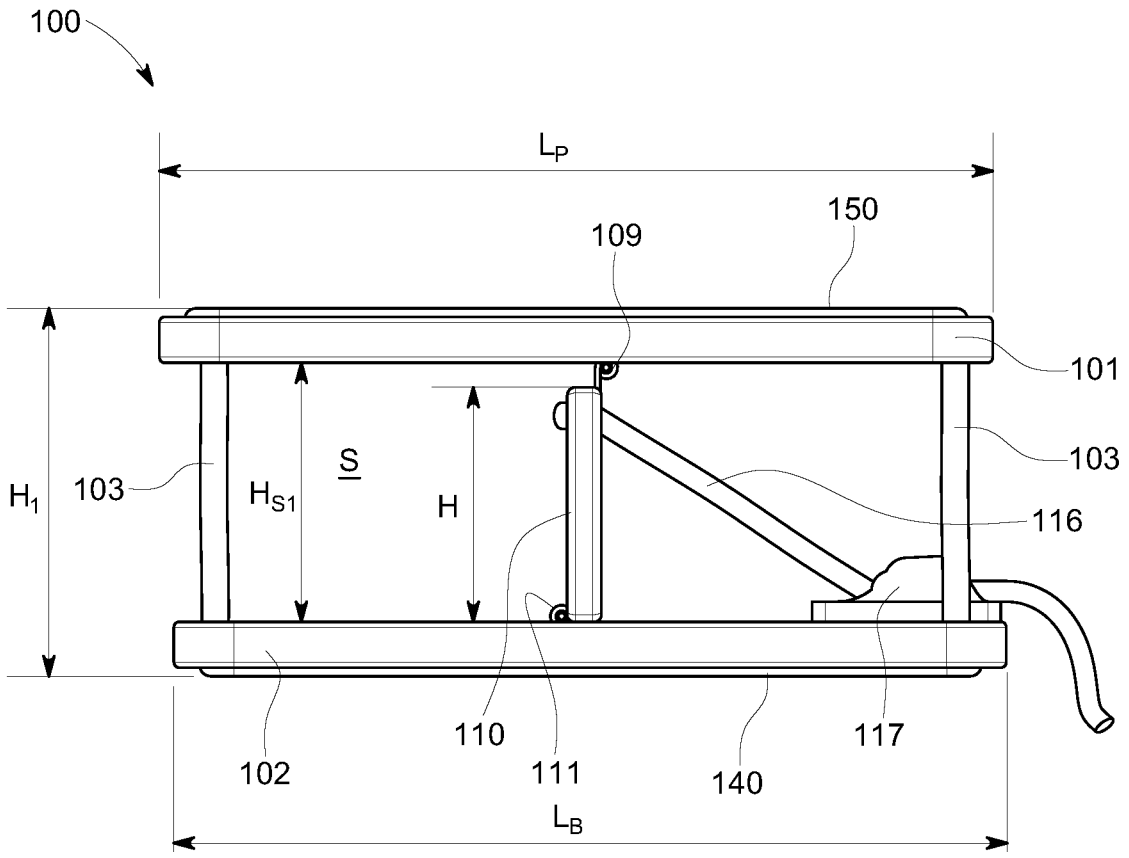
FIG. 3 is a side view of the device of FIG. 1 in the open configuration.
Figure 4:
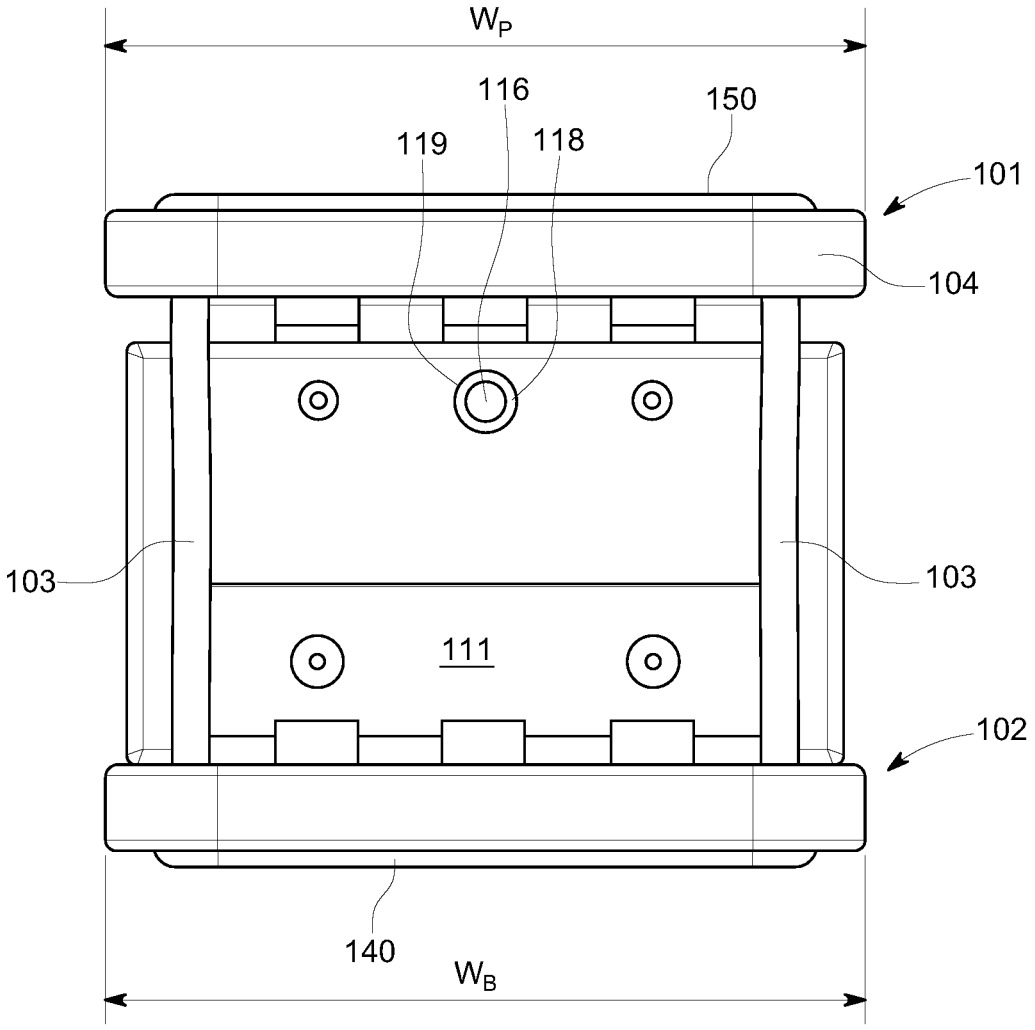
FIG. 4 is a front view of the device of FIG. 1 in the open configuration.
Figure 5:
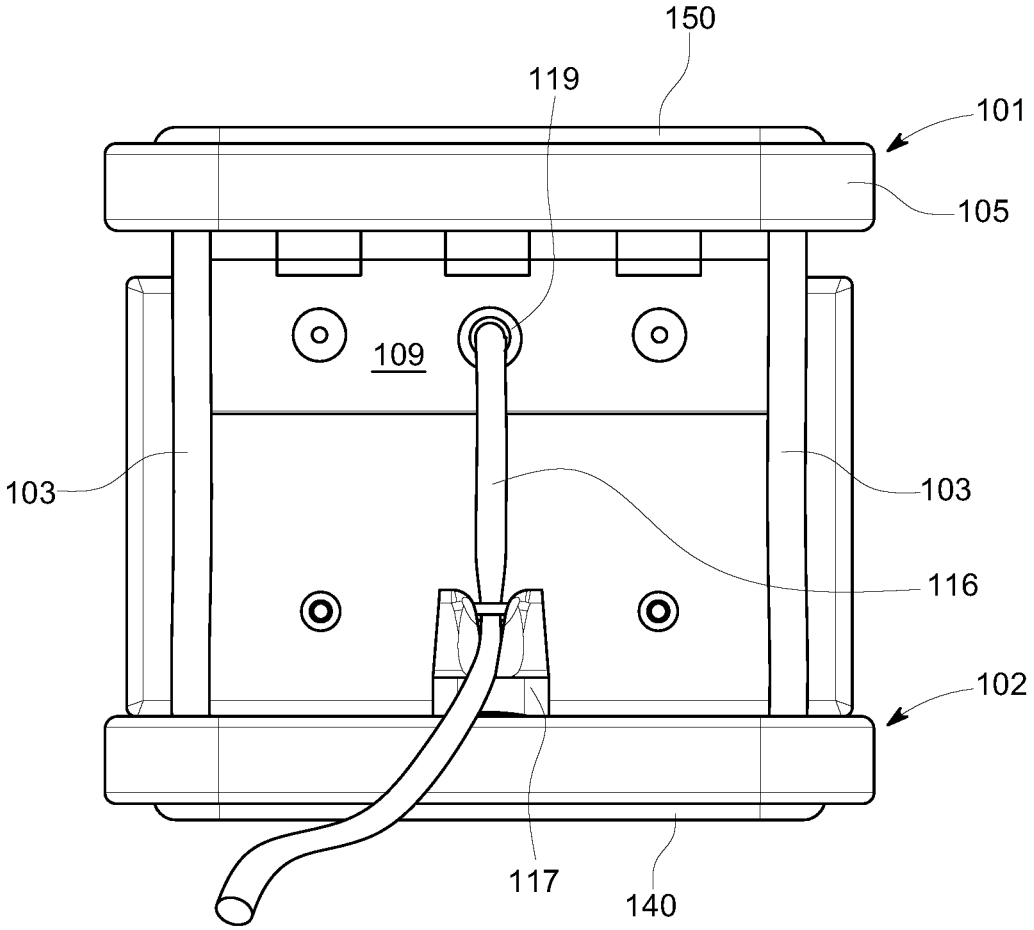
FIG. 5 is a back view of the device of FIG. 1 in the open configuration.

Various conventional thromboprophylaxis techniques typically rely on devices that are cumbersome, complex, and/or expensive. Consequently, such devices are generally impractical for use during transition care or between care locations, or for use by other VTE vulnerable groups, such as, for example, expectant mothers, travelers and/or other individuals sitting for extended periods. To increase thromboprophylaxis utilization, various exemplary embodiments of the present disclosure provide portable devices for exercising an ankle, foot and/or leg, and methods of using such devices, that provide simple and relatively inexpensive prophylaxis by providing full flexion and extension of the ankle joint to increase circulation in the lower extremities of the body. Various exemplary embodiments of the present disclosure, therefore, provide portable exercise devices that may engage both calf muscle pump and venous foot pump to enhance the return of venous blood from the lower extremities to the heart. Increasing circulation may include increasing circulation in body tissues. Movement of bodily fluids, including blood, lymph, and/or interstitial fluids may be achieved through practice of the disclosed methods and use of the disclosed devices. The increased circulation may be found in one or more of blood vessels, the lymphatic system, muscles, interstitial spaces, capillaries and surrounding body tissues. In addition to the movement of fluids through ankle flexion and extension, the pressure applied to the sole of the foot during the exercise, i.e., plantar pressure, also contributes to movement of fluid through the body tissue and to an increase in circulation of bodily fluids. This plantar pressure can have a massaging effect that stimulates nerves, which may cause the release of certain biochemicals that reduce coagulation and dilation in the blood vessels.

In various exemplary embodiments, portable exercise devices for exercising an ankle, foot and/or leg, and related methods, use at least one pedal that is pivotably connected to a base about a pivot axis. The pedal has a neutral position relative to the pivot axis and is generally positioned such that the pivot axis is centrally located along a length of the pedal. When the pedal is in the neutral position, the pedal is substantially parallel to the base and there is a space between the pedal and the base. In this manner, the pedal is configured to rotate about the pivot axis in a first direction away from the neutral position and toward the base (where a first end of the pedal moves toward the base) and in a second direction away from the neutral direction and toward the base (where a second end of the pedal moves toward the base), wherein the second direction is opposite the first direction.

The devices and methods also use a resistance mechanism that is configured to exert a force on the pedal about the pivot axis in a direction opposite to a respective direction of rotation of the pedal about the pivot axis. For example, in accordance with various embodiments, to exercise the ankle, foot, and/or leg of the user, as explained further below, the force exerted by the resistance mechanism is configured to provide a passive resistance to the rotational movement of the pedal. In other words, the resistance mechanism is configured to provide a passive resistance against the rotation of the pedal throughout a full range of ankle flexion and ankle extension.

In accordance with the present disclosure, a pivot axis of the device may be located at a point configured to be positioned below a user's ankle during use. In some embodiments, the pivot axis of the device may be located at a point configured to be positioned below a central portion of a user's foot during use, such that the user's foot undergoes a rocking motion as it moves through a full range of ankle flexion and ankle extension. In additional embodiments, as will be described further below, the device may provide two different types of movements, such that the device has a first movement relative to a first side of the device and a second movement relative to a second side of the device. In this manner, the device may be used in a first open, in-use configuration, and flipped over to be used in a second open, in-use configuration. Thus, in such embodiments, each of the first and second open, in-use configurations of the device may employ a different type of motion on the foot as it moves through the full range of ankle flexion and ankle extension.

Figure 14:
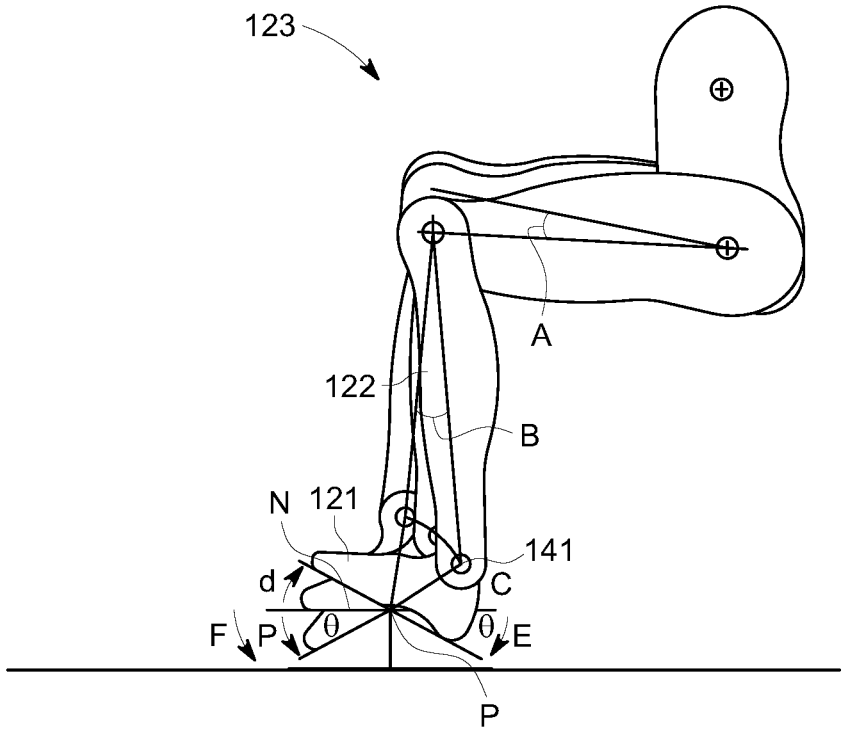
FIG. 14 is a diagram of an exemplary range of motion of the portable exercise devices in accordance with the present disclosure.
Figure 15:
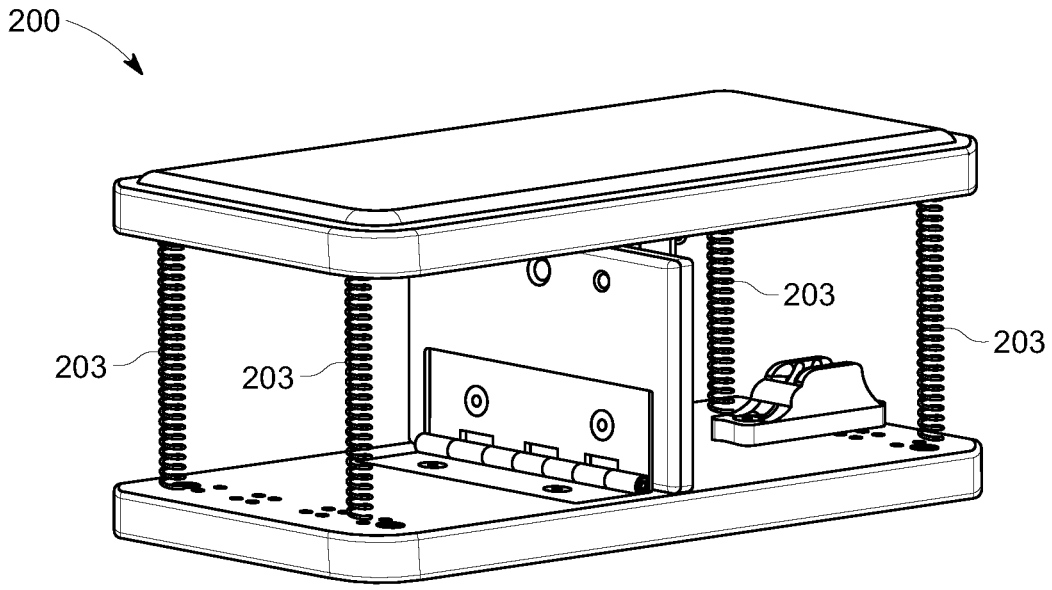
FIG. 15 is a perspective view of another embodiment of a portable device, in an open configuration, in accordance with the present disclosure.
Figure 16:
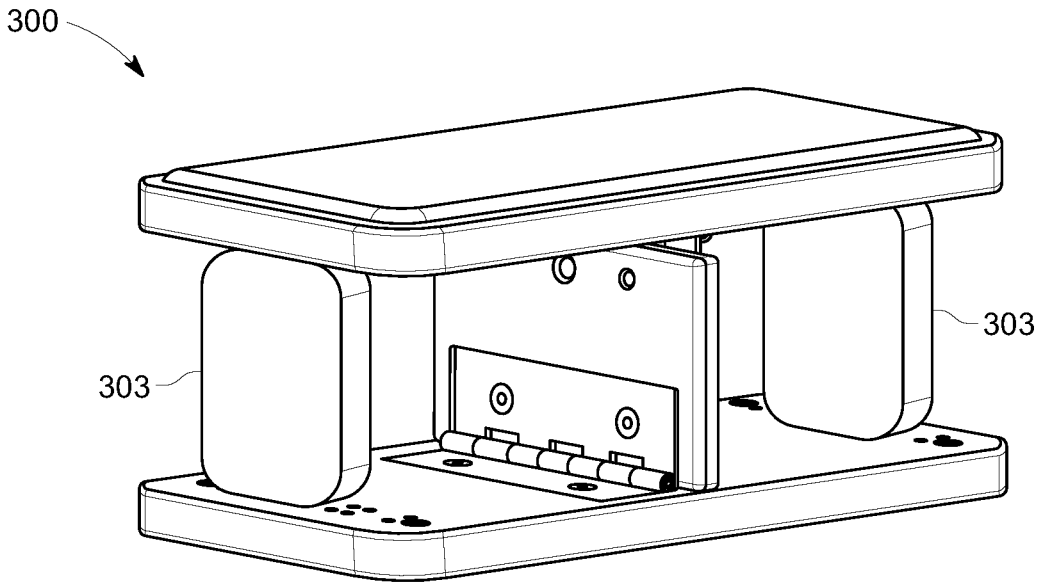
FIG. 16 is a perspective view of another embodiment of a portable device, in an open configuration, in accordance with the present disclosure.
Figure 17:
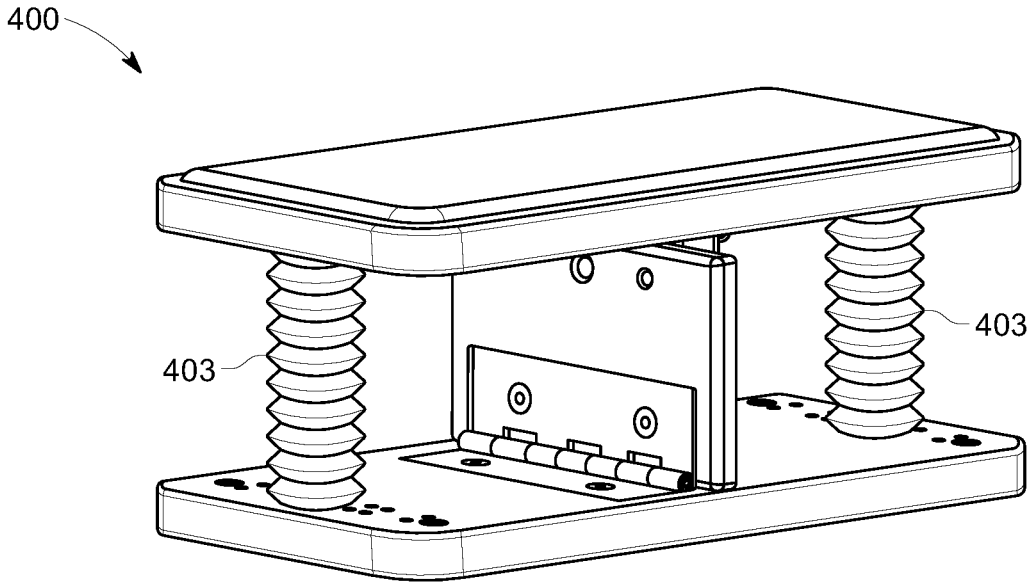
FIG. 17 is a perspective view of yet another embodiment of a portable device, in an open configuration, in accordance with the present disclosure.
Figure 18:
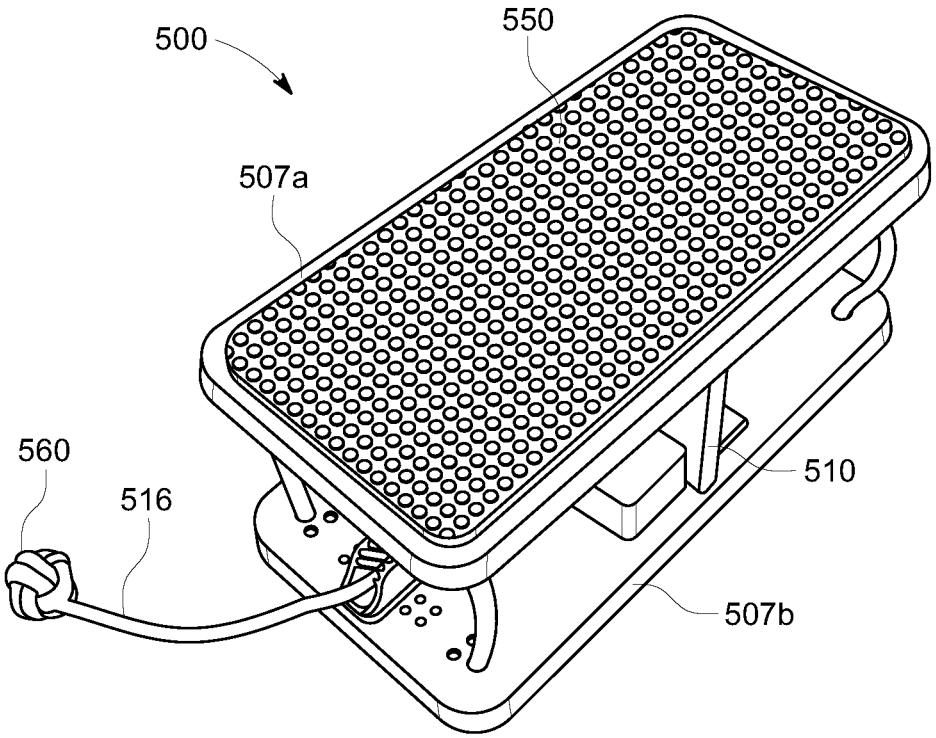
FIG. 18 is a perspective top view of yet another embodiment of a portable exercise device, in an open configuration, in accordance with the present disclosure.
Figure 19:
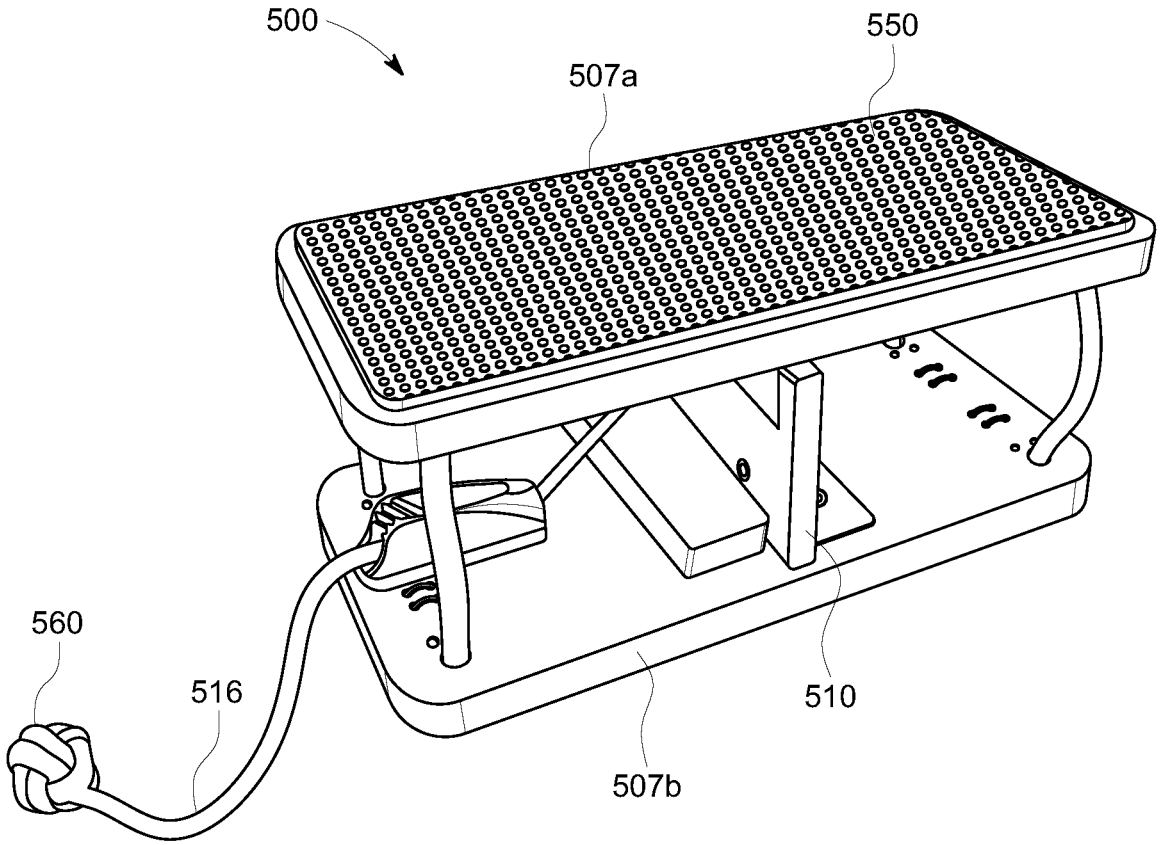
FIG. 19 is a perspective side, front view on the device of FIG. 18 in the open configuration.
Figure 20:
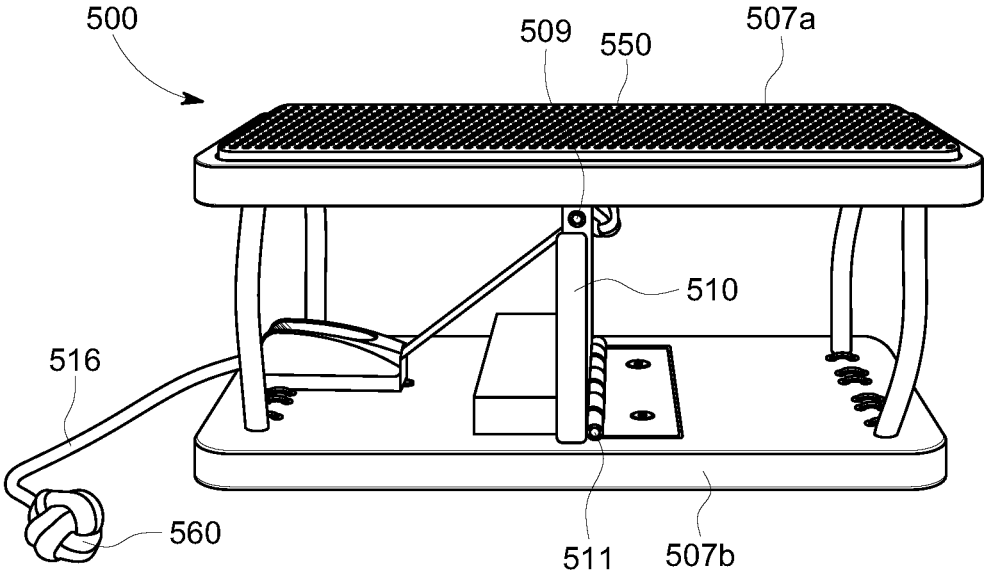
FIG. 20 is a perspective side view of the device of FIG. 18 in the open configuration.
Figure 21:
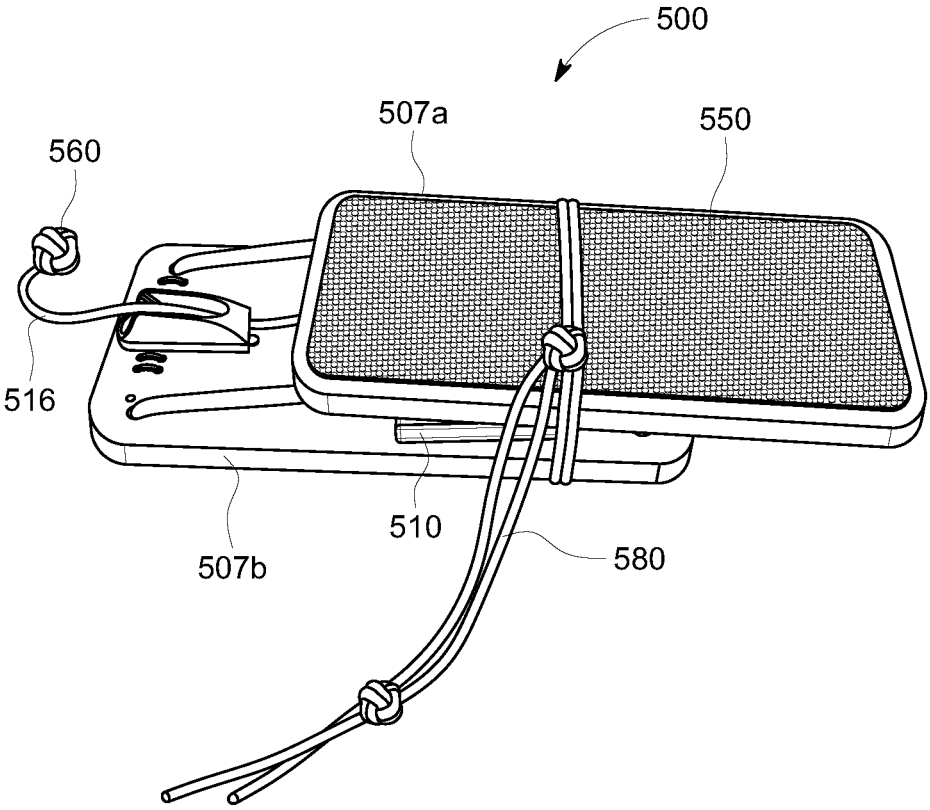
FIG. 21 is a perspective side, top view of the device of FIG. 18 in a closed configuration.

As used herein, the term "full range of ankle flexion and ankle extension" refers to the complete range of motion that the joints of a healthy user's ankle may undergo. In accordance with exemplary embodiments of the present disclosure, as illustrated in FIG. 14, a full range of ankle flexion and extension includes about 75 degrees of plantar flexion motion p (e.g., rotation ranging from about neutral to 75 degrees); and about 60 degrees of dorsiflexion motion d (e.g., rotation ranging from about neutral to −60 degrees). It will be understood, however, that the ambulatory ability of a user may be limited, and that, accordingly, the range of ankle flexion and ankle extension of each individual user may vary and be somewhat to significantly less than the full range of ankle flexion and ankle extension.

Accordingly, as illustrated in the exemplary embodiments shown in the drawings, a portable exercise device in accordance with the present disclosure has a simple configuration, which includes three main parts: 1) a base, 2) at least one pedal pivotably connected to the base, and 3) a resistance mechanism which is configured to resist the rotation of the pedal with respect to a neutral position in at least two opposite directions. Furthermore, for portability, devices in accordance with the present disclosure are adjustable to at least two configurations: 1) an open, in use configuration, wherein the pedal is spaced away from the base to enable the pedal to rotate relative to the base, the pedal being disposed in the neutral position to receive a foot of a user, and 2) a closed configuration, wherein the pedal is adjacent to, collapsed against, or otherwise positioned near the base to minimize a space between the pedal and the base, and thereby the size of the device. The closed configuration does not permit use of the device but is configured to facilitate storage and/or transport of the device.

FIGS. 1-7 illustrate an exemplary exercise device 100, in accordance with an exemplary embodiment of the present disclosure, in an open, in use configuration. FIGS. 8-12 show the exercise device 100 in a closed configuration. As shown in FIGS. 1-12, the exercise device 100 includes a base 102, a pedal 101, and a resistance mechanism 103, with a set of four resistance mechanisms 103 being shown in the embodiment of FIGS. 1-12. As shown, the pedal 101 includes a toe end portion 104 and a heel end portion 105, and the pedal 101 is pivotably connected to the base 102 substantially midway between the toe end portion 104 and the heel end portion 105 of pedal 101, as will be described in further detail below. As illustrated best perhaps in FIGS. 6 and 7, the base 102 provides a bottom surface 140 configured to support the device 100 against a support surface (e.g., the floor, ground, or a vertical support board 160) and configured to resist movement of device 100 relative to the support surface 160 while a user 123 is using the device 100. The pedal 101 provides a foot surface 150 configured to receive and support a foot 121 of the user 123 while the user 123 is using the device 100, as will be described in more detail below.

The pedal 101 may be formed from any material suitable for receiving and supporting the foot of a user in accordance with the present disclosure. In various exemplary embodiments, the pedal 101 may, for example, comprise a molded plastic material, such as, for example, a molded polypropylene material. Those of ordinary skill in the art will understand, however, that the pedal 101 may be made of various plastic materials, as well as various other materials, including, for example, wood and/or metal materials, as described further below. Suitable materials can include, for example, materials that are relatively light to facilitate carrying, packing, and transporting the device 100, yet durable and able to withstand repetitive use/motion.

Figure 6:
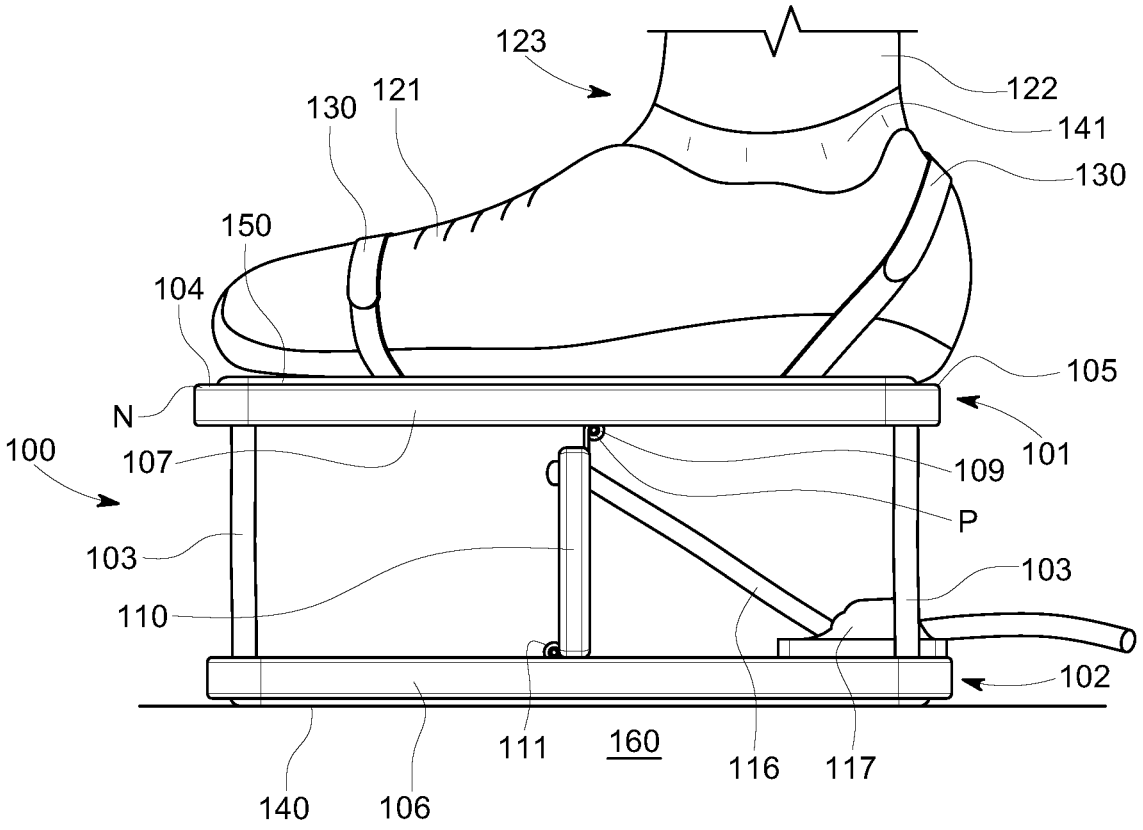
FIG. 6 is a side view of the device of FIG. 1 in the open configuration, showing a user's foot strapped to the device for use in a sitting position.
Figure 7:
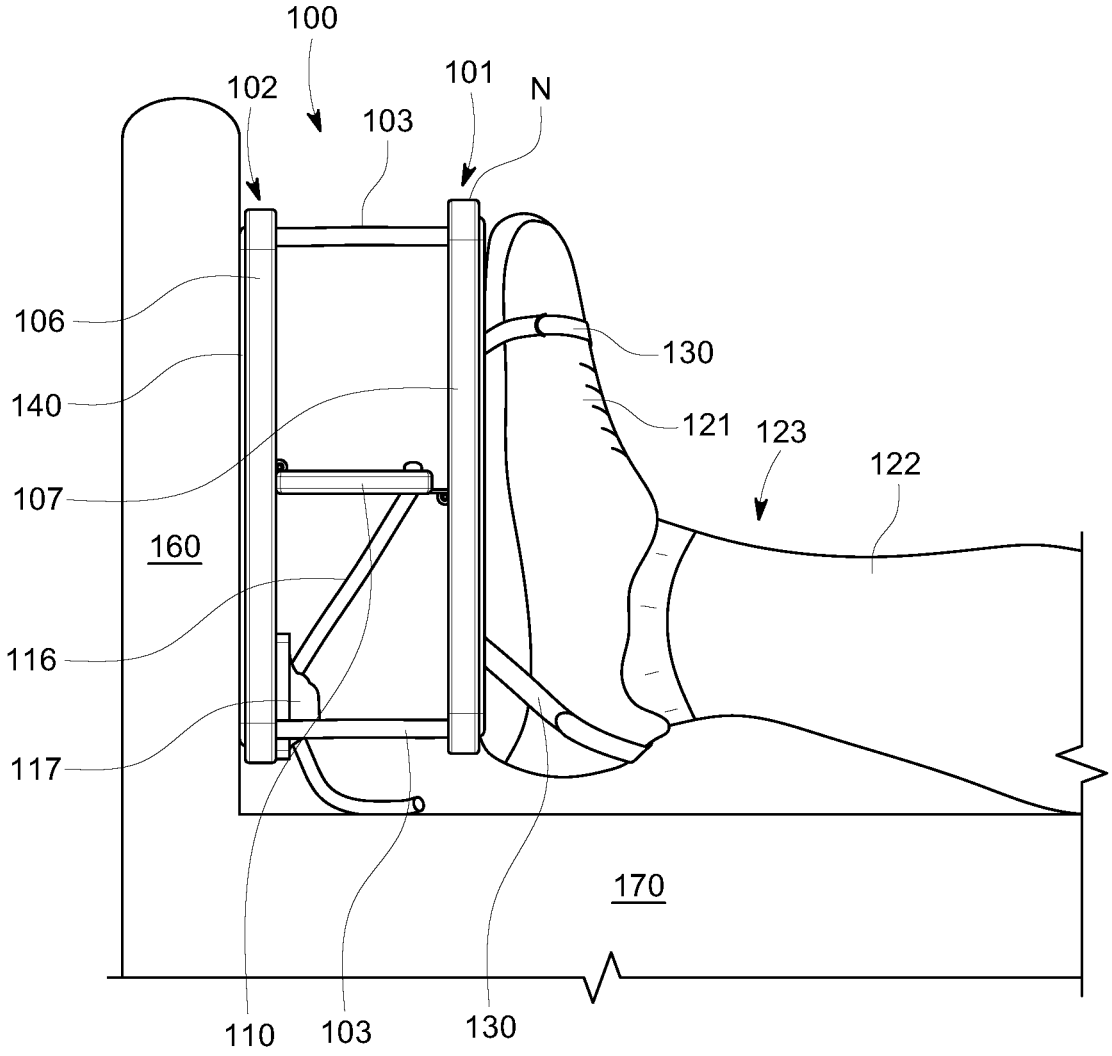
FIG. 7 is a side view of the device of FIG. 1 in the open configuration, showing a user's foot strapped to the device for use in a supine position.
Figure 8:
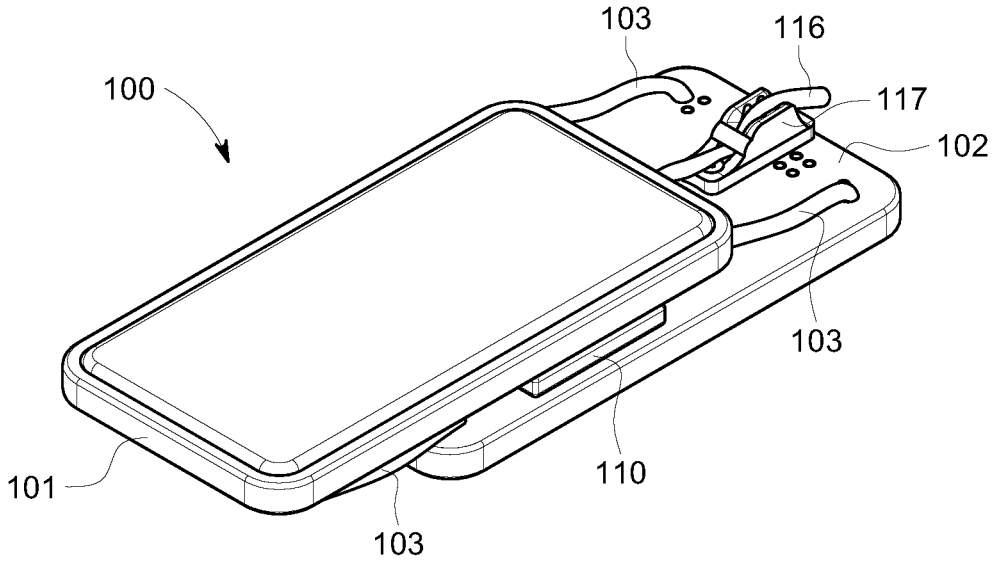
FIG. 8 is a perspective top, front view of the device of FIG. 1 in a closed configuration.
Figure 9:
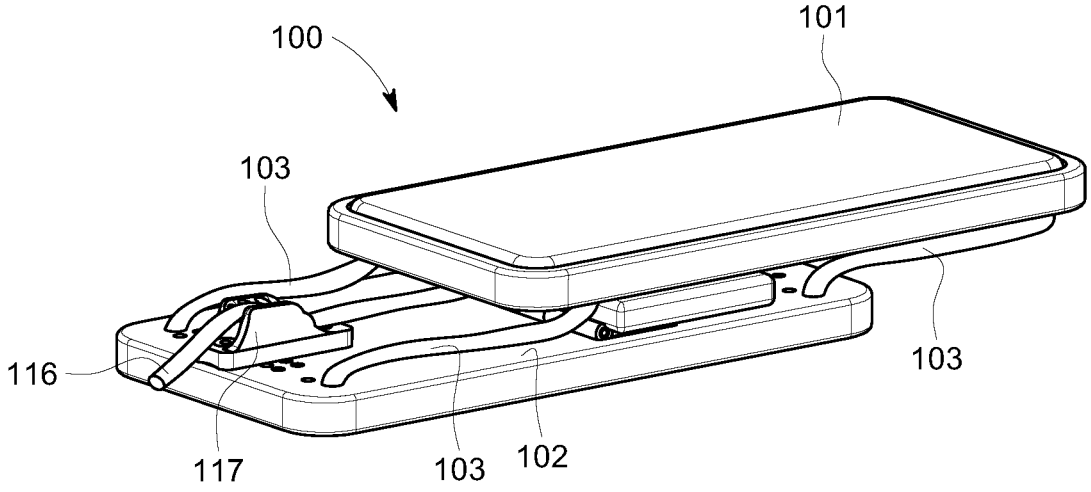
FIG. 9 is a perspective side, back view of the device of FIG. 1 in the closed configuration.
Figure 10:
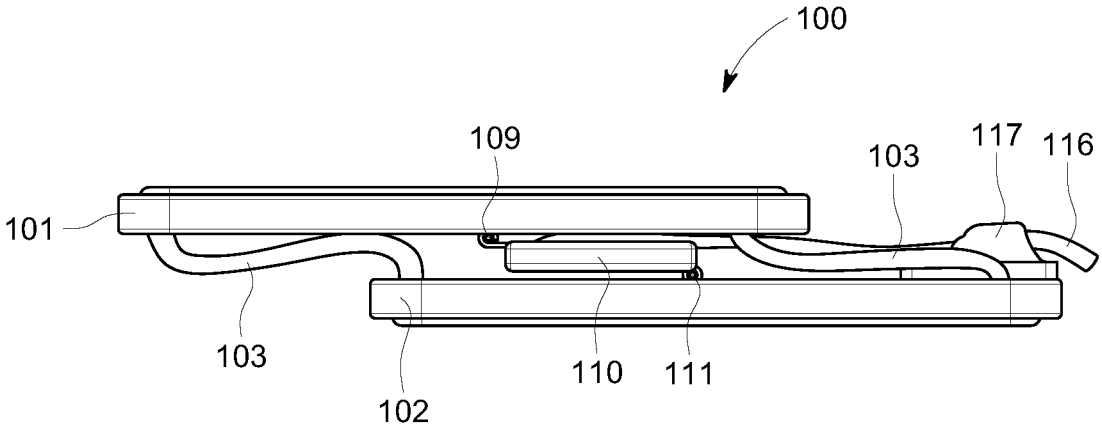
FIG. 10 is a side view of the device of FIG. 1 in the closed configuration.
Figure 11:
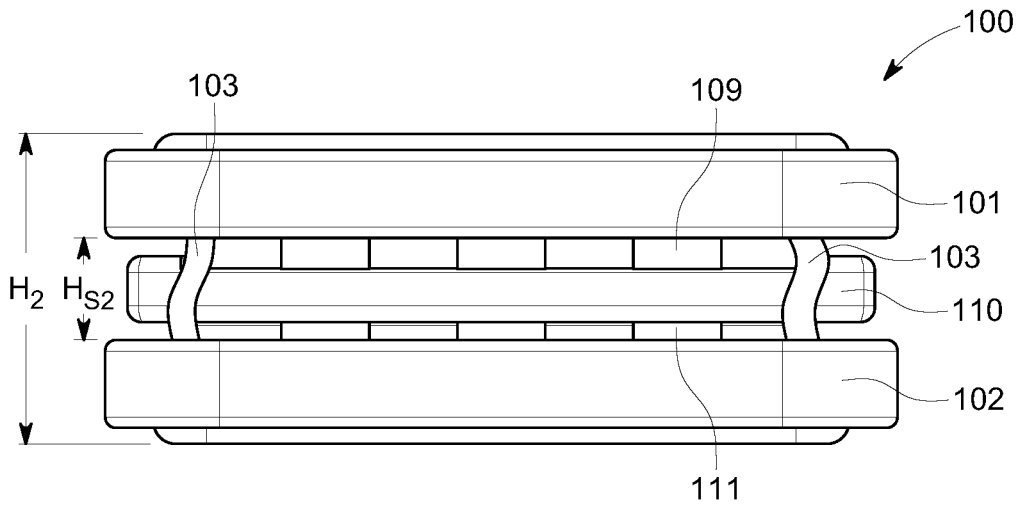
FIG. 11 is a front view of the device of FIG. 1 in the closed configuration.
Figure 12:
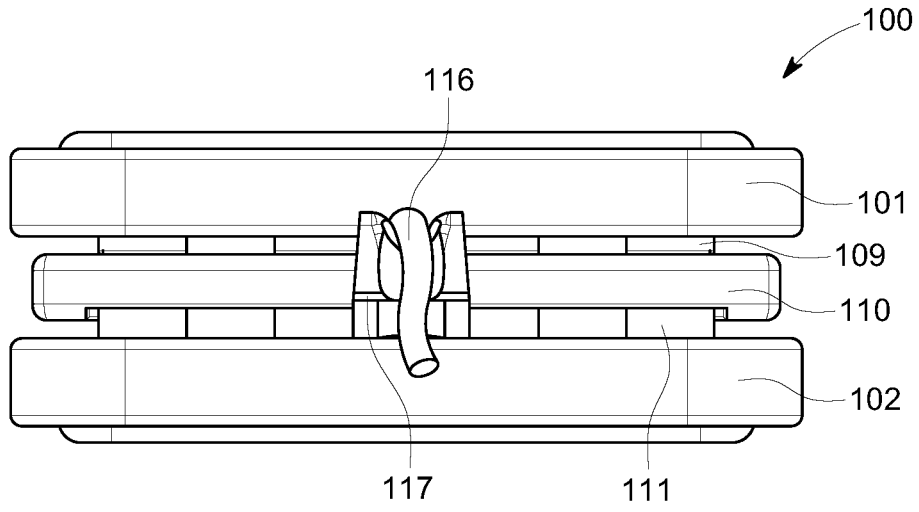
FIG. 12 is a back view of the device of FIG. 1 in the closed configuration.

As illustrated in FIGS. 1-12, the pedal 101 can be shaped to receive a user's foot, for example, the foot 121 of the user 123 (see FIGS. 6 and 7). In one exemplary embodiment, for example, the pedal 101 comprises a substantially flat, rectangular body 107 configured to receive the foot 121 of the user 123. In other exemplary embodiments, as illustrated in the embodiments of FIGS. 22-27, the pedal may comprise a more contoured shape that loosely resembles the shape of a foot. The pedal 101 can be sized to accommodate a range of foot and/or shoe sizes. In various exemplary embodiments of the present disclosure, for example, the pedal 101 can have a length $L_P$ (see FIG. 3) ranging from about 8 inches to about 15 inches, for example from about 9 inches to about 10 inches, and a width $W_P$ (see FIG. 4) ranging from about 2 inches to about 7 inches, for example, about 4 inches to about 5 inches.

As discussed above, the pedal 101 includes a toe end portion 104, a heel end portion 105, and a foot surface 150 extending between the toe end portion 104 and the heel end portion 105. The foot surface 150 may include, for example, various ridges, treads (see, e.g., foot surface 550 of portable exercise device 500 of FIGS. 18-21), coatings, applied surfaces (e.g., grip tape), laser markings, and/or other mechanisms to increase user comfort and/or to increase friction on the foot surface 150 with which the foot comes into contact, for example, to massage the user's foot and/or prevent the foot from slipping on the foot surface 150. Massage of the user's foot, via the foot surface 150 and any elements, coatings, or surfaces applied thereto, will apply pressure to the sole of the foot during the exercise, i.e., plantar pressure, which also contributes to movement of fluid through the body tissue and to an increase in circulation of bodily fluids.

In various embodiments, the foot surface 150 may include a removable pad upon which the foot may rest for comfort and/or additional support. Additionally or alternatively, the pad may be made from a soft, form fitting material, such as, for example, a shape memory polymer, which may conform to the feet of different users, as would be understood by those of ordinary skill in the art. In various additional embodiments, to simplify the device 100, grip tape and/or laser markings may be applied directly to the foot surface 150.

The pedal 101, and the foot surface 150 of the pedal 101, may have various sizes (i.e., dimensions), shapes, configurations and/or features without departing from the scope of the present disclosure. In various embodiments, for example, a foot guide can be placed on the foot surface 150 to assist in the proper placement of a user's foot on the pedal 101. The foot guide may include, for example, a movable guide and/or a printed outline that is representative of several general foot size categories. In various further embodiments, the pedal may also be extensible to accommodate various foot/shoe sizes. For example, the pedal may be extensible such that both ends of the pedal are configured to move away from a center of the pedal a corresponding distance, to maintain a central position of the pivot axis and maintain stability of the device.

The base 102 may be formed from any material and/or combination of materials suitable for mounting the pedal 101 and stably supporting the device 100 relative to the support surface 160 while the user is using the device 100 in accordance with the present disclosure. In various exemplary embodiments, the base 102 may, for example, comprise a molded plastic material, such as, for example, a molded polypropylene material. Those of ordinary skill in the art will understand, however, that the base 102 may be made of various plastic materials, as well as various other materials, including, for example, wood and/or metal materials, as described further below. Suitable materials can include, for example, materials that are relatively light to facilitate carrying, packing, and transporting the device 100, yet durable and able to withstand repetitive use.

As shown in FIGS. 1-12, in one exemplary embodiment of the present disclosure, the base 102 comprises a substantially flat, rectangular body 107 provided with a bottom surface 140 that is configured to rest against a support surface 160, while the user 123 is using the device 100 (see FIGS. 6 and 7). The base 102 is appropriately sized and/or configured to stably support the pedal 101 (e.g., against the support surface 160), when the exercise device 100 is in use. The body 106 of the pedal 101 and the body 107 of the base 102 have similar dimensions such that, when the device 100 is in the open configuration, and the pedal 101 is positioned to receive the foot 121 of the user 123 (see FIGS. 6 and 7), the pedal 101 is substantially parallel to the base 102 and respective corners of the bodies 106 and 107 are substantially in alignment with each other. Thus, in various exemplary embodiments, like the pedal 101, the base 102 can have a length $L_B$ (see FIG. 3) ranging from about 8 inches to about 15 inches, for example from about 9 inches to about 10 inches, and a width $W_B$(see FIG. 4) ranging from about 2 inches to about 7 inches, for example, about 4 inches to about 5 inches.

Figure 43A:
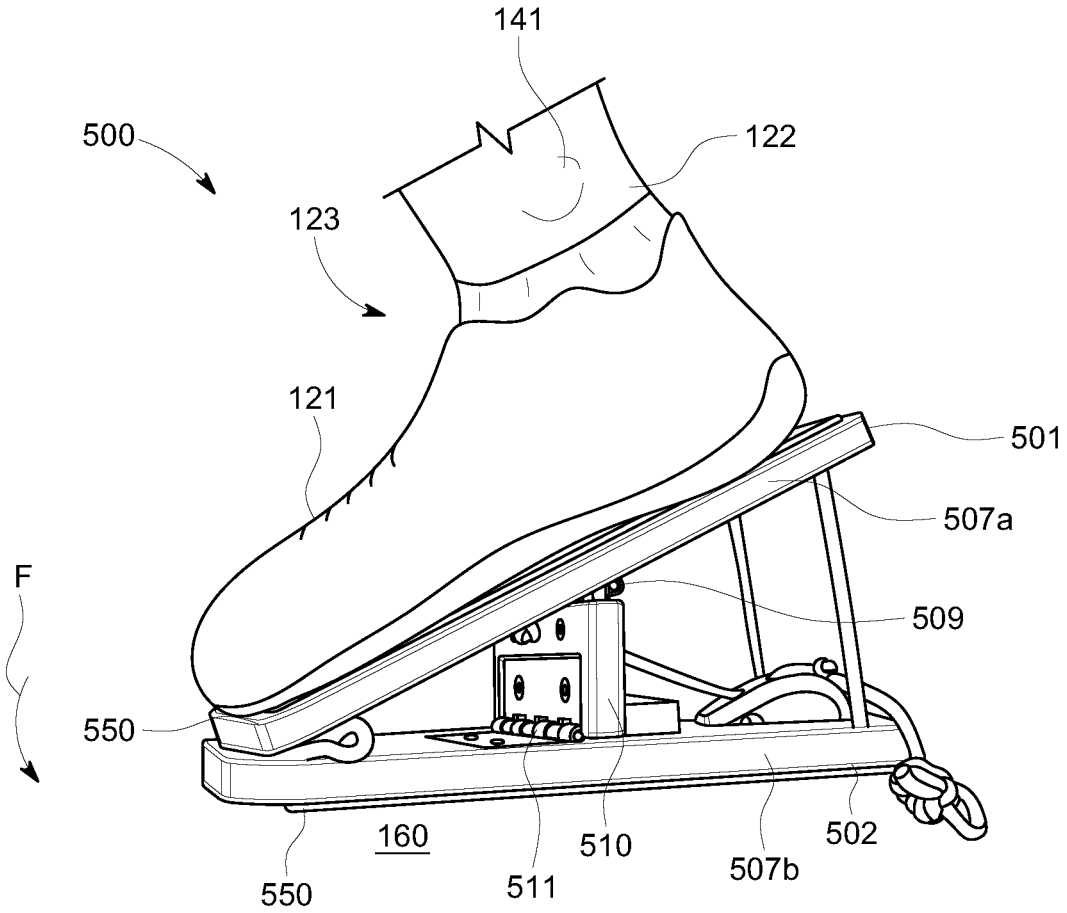
FIG. 43A is a perspective side view of the device of FIG. 18, in a first open configuration, in accordance with the present disclosure, showing a user rotating a pedal of the device in a first direction.
Figure 43B:
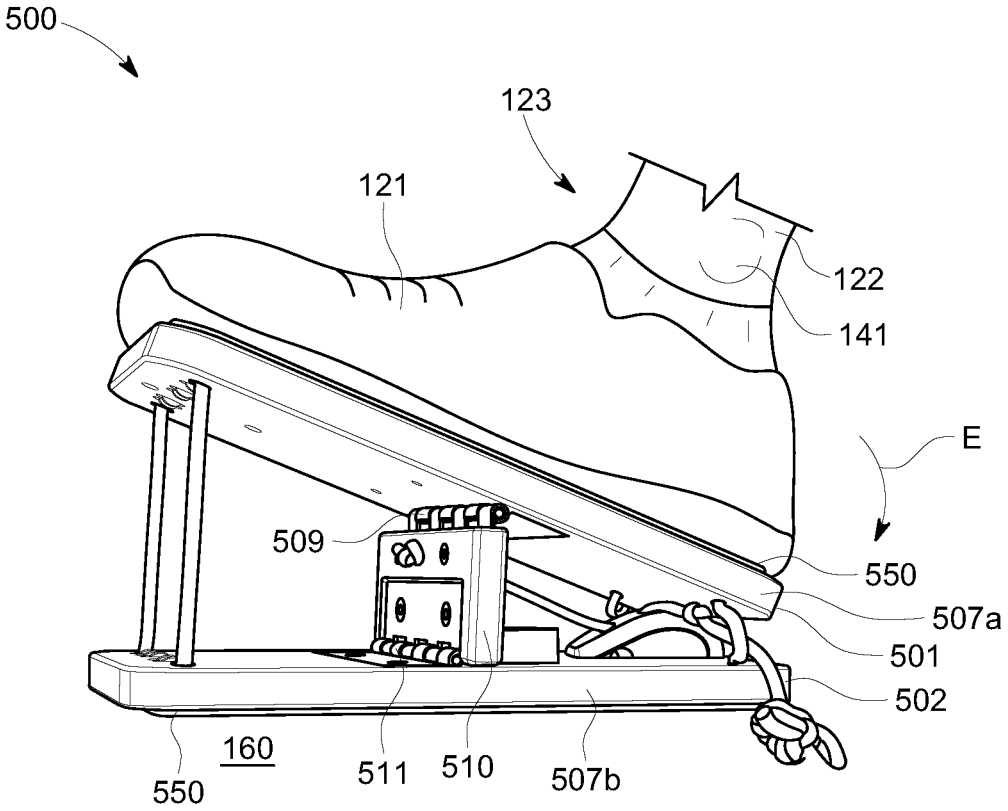
FIG. 43B is a perspective side view of the device of FIG. 18 in the first open configuration, showing a user rotating a pedal of the device in a second direction.

With reference to the device 500 of FIGS. 18-21, and as illustrated in FIGS. 43A-43B, in various other exemplary embodiments, the device 500 may include rectangular bodies 507*a* (i.e., a first body or platform) and 507*b* (i.e., a second body or platform) that may each function as both a pedal and a base. In such embodiments, as will be described in more detail below, the device 500 may have two open, in-use configurations: (1) a first open, in-use configuration in which the rectangular body 507*a* functions as a pedal 501 and the rectangular body 507*b* functions as a base 502 to support the device 500 against a support surface 160 (see FIGS. 43A and 43B); and (2) a second open, in use configuration in which the rectangular body 507*b* functions as the pedal 501 and the rectangular body 507*a* functions as the base 502 to support the device against the support surface 160 (see FIGS. 44A and 44B). In this manner, the device 500 may be flipped over to change between the first and second open, in-use configurations. In such a configuration, as shown, for example, in FIGS. 43A-44B, each of the rectangular bodies 507*a* and 507*b* may include a respective surface 550 that is suitable both to support a foot of the user and provide traction against a support surface (i.e. such that the rectangular body does not slide on the support surface during use).

The base 102 may take on a variety of sizes, shapes, configurations and/or features without departing from the scope of the present disclosure. As illustrated in FIGS. 1-21, in some embodiments, for example, the base is solid, while in other embodiments, the base has cutouts (see, e.g., FIGS. 22-27) configured to reduce the weight of the base. Furthermore, in some embodiments, the bottom surface 140 of the base 102 may include various ridges, treads, coatings, applied surfaces, and/or other mechanisms to increase friction between the bottom surface 140 and the support surface 160 upon which the base 102 rests to prevent slippage of the base 102 on the support surface 160. In other embodiments, the base 102 may be configured to be secured to the support surface 160, via, for example, a bolt, screw, hook and loop material, and/or clamp. And, in further embodiments, as will be described in more detail below, the base may include a pair of collapsible supports that are connected to the pedal via aligned hinges, such that when the device is in the open configuration the supports form a triangular body (e.g., an A-frame or tent) that supports the pedal. In such an embodiment, a bottom surface of each support may include a mechanism to increase friction between the bottom surface of the support and the support surface. For example, as illustrated in the embodiments of FIGS. 52-58, the feet of each support 1810*a*, 1910*a* and 1810*b*, 1910*b* may include rubber booties 1850, 1950 to increase friction between the feet and the support surface. In various further embodiments, the feet of each support 1810*a*, 1910*a* and 1810*b*, 1919*b* may be increased in size, have a different shape (e.g., to provide a different contact angle with the support surface), include various types and/or configurations of non-slip grips on a bottom surface thereof (e.g., include various ridges or other irregular surfaces integral with the feet or applied to a bottom surface thereof) to increase friction between the bottom surface of the support and the support surface.

In accordance with various embodiments, for example, to accommodate users in various positions, the device 100 may be used in both a sitting position (see FIG. 6) and a supine position (see FIG. 7). For example, as will be understood by those of ordinary skill in the art, the positioning of the device 100 can be adjusted such that the foot support portion 101 is disposed in a first position wherein the pedal 101 is in a neutral position N to receive a foot 121 of a user 123 in a sitting position (see FIG. 6) and a second position wherein the pedal 101 is in the neutral position N to receive a foot 121 of a user 123 in a supine position (see FIG. 7). In one example, to better support use in the supine position, the bottom surface 140 of the base 102 may be secured to a vertical support surface 160, such as, for example, a backboard 160 of a bed surface 170, as illustrated in FIG. 7.

As illustrated in FIGS. 6 and 7, in such embodiments (e.g., wherein the device 100 is secured to the support surface 160), the device 100 may further comprise at least one strap 130 affixed to the pedal 101, two straps 130 (i.e., a toe strap and a heel strap) being shown in the embodiment of FIGS. 6 and 7. The straps 130 may, for example, be configured to releasably secure the foot 121 of the user 123 to the pedal 101. The straps 130 can be adjustable to permit loosening and tightening of the straps 130 around a user's foot. By way of example only, the straps 130 may comprise hook and loop fasteners, such as, for example, Velcro®. Those of ordinary skill in the art will further understand that the straps 130 may comprise any type and/or configuration or mechanism to releasably secure a foot of the user to the pedal 101, including for example, snaps, buttons, ties, buckles, elastic bands and/or any combination thereof. As will also be understood by those of ordinary skill in the art, the presence of a strap or other securing means is optional and is not necessary for use of the device. In some embodiments, for the device to be functional while secured to a user's foot, the base of the device must be secured to the floor, ground, or other stable surface. Thus, in some embodiments and in certain environments, operation of the device without a securing means may be preferred.

In accordance with exemplary embodiments of the present disclosure, the pedal 101 is pivotably connected to the base 102 via at least one hinge. As illustrated best perhaps in the open configuration of FIGS. 1-7, in one exemplary embodiment, the pedal 101 is pivotably mounted to the base 102 via a double-hinged support. For example, as shown in FIGS. 1-7, a support 110 is positioned between a first hinge 109 and a second hinge 111, wherein the first hinge 109 is connected to the pedal 101 and the second hinge 111 is connected to the base 102. As shown, the support 110 may be connected to the pedal 101, via the hinge 109, substantially midway between the toe end portion 104 and the heel end portion 105 of the body 106 of pedal 101. The support 110 may also be mounted to the base 102, via the hinge 111, substantially midway between corresponding end portions of the body 107 of base 102. In this manner, the support 110 is configured to rotate, via the hinges 109 and 111, between an upright position (see FIGS. 1-7) and a collapsed position (see FIGS. 8-12), as will be explained further below. When the support 110 is positioned in the upright position, as illustrated in FIGS. 1-7, the support 110 extends between and substantially perpendicular to the parallel bodies 106 and 107 of the pedal 101 and the base 102, respectively, thereby creating a space S therebetween (see FIG. 3). In such a configuration, the pedal 101 can pivot, via the hinge 109, toward and away from the base 102, and can have a neutral position N relative to a pivot axis P (see FIG. 14).

In accordance with additional exemplary embodiments, such as, for example, the dual-sided base support/pedal embodiment of FIGS. 18-21 and 43A-44B, the rectangular body 507*a* (i.e., a first body or platform, which may function as either the pedal 501 or the base 502) is pivotably connected to the rectangular body 507*b* (i.e., a second body or platform, which can also function as either the pedal 501 or the base 502) via at least two hinges. Similar to the embodiment of FIGS. 1-12, for example, in one exemplary embodiment, the rectangular body 507*a* is pivotably mounted to the rectangular body 507*b* via a double-hinged support. For example, as shown in FIGS. 18-21 and 43A-44B, a support 510 is positioned between a first hinge 509 and a second hinge 511, wherein the first hinge 509 is connected to the rectangular body 507*a* and the second hinge 511 is connected to the rectangular body 507*b*. As shown, the support 510 may be connected to the rectangular body 507*a*, via the hinge 509, substantially midway between corresponding end portions of the rectangular body 507*a*. The support 510 may also be mounted to the rectangular body 507*b*, via the hinge 511, substantially midway between corresponding end portions of the rectangular body 507*b*. In this manner, the support 510 is configured to rotate, via the hinges 509 and 511, between an upright position (see FIGS. 18-20) and a collapsed position (see FIG. 21). When the support 510 is positioned in the upright position, as illustrated in FIGS. 18-21, the support 510 extends between and substantially perpendicular to the parallel rectangular bodies 507*a* and 507*b*, thereby creating a space therebetween. Thus, similar to the embodiment of FIGS. 1-12, in the first open, in-use configuration, the rectangular body 507*a*, acting as the pedal 501 can pivot, via the hinge 509, toward and away from the rectangular body 507*b*, acting as the base 502 (see FIGS. 43A and 43B), and can have a first neutral position $N_1$ relative to a pivot axis P. And, in the second open in-use configuration, the rectangular body 507*b*, acting at the pedal 501 can pivot, via the hinge 509, toward and away from the rectangular body 507*a*, acting as the base 502 (see FIGS. 44A and 44B), and can have a second neutral position $N_2$ relative to the pivot axis P.

Figure 13A:
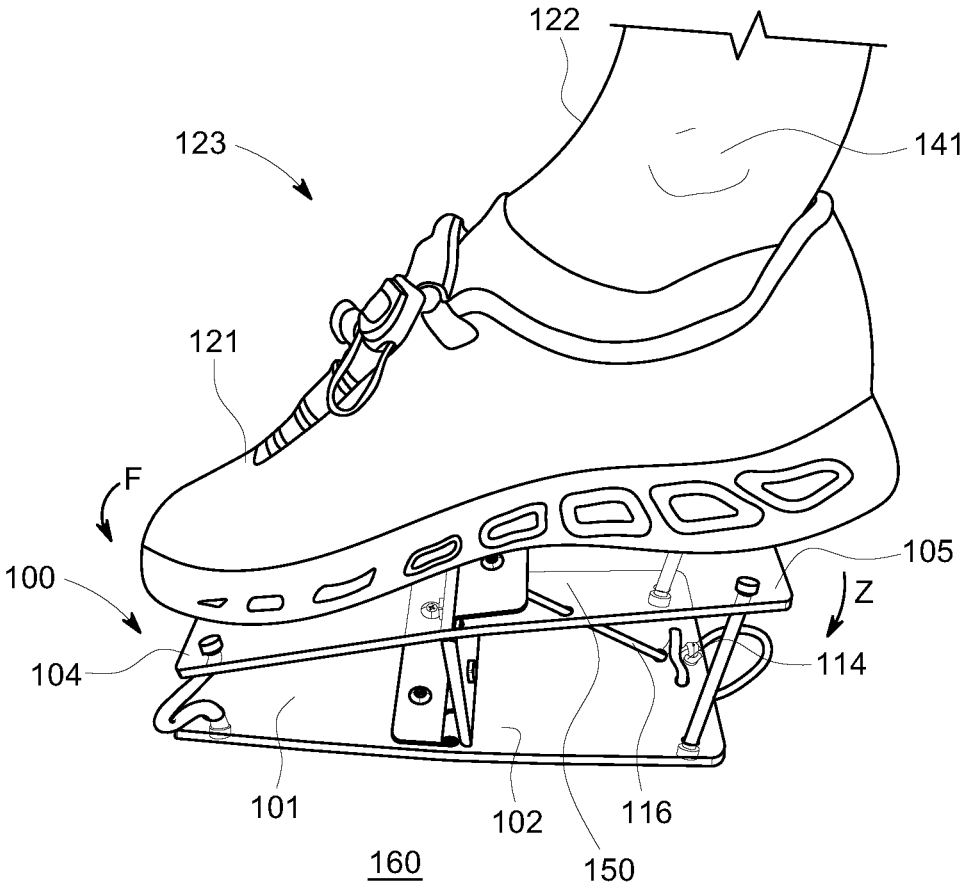
FIG. 13A is a perspective side view of another embodiment of a portable exercise device, in an open configuration, in accordance with the present disclosure, showing a user rotating a pedal of the device in a first direction.
Figure 13B:
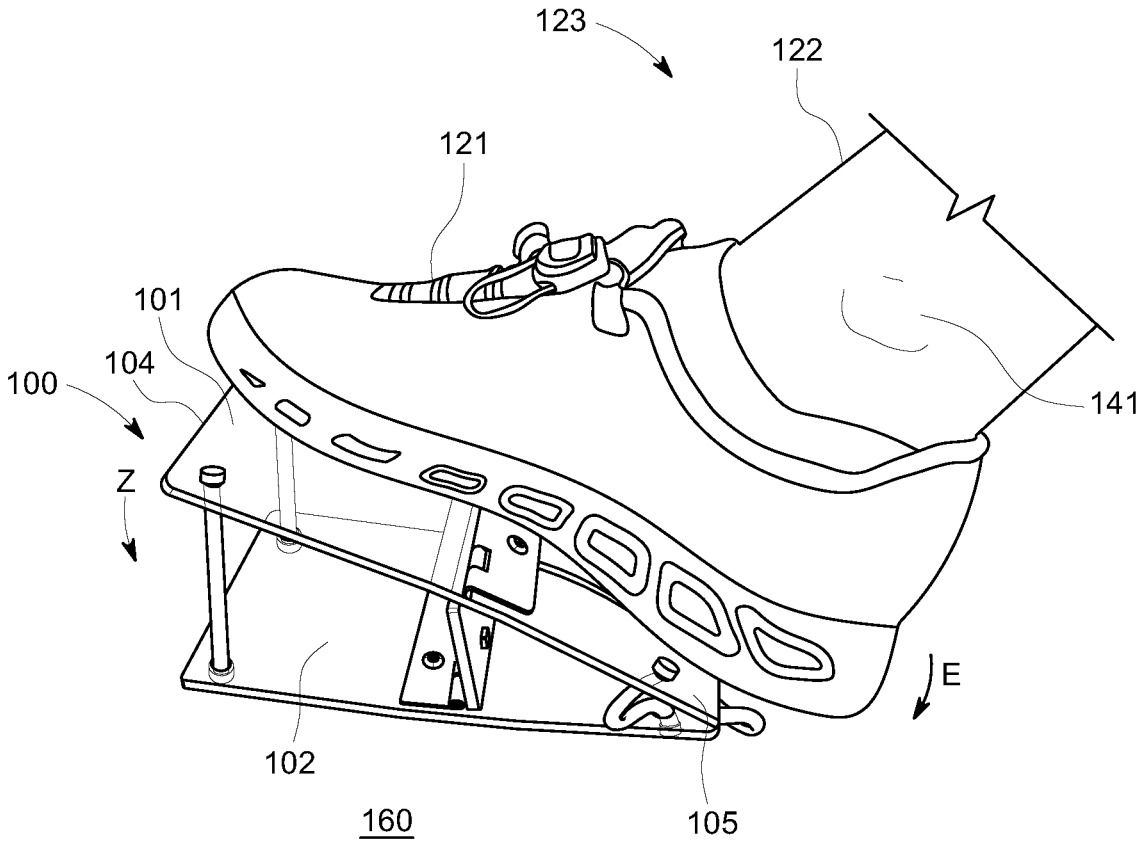
FIG. 13B is a perspective side view of the device of FIG. 12B in the open configuration, showing a user rotating a pedal of the device in a second direction.

As used herein, the term "neutral position" refers to a pedal starting position and a position of the pedal without external forces acting thereon to pivot the pedal about the pivot axis P (e.g., about the hinge 109, 509). Thus, when a pedal is in the "neutral position," the foot of a user, which is received by the pedal, is in a relaxed, un-flexed position (i.e., the user's foot is neither extended or flexed). In the exemplary embodiment of FIGS. 1-7, in the "neutral position", the pedal 101 is substantially parallel to the base 102. With reference to FIGS. 13A, 13B, and 14, the pedal 101 is configured to rotate about the pivot axis P in a first direction away from the neutral position N and toward the base 102 and in a second direction away from the neutral position N and toward the base 102, wherein the second direction is opposite the first direction. For example, the pedal 101 is configured to undergo a rocking type motion in which the pedal 101 rotates about the pivot axis P in a first direction F away from the neutral position N (see FIG. 13A) in which the toe end portion 104 moves toward the base 102 (and the heel end portion 105 moves away from the base 102) and in a second direction E (see FIG. 13B) away from the neutral position N in which the heel end portion 105 moves toward the base 102 (and the toe end portion 104 moves away from the base 102). In this manner, rotation is around the axis P provided by the hinge 109 on the device 100, and, as illustrated in FIG. 14, the user's ankle 141 must pivot around this axis in an arc C. Consequently, the user's leg 122 must also move, in both an arc B and an arc C, to accommodate the rotation of the ankle 141 about the pivot P. For example, when the user 123 performs a plantarflexion motion, the ankle 141 rises, so the leg 122 must also rise. Similarly, when the user 123 performs a dorsiflexion motion, the ankle 141 lowers, so the leg 122 must also move lower.

Similar to the embodiment of FIGS. 1-7, in the exemplary embodiment of FIGS. 18-21, in the "neutral position", when in the first, open in-use configuration, the rectangular body 507*a*, acting as the pedal 501, is substantially parallel to the rectangular body 507*b*, acting as the base 502. With reference to FIGS. 43A and 43B, the rectangular body 507*a* is configured to rotate about the pivot axis P in a first direction away from the neutral position N and toward the rectangular body 507*b* and in a second direction away from the neutral position N and toward the rectangular body 507*b*, wherein the second direction is opposite the first direction. Thus, in such a configuration, similar to the embodiment of FIGS. 1-7, the rectangular body 507*a* is configured to undergo a first type of motion, a rocking type of motion in which the rectangular body 507*a* rotates about the pivot axis P, while the support 510 is held in a fixed position. In other words, like the embodiment of FIGS. 1-7, the pivot axis P is directly adjacent to a foot of a user, such that the rectangular body 507*a* by itself rotates about the pivot axis P, in a first direction F away from the neutral position N (see FIG. 43A) in which a toe end portion moves toward the rectangular body 507*b* (and the heel end portion moves away from the rectangular body 507*b*) and in a second direction E (see FIG. 43B) away from the neutral position N in which the heel end portion moves toward the rectangular body 507*b* (and the toe end portion moves away from the rectangular body 507*b*). In this manner, while in the first, in-use configuration, the rectangular body 507*a* moves in a pivot, with rotation around the pivot axis P provided by the hinge 509 (i.e., the active hinge is located at the top of the support 510 and adjacent the foot 121), and, as illustrated in FIG. 14, the user's ankle 141 also must pivot around this axis in an arc C. Thus, while in the first, in-use configuration, the movement of the rectangular body 507*a* subjects the foot 121 of the user 123 to a first motion, which comprises pivoting the foot 121 about the ankle 122, while moving the ankle 141 in the arc C.

Figure 44A:
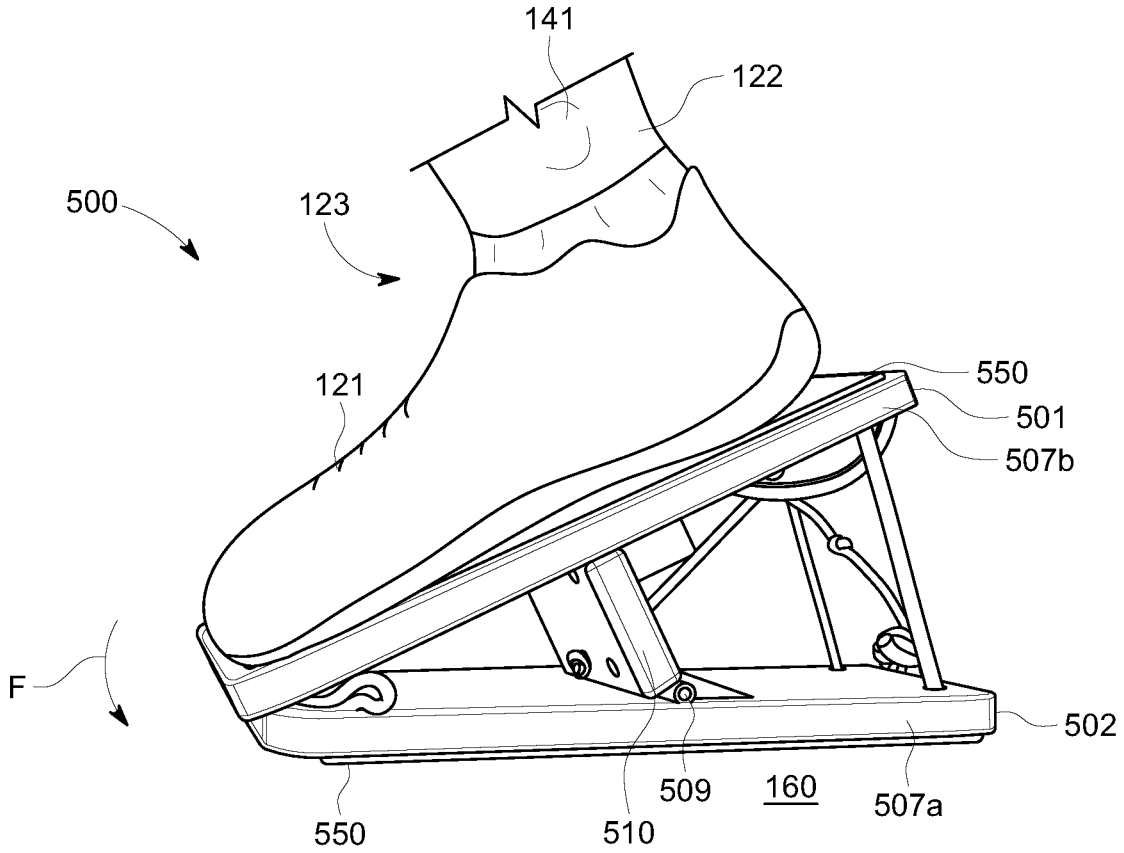
FIG. 44A is a perspective side view of the device of FIG. 18, in a second open configuration, in accordance with the present disclosure, showing a user rotating a pedal of the device in a first direction.
Figure 44B:
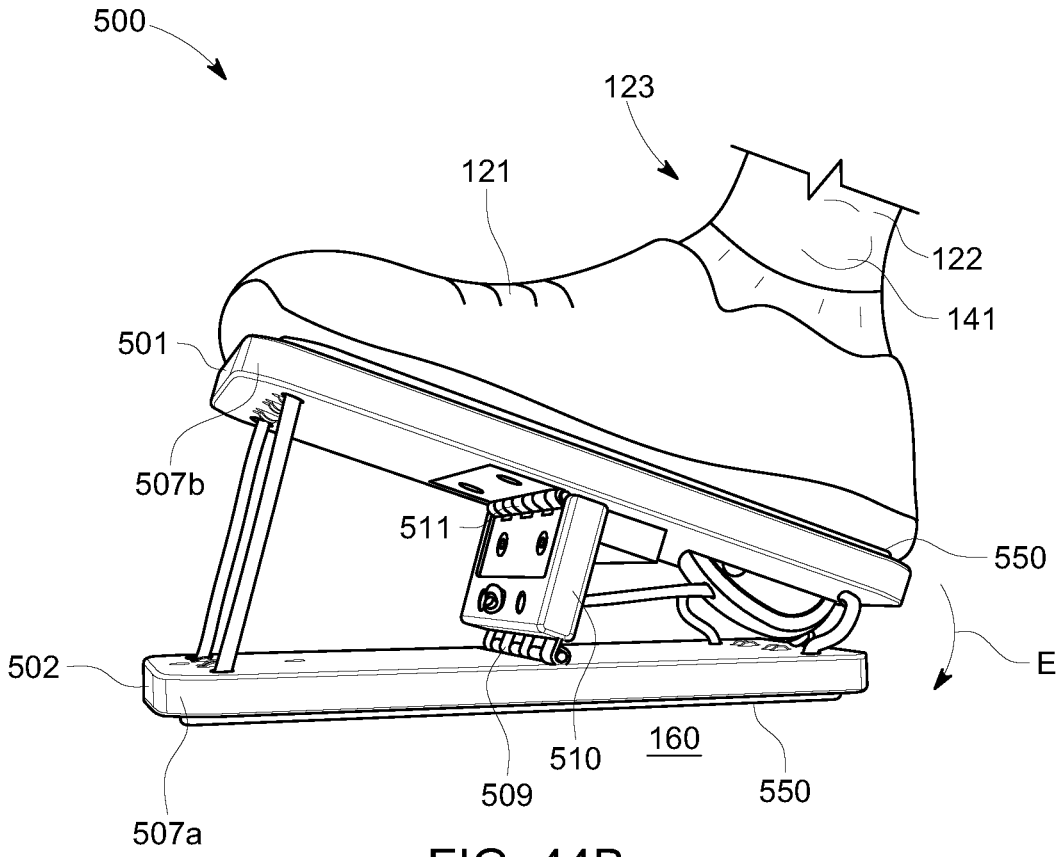
FIG. 44B is a perspective side view of the device of FIG. 18 in the second open configuration, showing a user rotating a pedal of the device in a second direction.
Figure 45:
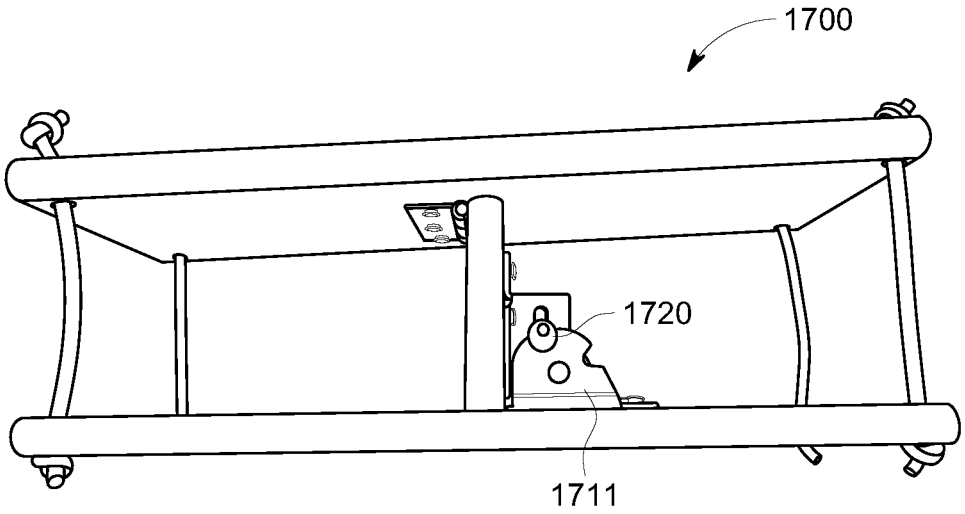
FIG. 45 is a perspective side view of another exemplary embodiment of a portable exercise device, in an open configuration, in accordance with the present disclosure.
Figure 46:
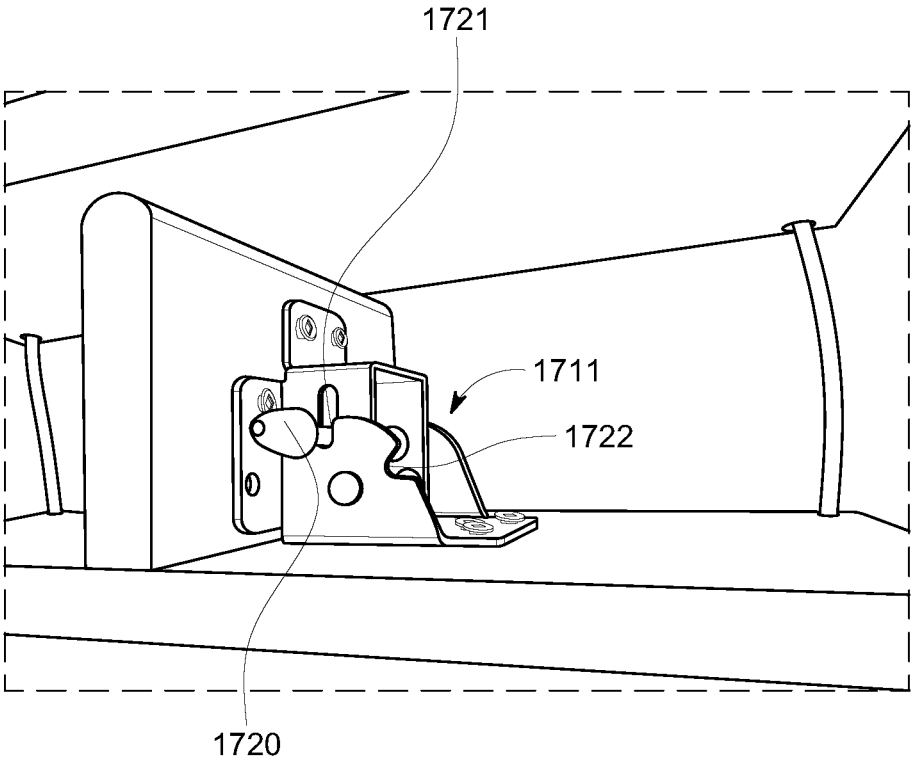
FIG. 46 is an enlarged, partial perspective side, back view of the device of FIG. 45 showing a self-locking hinge in accordance with the present disclosure.
Figure 47:
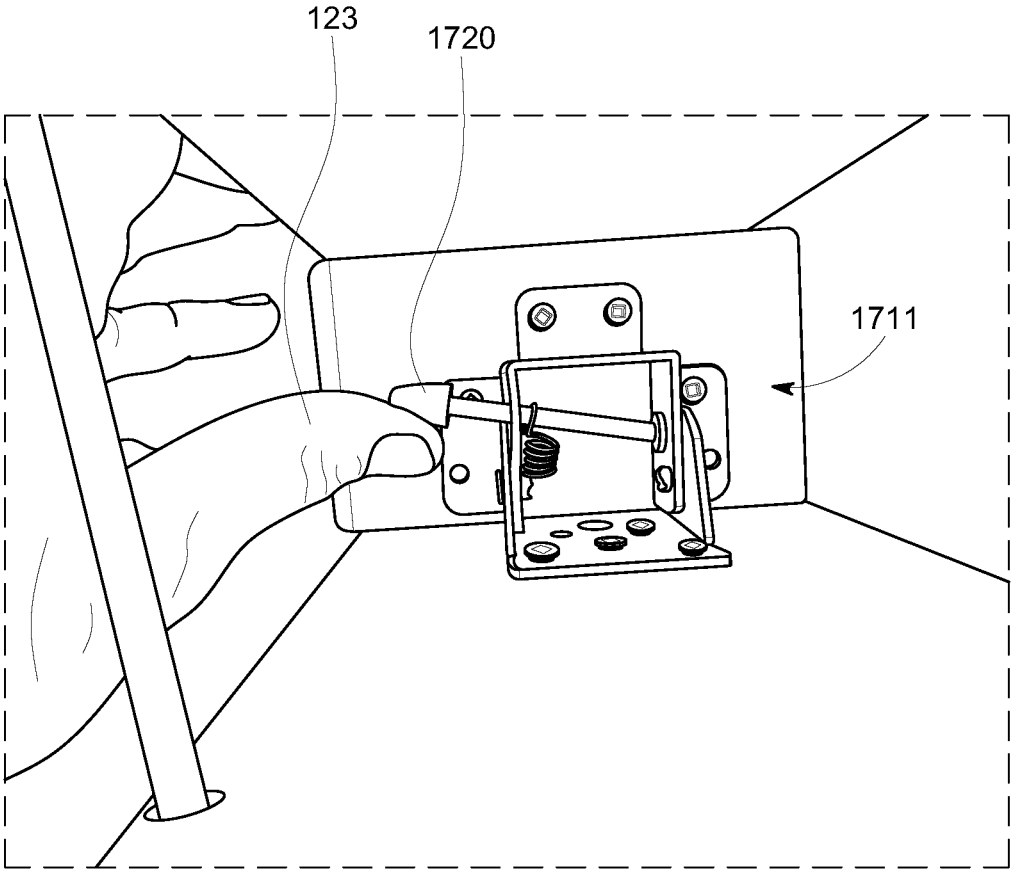
FIG. 47 is an enlarged, partial perspective back view of the device of FIG. 45 illustrating operation of the self-locking hinge.
Figure 48:
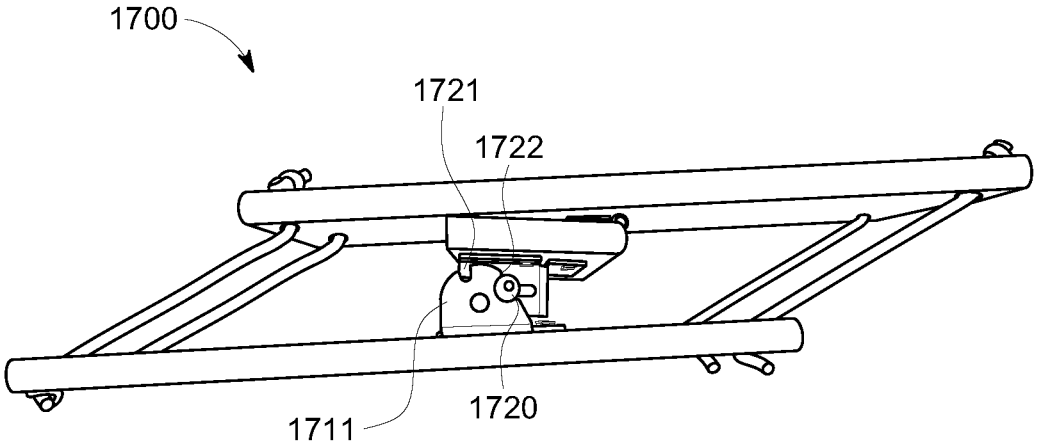
FIG. 48 is a perspective side view of the device of FIG. 45, in a closed configuration.

And, when the device 500 is flipped over and in the second, open in-use configuration, in the "neutral position", the rectangular body 507*b*, acting as the pedal 501 is substantially parallel to the rectangular body 507*a*, acting as the base 502. With reference to FIGS. 44A and 44B, the rectangular body 507*b* is configured to rotate about the pivot axis P, via the support 510, in a first direction away from the neutral position N and toward the rectangular body 507*a* and in a second direction away from the neutral position N and toward the rectangular body 507*a*, wherein the second direction is opposite the first direction. Thus, in such a configuration, the rectangular body 507*b* is configured to undergo a second type of motion, a combination motion in which the rectangular body 507*b* travels forward and aft while also rotating about the pivot axis P (i.e., via its attachment to the support 510). In other words, since the support 510 is also allowed to rotate in the second, open in-use configuration (i.e., relative to the base 502), the rectangular body 507*b* moves in a different motion with relation to the pivot axis P in comparison to the motion of the rectangular body 507*a* when the device 500 is in the first, open in-use configuration (i.e., when the support 510 is held fixed relative to the base 502). Indeed, in this configuration, the pivot axis P is lowered (i.e., relative to the first, open in-use configuration) and is spaced away from a foot of a user such that the support 510 rotates about the pivot axis P, and the rectangular body 507*b* (which is connected to the support 510 at the hinge 511) moves in a first direction F away from the neutral position N (see FIG. 44A) in which a toe end portion moves toward the rectangular body 507*a* (and the heel end portion moves away from the rectangular body 507*a*) and in a second direction E (see FIG. 44B) away from the neutral position N in which the heel end portion moves toward the rectangular body 507*a* (and the toe end portion moves away from the rectangular body 507*a*). In this manner, the rectangular body 507*b* moves in a forward and aft motion, with rotation around the pivot axis P provided by the hinge 509 (i.e., the active hinge is located at the bottom of the support 510 and spaced away from the foot 121). Thus, while in the second, in-use configuration, the movement of the rectangular body 507*b* subjects the foot 121 of the user 123 to a second motion, which comprises pivoting the foot 121 about the ankle 122, while also subjecting the ankle 122 to a forward and aft rocking motion.

The support 110 extending between the pedal 101 and the base 102 has a height h. When the device 100 is in the open, in use configuration, the pedal 101 and the base 102 are spaced apart from one another by the height h of the support 110. This space S has a height $H_{S1}$ when the device 100 is in the open configuration (see FIG. 3). The respective heights of the support 110 and the space S are configured to allow sufficient rotation of the pedal 101 in the first direction F about the pivot axis P (see FIG. 14) to subject a foot 121 of a user 123 to full flexion and to allow sufficient rotation of the pedal 101 in the second direction E about the pivot axis P (see FIG. 14) to subject the foot 121 of the user 123 to full extension. In various embodiments, for example, the space S may have a height $H_{S1}$ that is sufficient for the length of the pedal 101 to clear the base 102 when moved through 75 degrees of plantar flexion and 60 degrees of dorsiflexion. Those of ordinary skill in the art will understand that, to support the pedal 101 while also achieving the goal of full ankle flexion/extension, the support 110 may employ various pivoting mechanisms, and have various shapes, configurations and/or sizes (i.e., dimensions), including various heights h, which create various spaces S (i.e., having various heights $H_{S1}$) between the pedal 101 and the base 102, without departing from the scope of the present disclosure.

The resistance mechanism 103 is configured to exert a force on the pedal 101 about the pivot axis P in a direction opposite to a respective direction of rotation of the pedal 101 about the pivot axis P. In one exemplary embodiment, the resistance mechanism 103 comprises a plurality of elastomeric bands 103, each of the bands 103 extending between and connected to the pedal 101 and the base 102. For example, as illustrated in FIGS. 1-12, an elastomeric band 103 extends between each pair of aligned corners of the bodies 106 and 107 of the pedal 101 and the base 102. During rotation of the pedal 101, the elastomeric bands 103 exert a force on the pedal 101 about the pivot axis P in a direction opposite to the respective direction of rotation of the pedal 101 about the pivot axis P. For example, when a foot presses down on the toe end portion 104 or the heel end portion 105 of the pedal 101, the elastomeric bands 103 on the opposite side of the device 100 (i.e., opposite to the pressing action) extend, thereby exerting a force against the movement of the pedal 101. In other words, when a foot (e.g., toes of the foot) presses down on the toe end portion 104, thereby moving the toe end portion 104 of the pedal 101 toward the base 102, the elastomeric bands 103 connected to the heel end portion 105 are extended as the heel end portion 105 moves away from the base 102, thereby exerting a force that resists the movement of the heel end portion 105 away from the base and the toe end portion 104 toward the base. Likewise, when a foot (e.g., a heel of the foot) presses down on the heel end portion 105, thereby moving the heel end portion 105 of the pedal 101 toward the base 102, the elastomeric bands 103 connected to the toe end portion 104 are extended as the toe end portion 104 moves away from the base 102, thereby exerting a force that resists the movement of the toe end portion 104 away from the base and the heel end portion 105 toward the base.

Accordingly, in various exemplary embodiments of the present disclosure, the force exerted by the elastomeric bands 103 may provide passive resistance to rotational movement of the pedal 101 in both directions (i.e., F and E of FIG. 14) about the pivot axis P. And, in various additional embodiments, an amount of the force may vary with a degree of rotation 6 (see FIG. 14) of the pedal 101 about the pivot axis P, for example, the amount of force may increase with the degree of rotation 6 of the pedal 101 about the pivot axis P.

Furthermore, to change the amount of force or resistance exerted by the elastomeric bands 103, various additional embodiments of the present disclosure contemplate, for example, providing elastomeric bands 103 that are removable and/or reconfigurable, such that additional elastomeric bands 103 may be added to the device 100, in addition to and/or in exchange for existing elastomeric bands 103. In this manner, a user of the device 100 may increase and/or decrease the amount of force that is exerted by the elastomeric bands, to, for example, accommodate a user as strength increases or to otherwise scale up and/or down an exercise routine.

In accordance with various embodiments, for example, the pedal 101 of the exercise device 100 may include multiple catches for each elastomeric band 103 (e.g., each respective corner of the pedal 101 may include a set of multiple catches), such that a user may reposition each elastomeric band 103 within the set of multiple catches to increase/decrease the amount of force exerted by the elastomeric band 103 on the pedal 101. As used herein the term "catch" or "catches" generally refers to a feature on the device that may removably retain an elastomeric band. Although in various embodiments of the present disclosure, as illustrated in the accompanying figures, such catches may include recesses within the pedal and/or base of the device, the term catch(es) as used herein is intended to include all types and configurations of indents, recesses, clips, slots, ties, snaps, buttons, etc. that may serve to removably retain an elastomeric band in different positions on the pedal and/or base.

Figure 49:
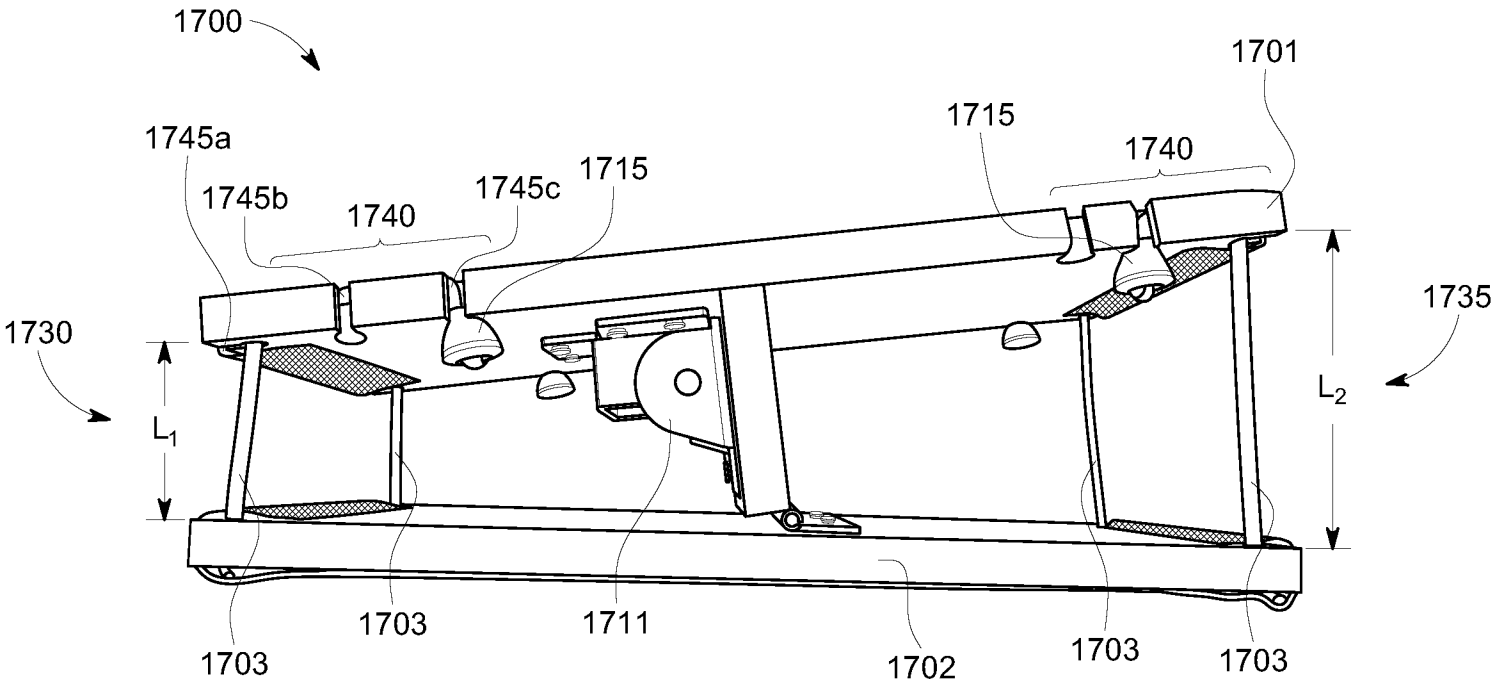
FIG. 49 is a perspective side view of another exemplary embodiment of a portable exercise device, in an open configuration, in accordance with the present disclosure.
Figure 50:
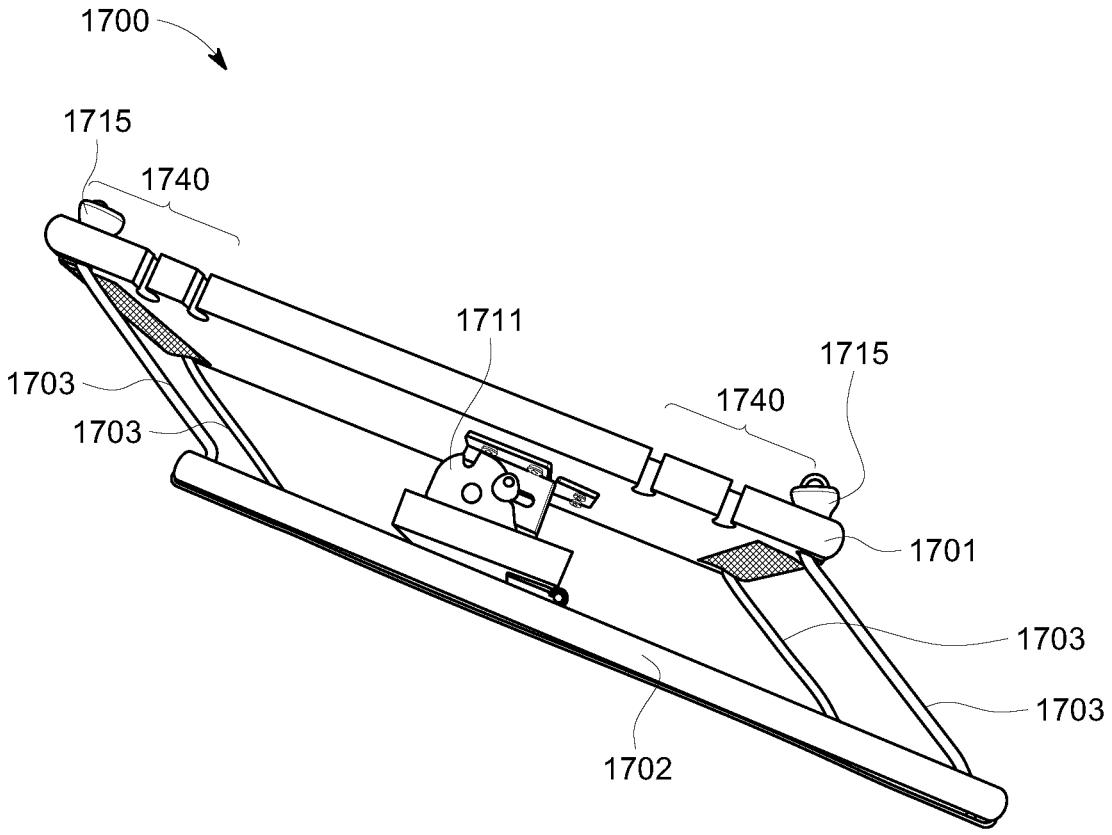
FIG. 50 is a perspective side view of the device of FIG. 49, in a closed configuration.
Figure 51:
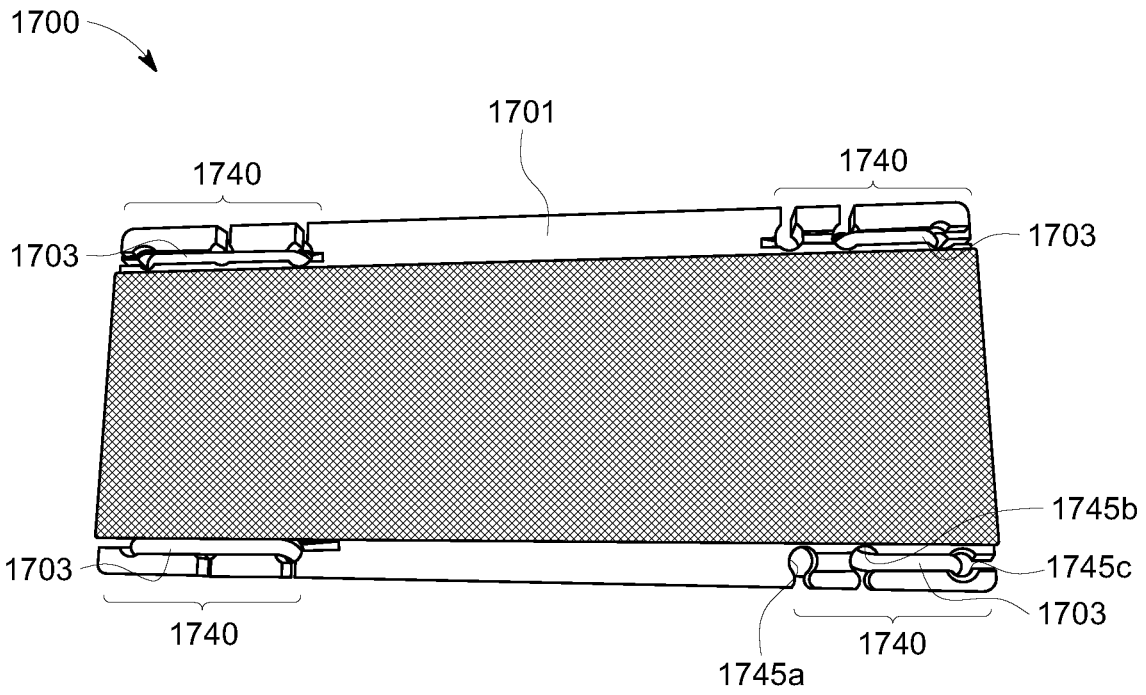
FIG. 51 is a top view of the device of FIG. 49.
Figure 52:
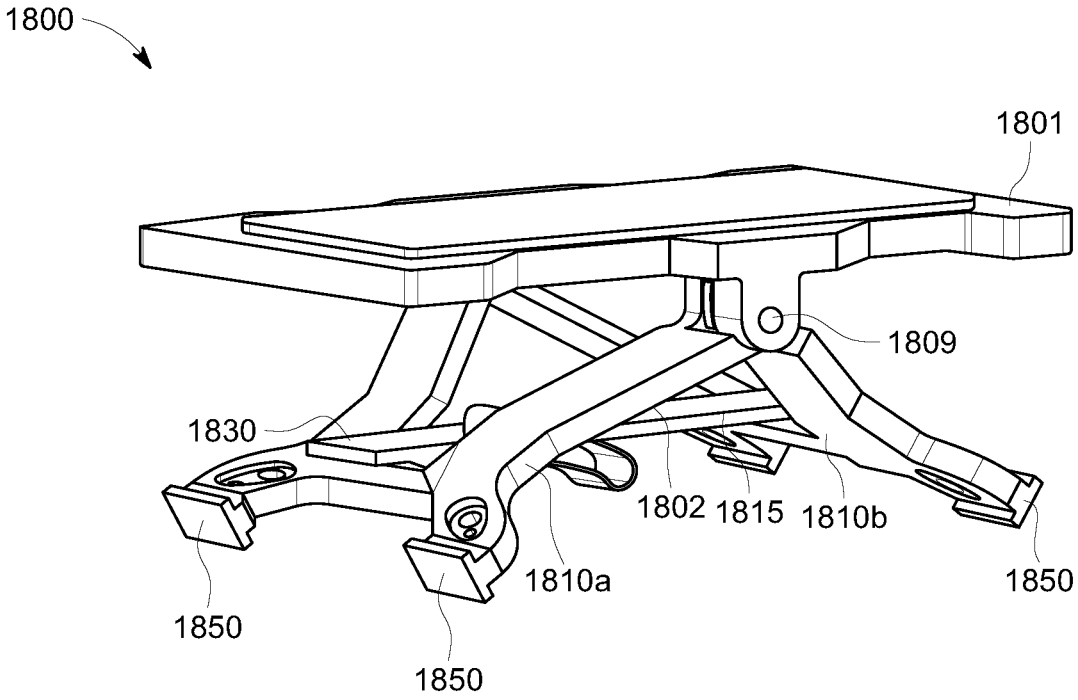
FIG. 52 is a perspective side, front view of another exemplary embodiment of a portable exercise device, in an open configuration, in accordance with the present disclosure.
Figure 53:
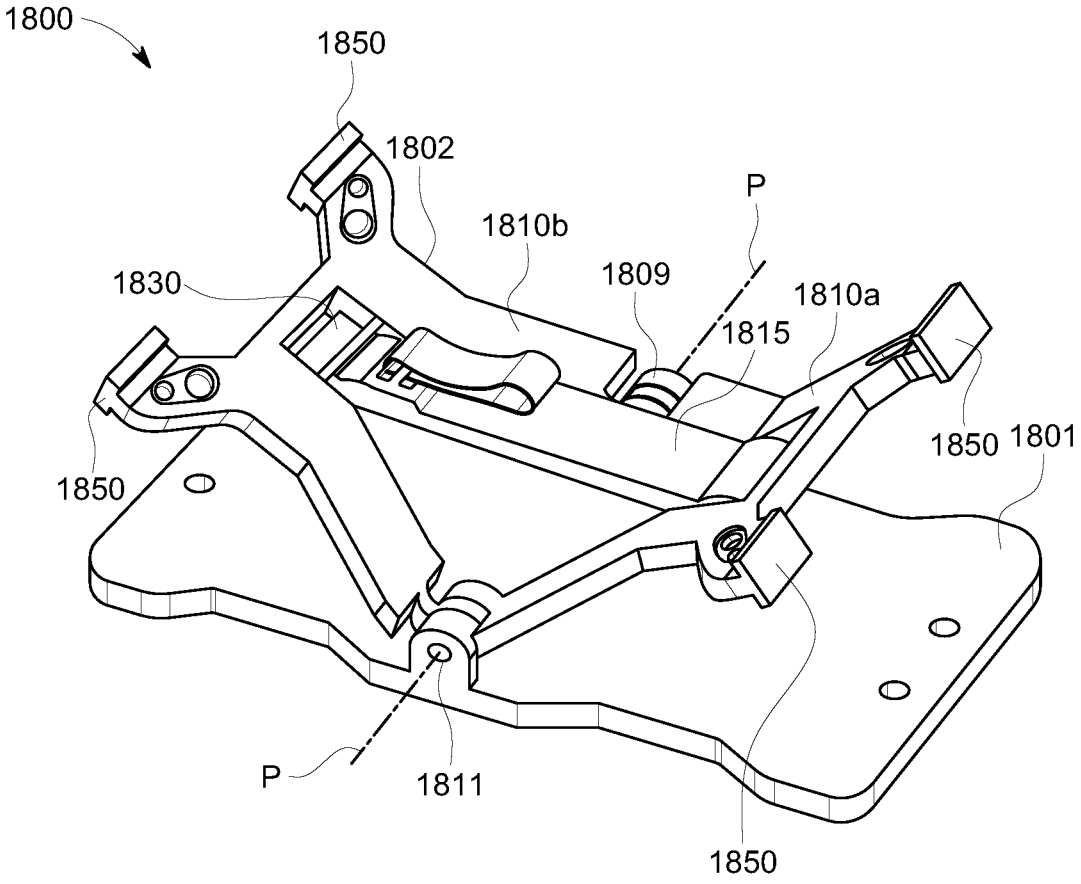
FIG. 53 is a perspective side, bottom view of the device of FIG. 52, in the open configuration.
Figure 54:
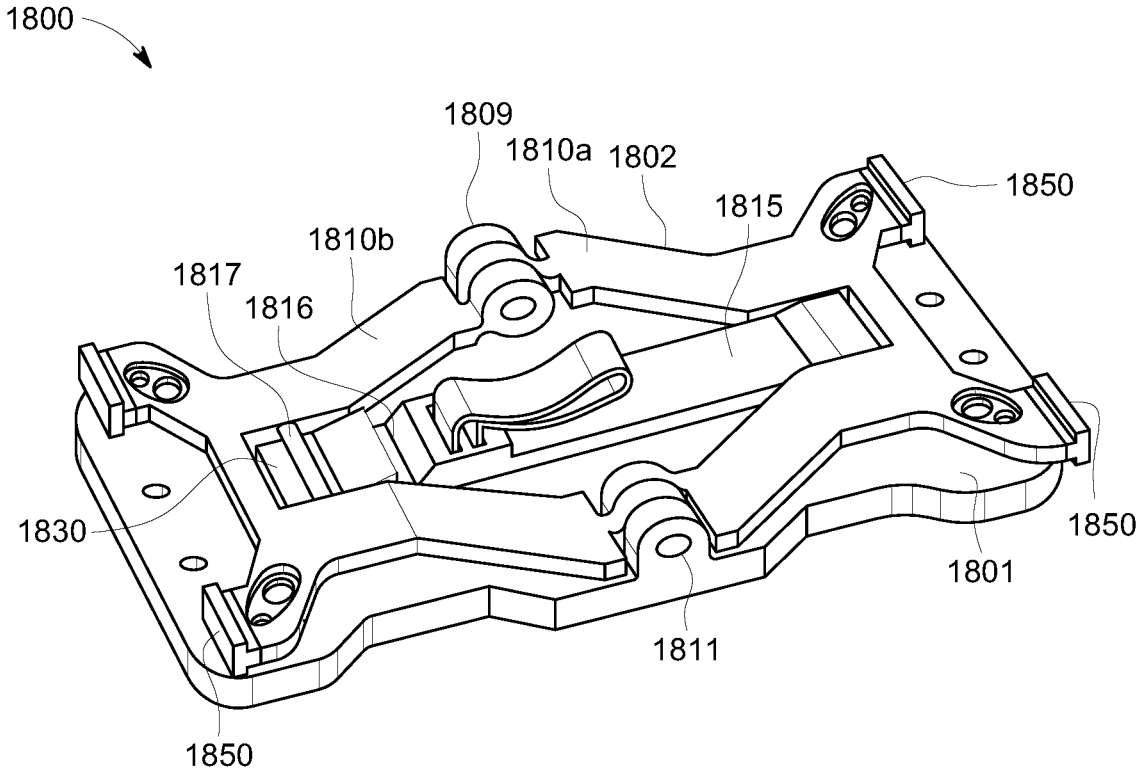
FIG. 54 is a perspective bottom view of the device of FIG. 52, in a closed configuration.
Figure 55:
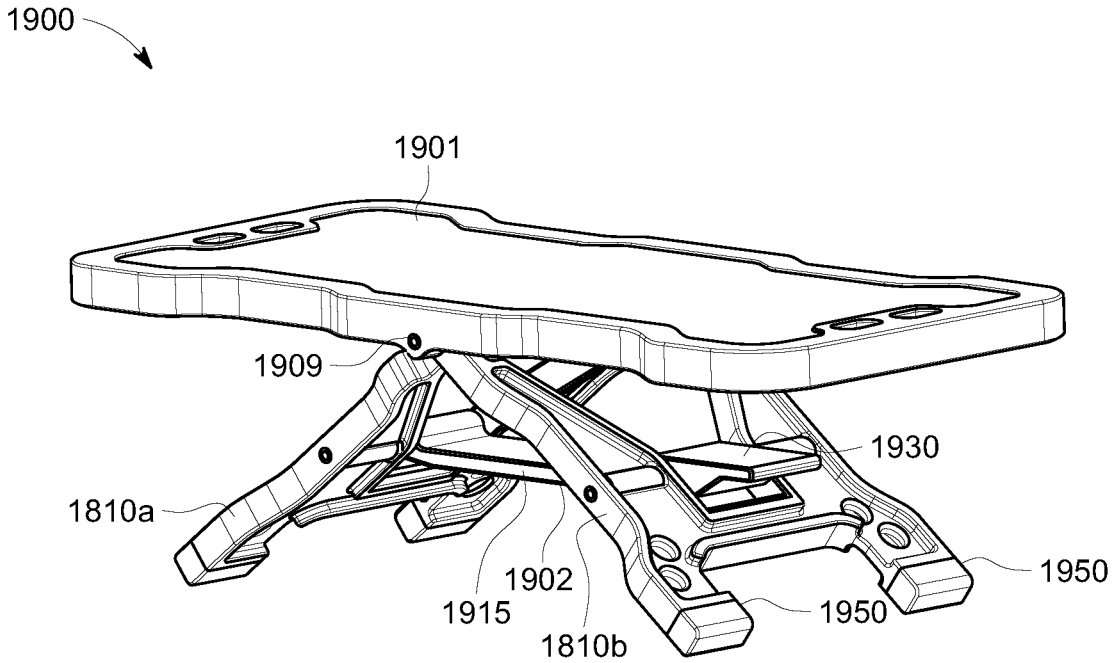
FIG. 55 is a perspective side, top view of another exemplary embodiment of a portable exercise device, in an open configuration, in accordance with the present disclosure.
Figure 56:
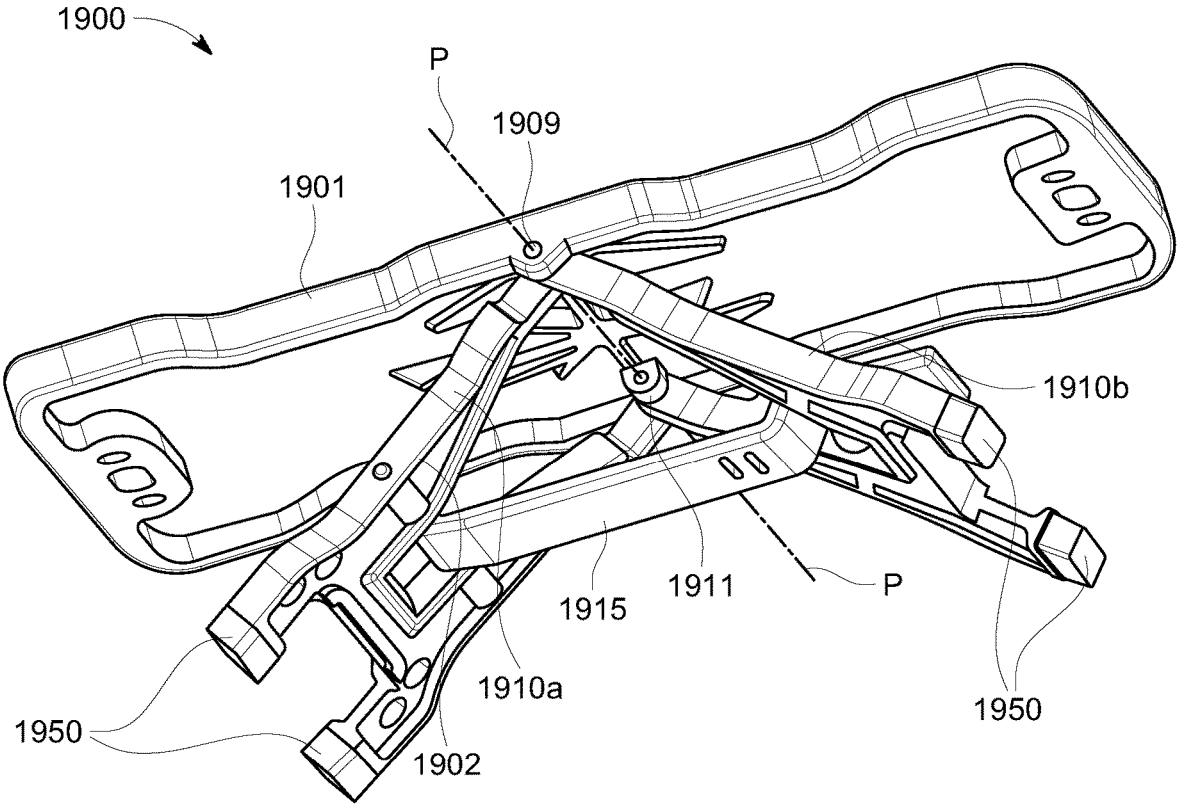
FIG. 56 is a perspective side, bottom view of the device of FIG. 55, in the open configuration.
Figure 57:
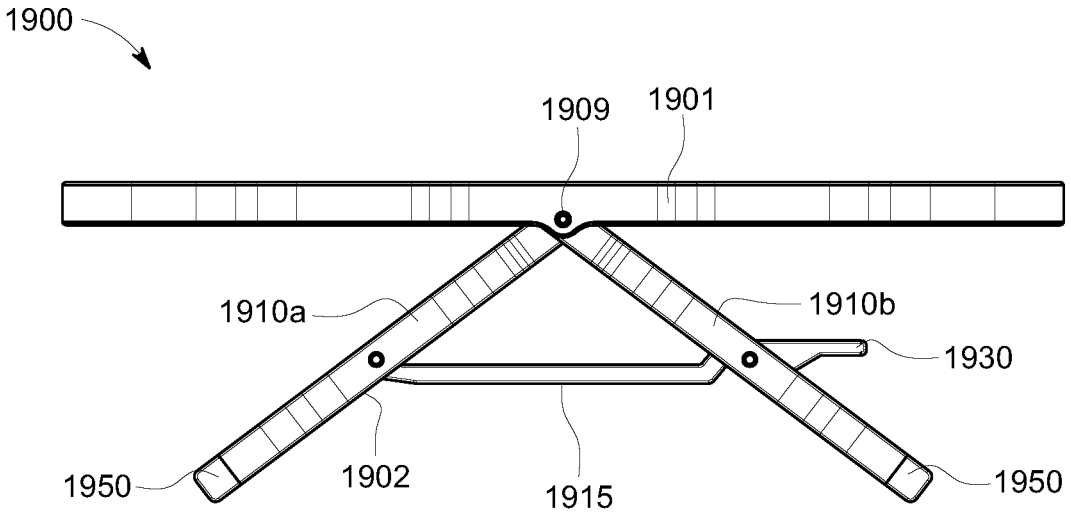
FIG. 57 is a side view of the device of FIG. 55, in the open configuration.

In various embodiments, for example, as illustrated in the embodiment of FIGS. 49-51, an exercise device 1700 may include a pedal 1701 that includes multiple sets 1740 of catches 1745. As illustrated best perhaps in FIG. 51, in one exemplary embodiment of the device 1700, each set 1740 may include three catches 1745 (e.g., catches 1745*a*, 1745*b*, and 1745*c*) that are each configured to retain a respective elastomeric band 1703. As illustrated in FIG. 51, each elastomeric band 1703 may, for example, include a knob 1715 at an end of the band 1703, which is configured to be retained within each catch 1745 (i.e., of a respective set 1740 of catches 1745). In this manner, a user my increase/decrease the amount of force exerted by each elastomeric band 1703 by reconfiguring the positioning of the elastomeric bands 1703 within the catches 1745 to increase/decrease a length L (see FIG. 49) of the elastomeric band 1703 extending between the pedal 1701 and the base 1702. For example, with reference to FIG. 51 again, to increase the force exerted by a respective elastomeric band 1703 (and decrease the length L), the elastomeric band 1703 can be moved from a first position within the catch 1745*a* to a second position within the catch 1745*b*. And, to further increase the force exerted by the elastomeric band 1703 (and further decrease the length L), the elastomeric band 1703 can be moved from the second position within the catch 1745*b* to a third position within the catch 1745*c*. Conversely, to then decrease the force exerted by the elastomeric band 1703 (and increase the length L), the elastomeric band 1703 can be moved back between the catches 1745*c* and 1745*a* (i.e., between the third and first positions). As illustrated in FIG. 49, for example, in one exemplary combination of elastomeric bands 1703, the bands 1703 on a first end 1730 (e.g., the toe end) of the pedal 1701 are positioned within catches 1745*c* (in the third position), while the bands 1703 on a second end 1735 (e.g., the heal end) of the pedal 1701 are positioned within catches 1745*b* (in the second position). In this manner, a length $L_1$ of the elastomeric bands 1703 on the first end 1730 (i.e., the length $L_1$ of the portion of the bands 1703 extending between the pedal 1701 and the base 1702) is shorter than a length $L_2$ of the elastomeric bands 1703 on the second end 1735 (i.e., the length $L_2$ of the portion of the bands 1703 extending between the pedal 1701 and the base 1702). In such a configuration, the device 1700 will provide more resistance against the rotation of the first end 1730 of the pedal 1701 (e.g., against plantar flexion motion) than against the rotation of the second end 1735 of the pedal 1701 (e.g., against dorsiflexion motion).

Thus, as will be understood by those of ordinary skill in the art, a user can reconfigure the elastomeric bands 1703 many different ways (i.e., many different combinations) to provide various different levels of resistance based, for example, on the user's age and fitness, a given need, and/or the proposed application of the device. In other words, the exercise device 1700 may be readily adapted to a specific user and application. Exercise devices in accordance with the present disclosure further contemplate including catches in both the pedal and base portions of the device (e.g., when the device has a flippable configuration as described above with reference to FIGS. 18-21), such that the elastomeric bands may be repositioned within each of the pedal and base, thereby providing even more combinations of resistance.

Figure 63:
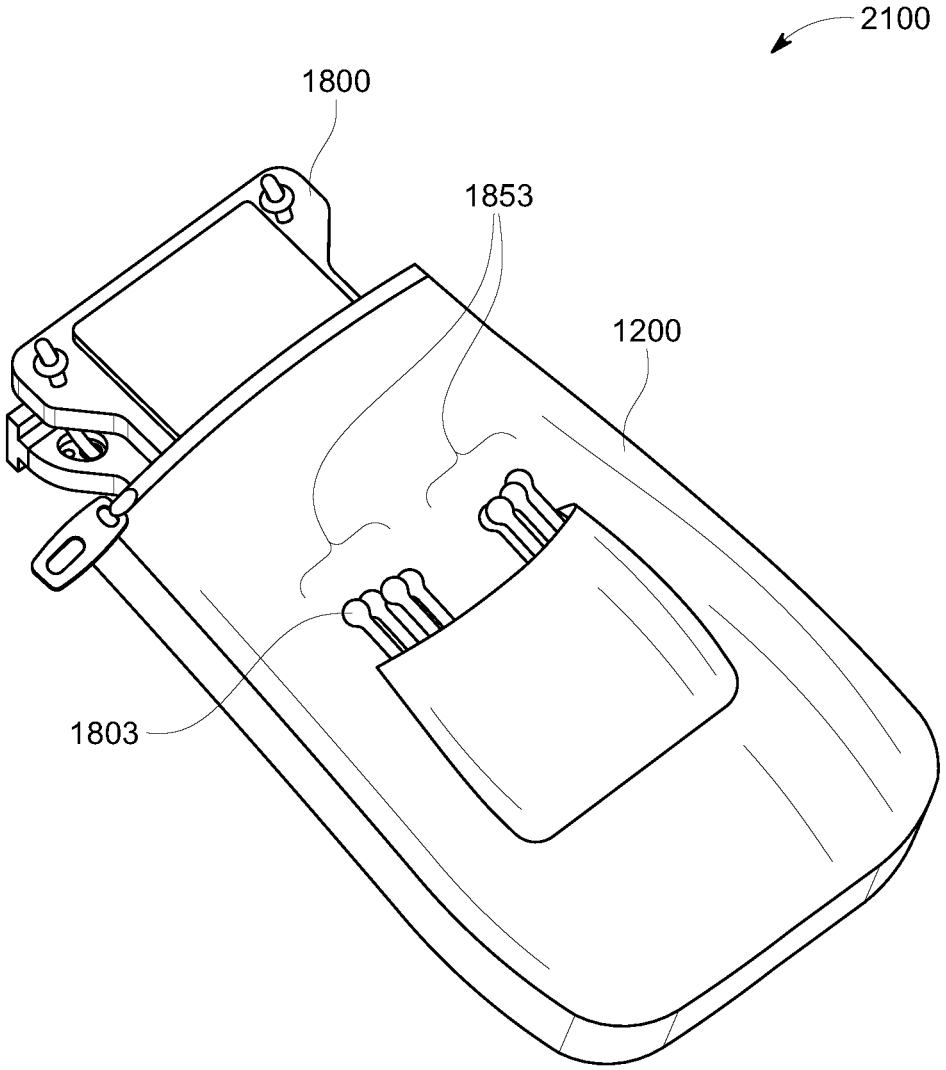
FIG. 63 is a is a top, front view of an exemplary kit, including the device of FIG. 58, in accordance with the present disclosure.

Various embodiments of the present disclosure also contemplate that additional sets of elastomeric bands (e.g., of different elasticity/resistance) can be separately purchased or sold in combination with the device, such that the bands can be switched out and/or replaced with different bands (e.g., bands made of stronger or different materials, bands having greater or less thickness, bands having more or less elasticity, etc.) as needed during a given exercise application. For ease of use, such bands can, for example, be colored coded based on their weight/elasticity (i.e., the amount of resistance that they provide). Various additional embodiments further contemplate that the disclosed exercise devices can be sold in a kit with different sets of elastomeric bands (e.g., different sets of color-coded elastomeric bands). As illustrated in FIG. 63, for example, a kit 2100 may include a device 1800, a sleeve 1200 (as described further below) for insertion/storage of the device 1800, and multiple sets 1853 of elastomeric bands 1803. Those of ordinary skill in the art will understand that the kit 2100 illustrated in FIG. 63 is exemplary only and that various types and/or configurations of kits including various types of storage devices (e.g., including various types of sleeves); various types of exercise devices; and various types/numbers of resistance mechanisms, including various sets of elastomeric bands, are contemplated without departing from the scope of the present disclosure and claims.

Those of ordinary skill in the art will further understand that resistance mechanisms in accordance with the present disclosure may comprise various types, numbers, configurations, and/or combinations of elements that may exert a force on the pedal 101 about the pivot axis P in a direction opposite to the respective direction of rotation of the pedal 101 and are not limited in any way to elastomeric bands, or to the particular exemplary configuration of elastomeric bands 103 of the embodiment illustrated in FIGS. 1-12. Examples of resistance mechanisms other than elastomeric bands that can be used, or that can be used in combination with elastomeric bands, for example, at each respective end portion of the pedal 101, include but are not limited to, for example, springs (see, e.g., springs 203 in portable exercise device 200 of FIG. 15), inflatable devices (see, e.g., inflatable bags 303 in portable exercise device 300 of FIG. 16), bellows (see, e.g., bellows 403 in portable exercise device 400 of FIG. 17), and/or foams.

When such non-elastomeric resistance mechanisms are utilized (e.g., springs 203, inflatable bags 303, and/or bellows 403), the resistance mechanisms on the same side of the device 100 as the pressing action may assist in returning the pedal 101 to the neutral position. In other words, when the toe end portion 104 of the pedal 101 moves toward the base 102, the non-elastomeric resistance mechanisms connected to the toe end portion 104 may assist in returning the pedal 101 to the neutral position N; and when the heel end portion 105 of the pedal moves toward the base 102, the non-elastomeric resistance mechanisms connected to the heel end portion 105 may assist in returning the pedal 101 to the neutral position N. In various exemplary embodiments, the amount of assist respectively provided by the non-elastomeric resistance mechanisms on the pedal 101 is proportional to the amount by which the pedal 101 is rotated about the pivot axis P and away from the neutral position N.

Figure 22:
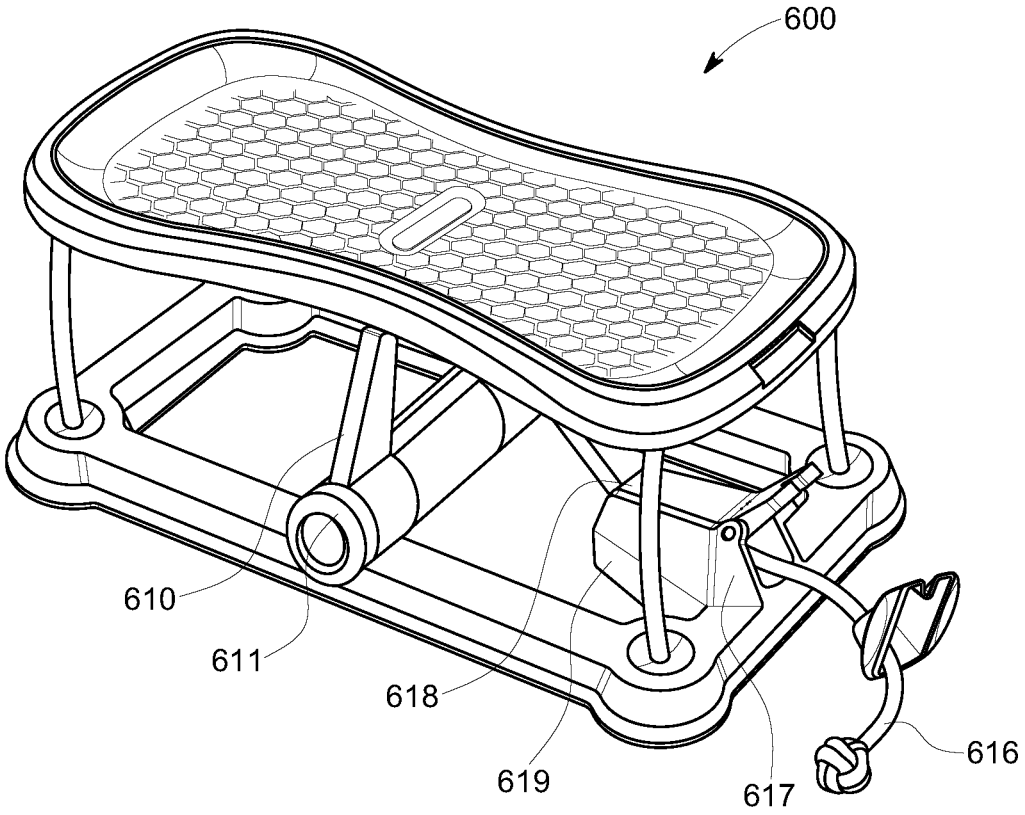
FIG. 22 is a perspective top, front view of another embodiment of a portable exercise device, in an open configuration, in accordance with the present disclosure.

Various additional exemplary embodiments further contemplate utilizing a resistance mechanism that is positioned at the pivot P, as disclosed, for example, in International Patent Application No. PCT/US2019/015031, entitled "Devices and Methods for Exercising an Ankle, foot, and/or Leg, and filed on Jan. 24, 2019, the entire contents of which are incorporated by reference herein. Such resistance mechanisms may include, for example, but are not limited to friction devices, torsion bars, spring devices (e.g., torsion springs/linear springs), compliant mechanisms, detent dials, adjustable clutch mechanisms, piezoelectric/nanomotion motors, pneumatic, and/or hydraulic devices, such as, for example, hydraulic cylinders (see below), viscous damping devices, and/or devices utilizing smart fluids, such as, for example, magnetorheological fluids or electrorheological fluids. Various exemplary embodiments of the present disclosure additionally contemplate a portable exercise device that includes a triple hinge that may, for example, also function as the support. In such embodiments, the triple hinge may also incorporate the resistance mechanism. And, as illustrated in FIG. 22, for example, various further exemplary embodiments contemplate a portable exercise device 600, which includes molded hinges 609 (not shown in the view of FIG. 22) and 611 that are integral with a collapsible support 610. The collapsible support 610 may, for example, be made from a molded plastic material with the hinges 609 and 611 and/or locking mechanisms molded into it. In such a configuration, the molded hinge 609 could also house an adjustable resistance mechanism, such as, for example, one of the resistance mechanisms disclosed in International Patent Application No. PCT/US2019/015031. The resistance mechanisms and the respective ranges of resistance for the resistance mechanisms disclosed in International Patent Application No. PCT/US2019/015031 are incorporated herein by reference.

As illustrated in FIGS. 52-58, various additional exemplary embodiments of the present disclosure contemplate a portable exercise device 1800, 1900 having two molded hinges 1809, 1909 and 1811, 1911 at are adjacent to one another along a pivot axis P (see FIGS. 53 and 56), and which are integral with the device 1800, 1900. The device 1800, 1900 may, for example, be made from an injected molded plastic material or 3D printed with the hinges 1809, 1909 and 1811, 1911 molded into it. As illustrated in FIGS. 52-57, the device 1800, 1900 includes a pedal 1801, 1901 and a base 1802, 1902. In the exemplary embodiments of FIGS. 52-58, similar to the embodiments of FIGS. 36-42 described below, however, each base 1802, 1902 comprises of a pair of collapsible supports 1810*a*, 1910*a* and 1810*b*, 1910*b* that are connected to the pedal 1801, 1901 via the aligned hinges 1809, 1909 and 1811, 1911. In this manner, when the device 1800, 1600 is in the open configuration (see, e.g., FIGS. 52 and 57), the supports 1810*a*, 1910*a* and 1810*b*, 1910*b* of the base 1802, 1902 form a triangular body (e.g., an A-frame or tent) that elevates the pedal 1801, 1901 with respect to the support surface. In accordance with various embodiments, for example, to place the device 1800, 1900 in the open configuration, the supports 1810*a*, 1910*a* and 1810*b* and 1910*b* are rotated outward with respect to the pedal 1801, 1901 (i.e., via hinges 1809, 1909 and 1811, 1911) and are locked into place (i.e., to form the triangular body) via a brace 1815, 1915 that is configured to run between the supports 1810*a*, 1910*a* and 1810*b* and 1910*b*. In such a configuration, for example, the brace 1815, 1915 is pivotably connected to one of the supports (e.g., support 1810*b*, 1910*b*) and may include one or more slots, one slot 1816, 1916 being shown in the embodiments of FIGS. 52-58, which are configured to mate with a corresponding bar 1817, 1917 in the other one of the supports (e.g., support 1810*a*, 1910*a*) to lock the device 1800, 1900 in the open configuration.

Although only one slot 1816, 1916 is shown in the embodiments of FIGS. 52-58, the present disclosure contemplates using various numbers, shapes, and/or configurations of slots 1816, 1916 and corresponding bars 1817, 1917, as will be understood by those of ordinary skill in the art. As illustrated in the embodiment of FIGS. 59-62, for example, an exercise device 2000 contemplates using multiple slots (e.g., three slots 2016 being shown in the embodiment of FIGS. 59-62) in a brace 2015, such that a height H of a pedal 2001 of the device 2000 can be adjusted via movement of a bar 2017 (e.g., in one of supports 2010*a* and 2010*b*) between the slots 2016.

To place the device 1800, 1900 in the closed configuration (see. e.g., FIG. 54), a user may release the bar 1817, 1917 from the slot 1816, 1916 (e.g., by pushing/pulling an end portion 1830, 1930 of the brace 1815, 1915 toward the pedal 1801, 1901), such that the supports 1810*a*, 1910*a* and 1810*b*, 1910*b* of the base 1802, 1902 fold (via the hinges 1809, 1909 and 1811, 1911) flat against the pedal 1801, 1901. In this manner, to conserve space, the device 1800, 1900 is designed to have a low-profile, which is substantially flat, when the device 1800, 1900 is in the closed configuration. As illustrated, for example, in the embodiment of FIGS. 59-62 (which is shown as being substantially transparent for ease of illustration), both the supports 2010*a* and 2010*b* and the brace 2015 are configured such that the pedal 2001 lays completely flush against the supports 2010*a* and 2010*b* when the device 2000 is in the closed configuration.

In accordance with various exemplary embodiments, the molded hinges 1809, 1909 and 1811, 1911 may each house an adjustable resistance mechanism, such as, for example, one of the resistance mechanisms disclosed in International Patent Application No. PCT/US2019/015031, entitled "Devices and Methods for Exercising an Ankle, foot, and/or Leg, and filed on Jan. 24, 2019. As above, the resistance mechanisms and the respective ranges of resistance for the resistance mechanisms disclosed in International Patent Application No. PCT/US2019/015031 are incorporated herein by reference. The present disclosure additionally contemplates that various additional types and/or configurations of resistance mechanisms may be incorporated within the hinges 1809, 1909 and 1811, 1911 without departing from the scope of the present disclosure and claims.

The present disclosure also contemplates, for example, that a single resistance mechanism may be incorporated within and span between the two adjacent hinges along the pivot axis P. As illustrated in the embodiment of FIGS. 59-62, in one exemplary embodiment, a torsion element 2020, such as, for example, a torsion bar or torsion spring, may span between hinges 2009 and 2011 along a pivot axis P. The present disclosure further contemplates that various additional types and/or configurations of resistance mechanisms can be used in conjunction with or in place of such resistance mechanisms (which are incorporated into the molded hinges). As further illustrated in the embodiment of FIGS. 59-62, in the exercise device 2000, a set of resistance bands 2003 may be used in conjunction with, or in lieu of, the torsion element 2020 to further adjust/increase the amount of resistance provided by the device 2000.

Figure 58:
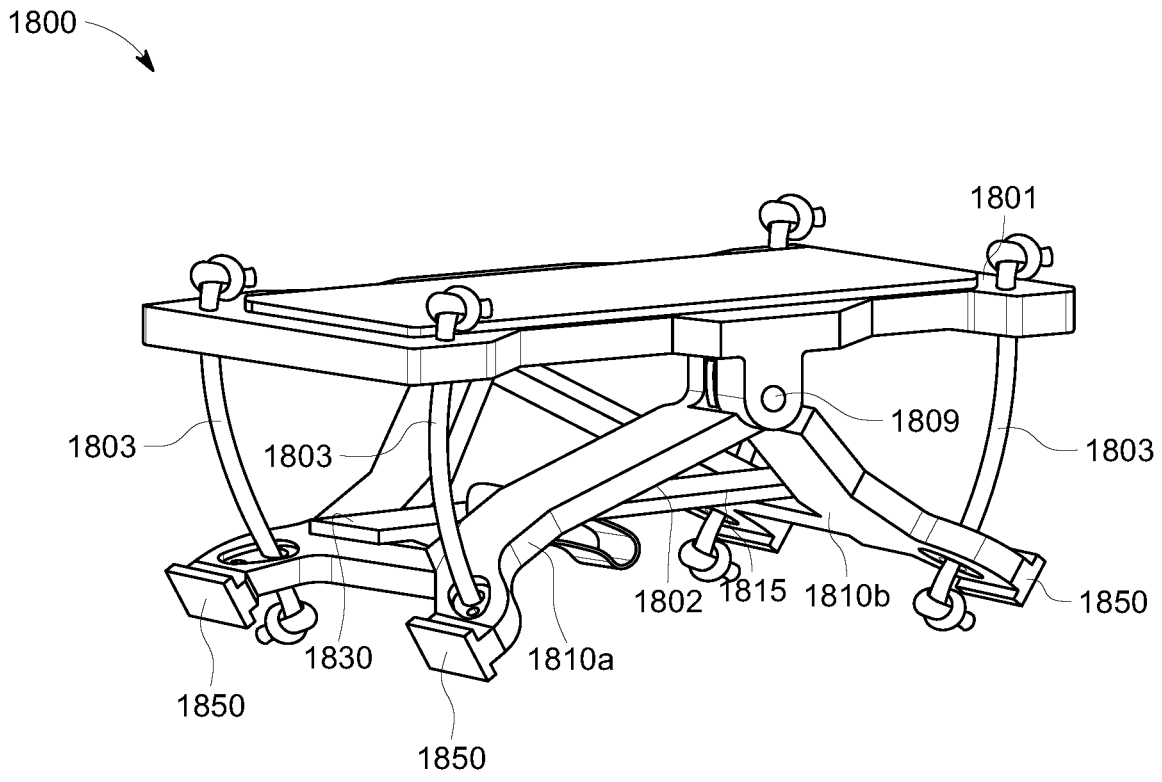
FIG. 58 is a perspective side, top view of yet another exemplary embodiment of a portable exercise device, in an open configuration, in accordance with the present disclosure
Figure 59:
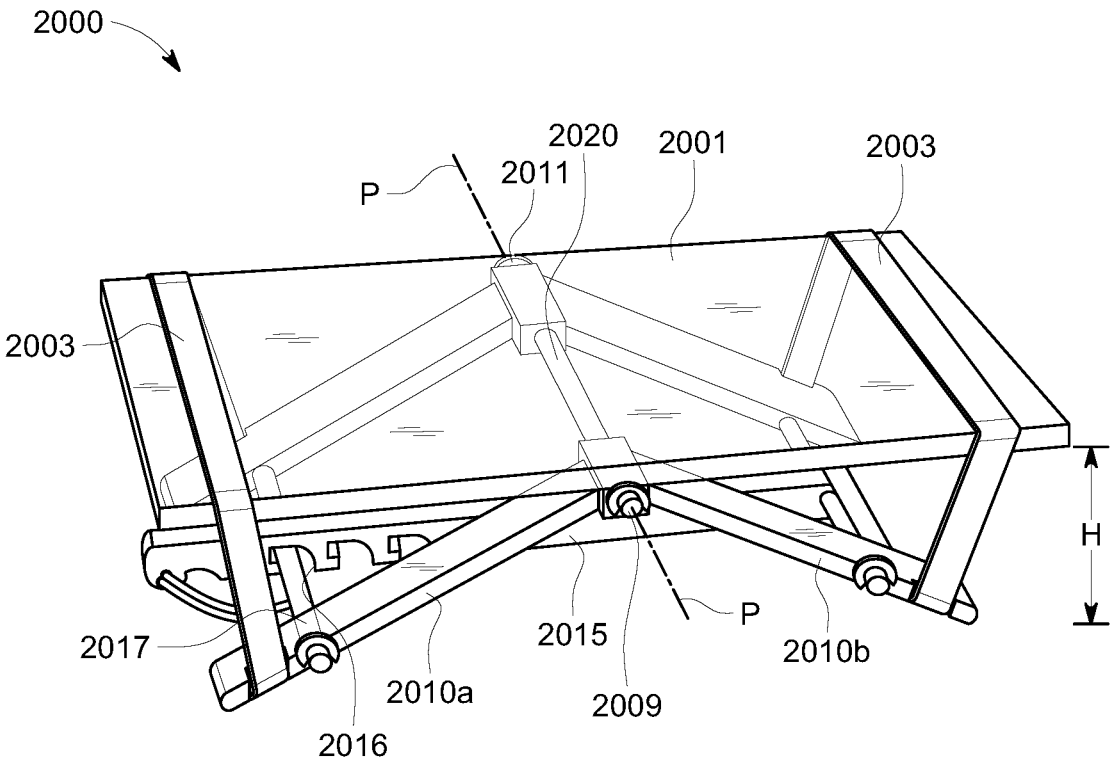
FIG. 59 is a perspective side, top view of yet another exemplary embodiment of a portable exercise device, in an open configuration, in accordance with the present disclosure.
Figure 60:
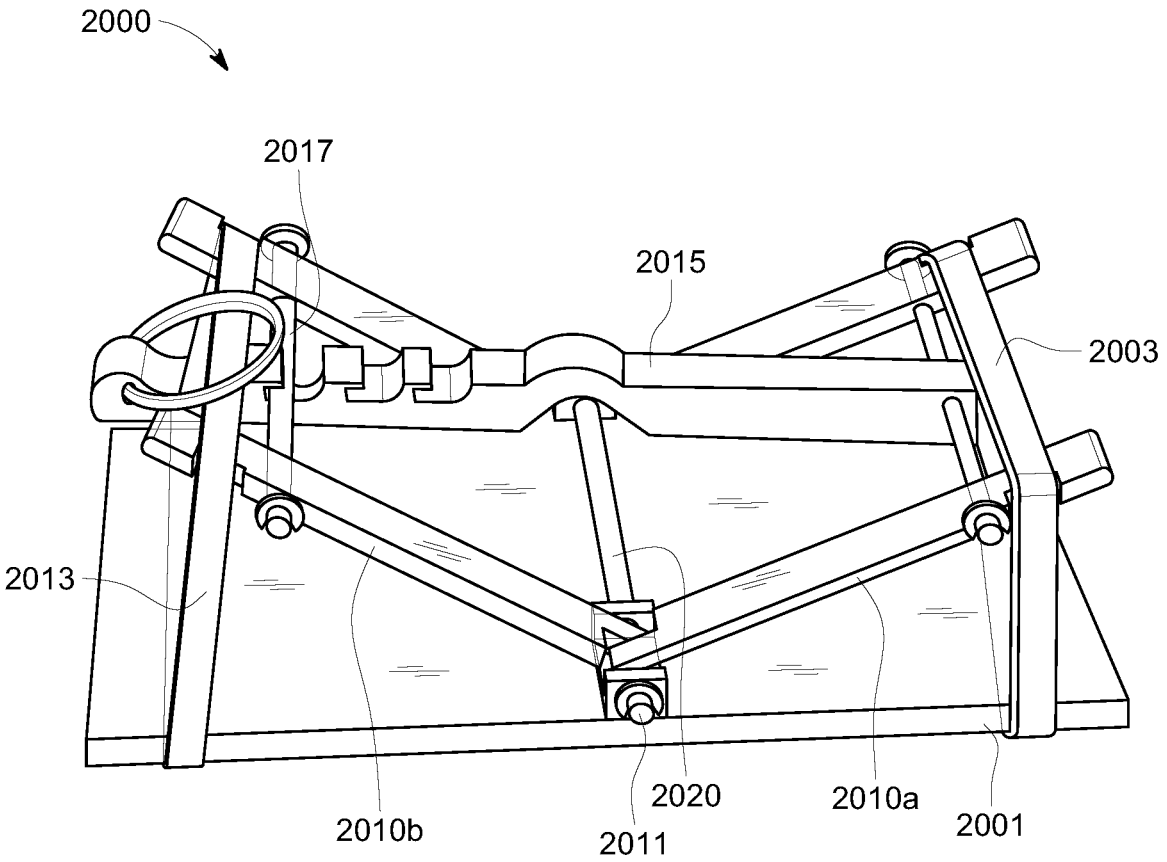
FIG. 60 is a perspective side, bottom view of the device of FIG. 59, in the open configuration.
Figure 61:
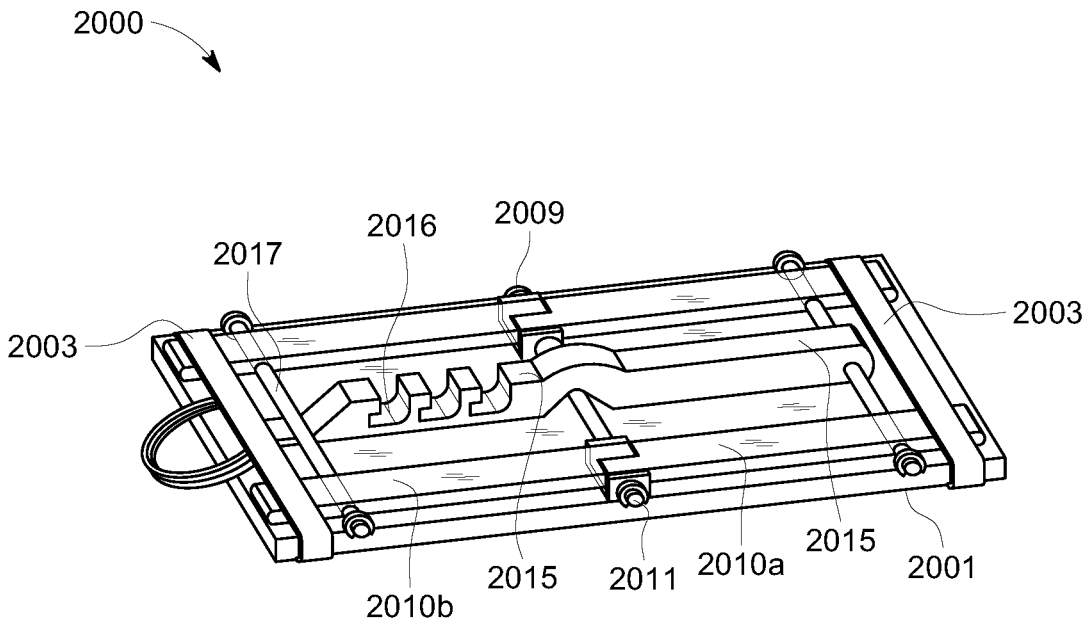
FIG. 61 is a perspective side, bottom view of the device of FIG. 59, in a closed configuration.
Figure 62:
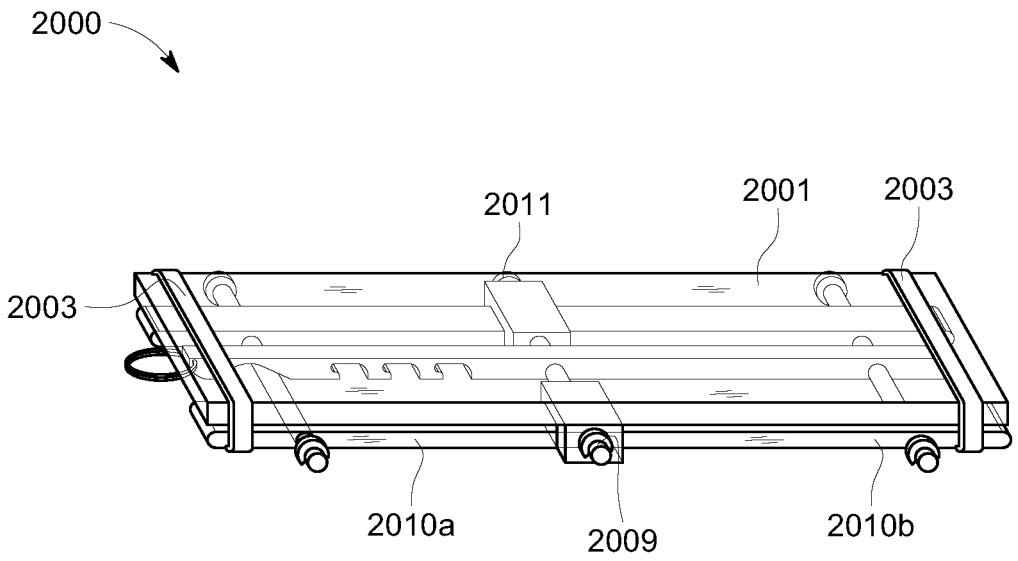
FIG. 62 is a perspective side, top view of the device of FIG. 59, in the closed configuration.

And, similar to the embodiment of FIGS. 1-12, as illustrated in FIG. 58, in various further embodiments, the device 1800 may include a plurality of elastomeric bands 1803, a set of four elastomeric bands 1803 being shown in the embodiment of FIG. 58, with each of the bands 1803 extending between and connected to the pedal 1801 and the base 1802. As above, the elastomeric bands 1803 can be used in conjunction with, or in lieu of, resistance mechanisms incorporated into the molded hinges 1809 and 1811 to adjust the amount of resistance provided by the device 1800. For example, as above, the exercise device 1800 may include multiple catches for each elastomeric band 1803 (e.g., each respective corner of the pedal 1801 may include a set of multiple catches), such that a user may reposition each elastomeric band 1803 within the set of multiple catches to increase/decrease the amount of force exerted by the elastomeric band 1803 on the pedal 1801. Furthermore, also as above, with reference to FIG. 63, the device 1800 may be included within a kit 2100 that comes with multiple sets 1853 of elastomeric bands 1803 (e.g. of color-coded elastomeric bands).

For portability, the device 100 is adjustable between at least two configurations. As shown in FIGS. 1-7, the device 100 may be adjusted to an open configuration wherein the pedal 101 is disposed in the neutral position N to receive a foot 121 of a user 123. Alternatively, as shown in FIGS. 8-12, the device 100 may be adjusted to a closed configuration wherein the pedal 101 is collapsed against the base 102 to minimize the space S between the pedal 101 and the base 102, thereby minimizing the profile of the device 100 for ease of transport. Thus, as discussed above, the device 100 includes a collapsible support 110 that is configured to rotate, via hinges 109 and 111, between an upright position in which the support 110 is perpendicular to the parallel bodies 106, 107 of the pedal 101 and the base 102 (see FIGS. 1-7) and a collapsed position in which the support 110 is parallel to the parallel bodies 106, 107 of the pedal 101 and the base 102 (see FIGS. 8-12). In this manner, the device 100 may be transitioned between the open and closed configuration via moving the support 110 between the upright and collapsed position, for example, by raising and lowering the support 110 with respect to the base 102 via the hinges 109 and 111.

Those of ordinary skill in the art will understand that embodiments of the present disclosure contemplate various mechanisms, which include various configurations of features, for transitioning the device 100 between the open and closed configurations, and are not limited in any way to the collapsible support 110 of the embodiment illustrated in FIGS. 1-12. Furthermore, the collapsible support 110 may be used in combination with various mechanisms to increase the stability of the device 100, when the device is in the open configuration. In various embodiments, for example, as illustrated in the embodiment of FIGS. 18-21, the device may further include a block that is secured to the base, against which the collapsible support may rest when in the open configuration.

In accordance with various embodiments of the present disclosure, the device 100 may include, for example, a closure mechanism 115 that is configured to transition the device 100 between the open and closed configurations. In various exemplary embodiments, the closure mechanism 115 includes a cord 116 and a clamp 117, such as, for example, a v-clamp 117. As illustrated in the embodiment of FIGS. 1-12, the clamp 117 is mounted to an end portion of the base 102, on a top surface 145 of the base 102. And, the cord 116 is configured to extend between the support 110 and the clamp 117. In various exemplary embodiments, the cord 116 is affixed to the support 110 at a location adjacent to the pedal 101, such as, for example, at a location of the hinge 109 connecting the support 110 to the pedal 101. As shown best perhaps in FIGS. 3-5, a first end of the cord 116 may be, for example, threaded through a hole 119 in the hinge 109/support 110 and knotted on the opposite side of the support 110, while a second end of the cord 116 is threaded through the clamp 117. In this manner, the support 110 may be raised and lowered with respect to the base 102 (i.e., transitioned between the upright and collapsed configurations) by respectively securing and releasing the cord 116 within the clamp 117. In other words, to raise the support 110 and maintain (lock) the support 110 in the upright configuration, the cord 116 may be pulled taut and secured within the clamp 117. And, to lower the support 110 the cord 116 may be released from the clamp 117, such that the cord 116 is slackened to allow the support 110 to collapse against the top surface 145 of the base 102 via the hinges 109 and 111.

Those of ordinary skill in the art will understand that devices in accordance with the present disclosure may comprise various types, numbers, configurations, and/or combinations of closure mechanisms to transition the device between the open configuration and the closed configuration and are not limited in any way to the cord and clamp mechanism of the embodiment illustrated in FIGS. 1-12. As illustrated in the embodiment of FIG. 22, for example, one embodiment of the present disclosure contemplates a device 600 that utilizes a plastic clamp 617 to lock the device 600 in the open configuration. The clamp 617 may include, for example, an upper jaw 618 that pivots with respect to a lower jaw 619, such that the upper jaw 618 may clamp down on a cord 616 that runs between the jaws 618 and 619. As illustrated in the embodiment of FIGS. 13A and 13B, for example, various additional embodiments of the present disclosure contemplate that the device 100 utilizes a cord 116 that interconnects directly with the base 102, such as, for example, with a notch 114 or other feature of the base 102. In various additional embodiments, the device may utilize a cord that has a ball at one end (see e.g., cord 516, having a ball 560, of portable exercise device 500 of FIGS. 18-21) to prevent the cord from sliding through the clamp. In various further exemplary embodiments, the device 100 may utilize a bar that is raised and lowered with respect to the support 110 to lock the support in the open configuration (e.g., similar to a kick stand as illustrated in the exemplary embodiment of FIGS. 34 and 35).

As illustrated in FIGS. 8-12, in the closed configuration of the device 100, the pedal 101 is collapsed against the base 102, reducing the space S between the pedal 101 and the base 102, such that the device 100 has a minimized profile. In this configuration, the support 110 is in a collapsed position in which the support 110 is parallel to the parallel bodies 106, 107 of the pedal 101 and the base 102. In other words, in the closed configuration of the device 100, the cord 116 of the closure mechanism 115 is slack such that the pedal 101 and support 110 can pivot, via the hinges 109 and 111, to collapse and lay flat against the base 102. Consequently, in this configuration, the elastomeric bands 103 are also substantially slack and collapsed with respect to the base 102, as further illustrated in FIGS. 8-12.

In accordance with various exemplary embodiments, in the closed configuration of the device 100, the space S between the pedal 101 and the base 102 is minimized such that a height $H_{S2}$ of the space S is less than the height $H_{S1}$ of the space S when the device 100 is in the open configuration. Consequently, in the closed configuration of the device 100, an overall height of the device 100 is also reduced. In various embodiments, for example, an overall height $H_1$ of the device 100 in the open configuration (see FIG. 3) ranges from about 3 inches to about 5 inches, while an overall height $H_2$ (see FIG. 10) of the device in the closed configuration ranges from about 1 inches to about 3 inches. Those of ordinary skill in the art will understand, for example, that the devices in accordance with the present disclosure may come in various sizes, having various different overall heights $H_2$, to accommodate users of various sizes, having various different heights and foot sizes.

Figure 27:
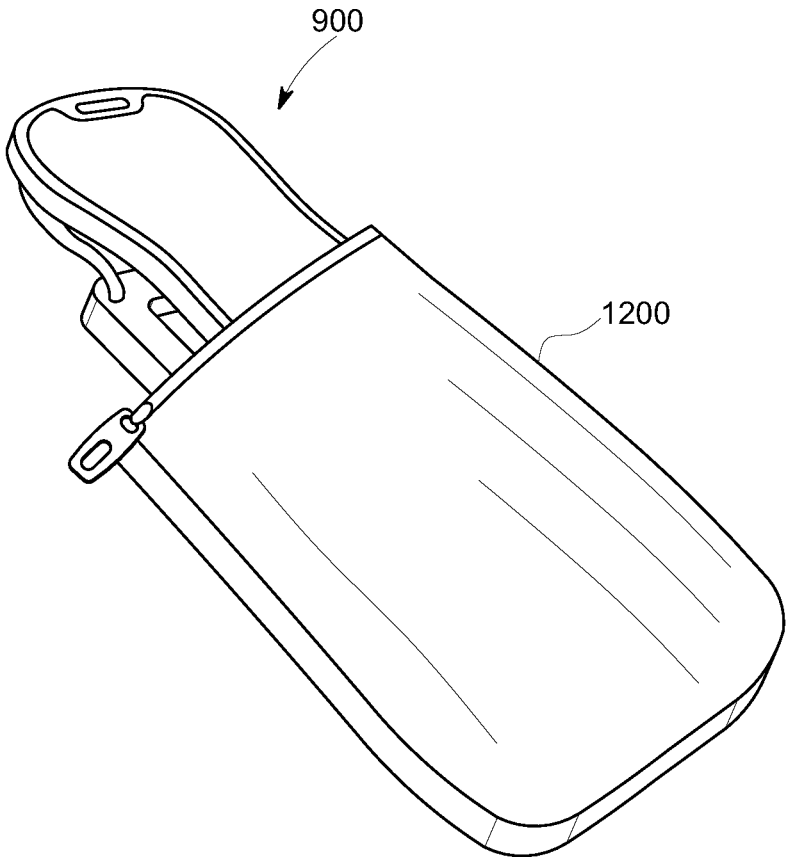
FIG. 27 is a top, front view of the device of FIG. 25 in a closed configuration and partially inserted into an exemplary pouch in accordance with the present disclosure.
Figure 28:
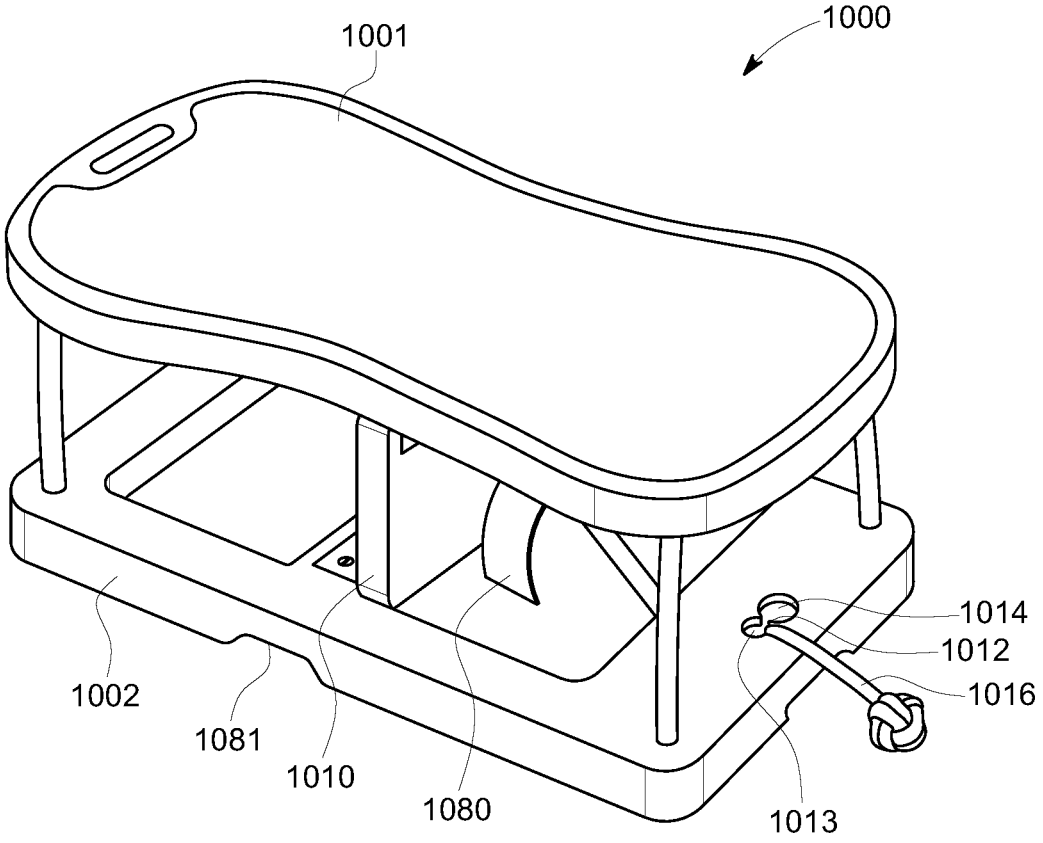
FIG. 28 is a perspective top, front view of another embodiment of a portable exercise device, in an open configuration, in accordance with the present disclosure.
Figure 29:
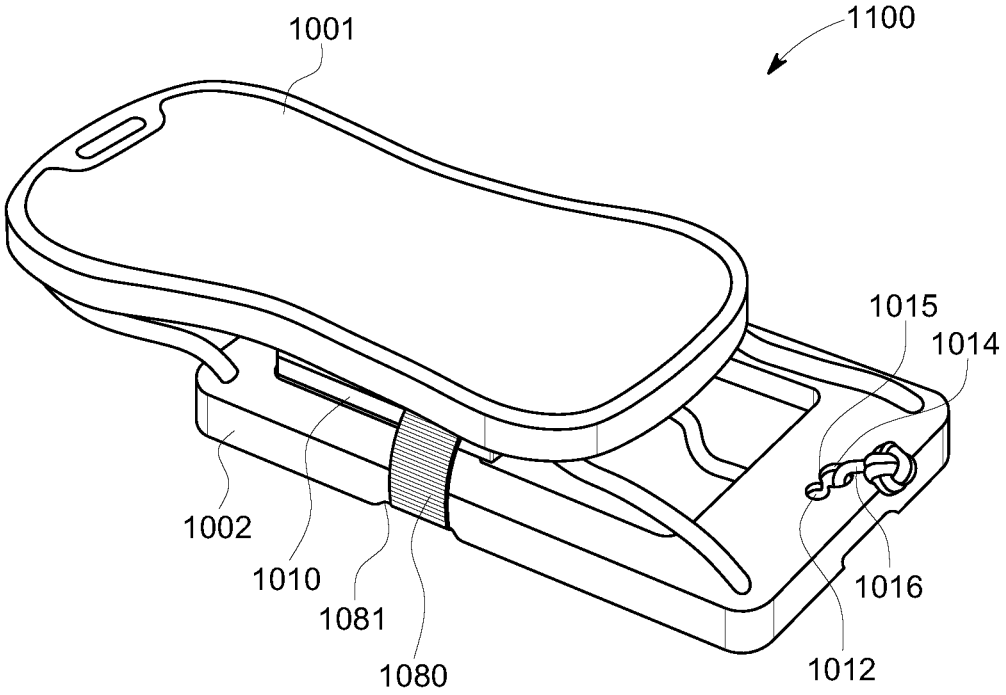
FIG. 29 is a perspective top, front view of the device of FIG. 28 in a closed configuration.
Figure 30:
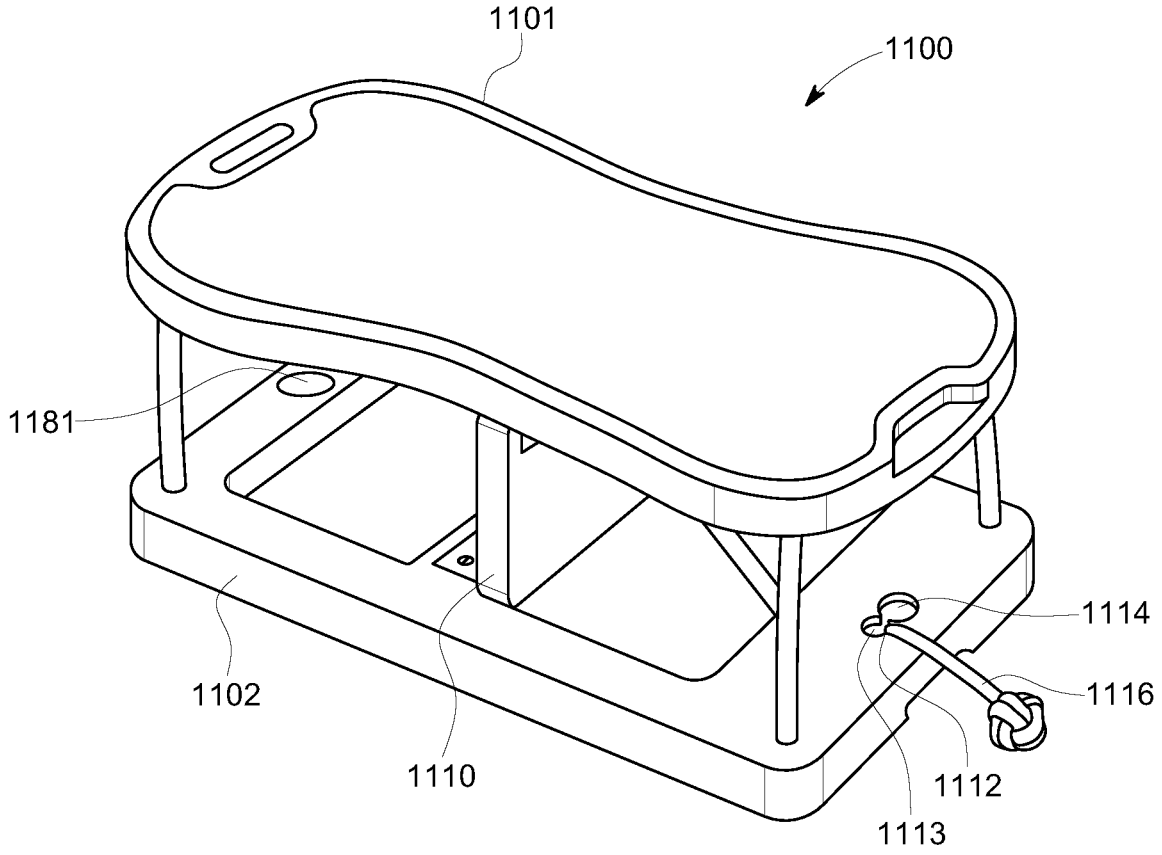
FIG. 30 is a perspective top, front view of another embodiment of a portable exercise device, in an open configuration, in accordance with the present disclosure.
Figure 31:
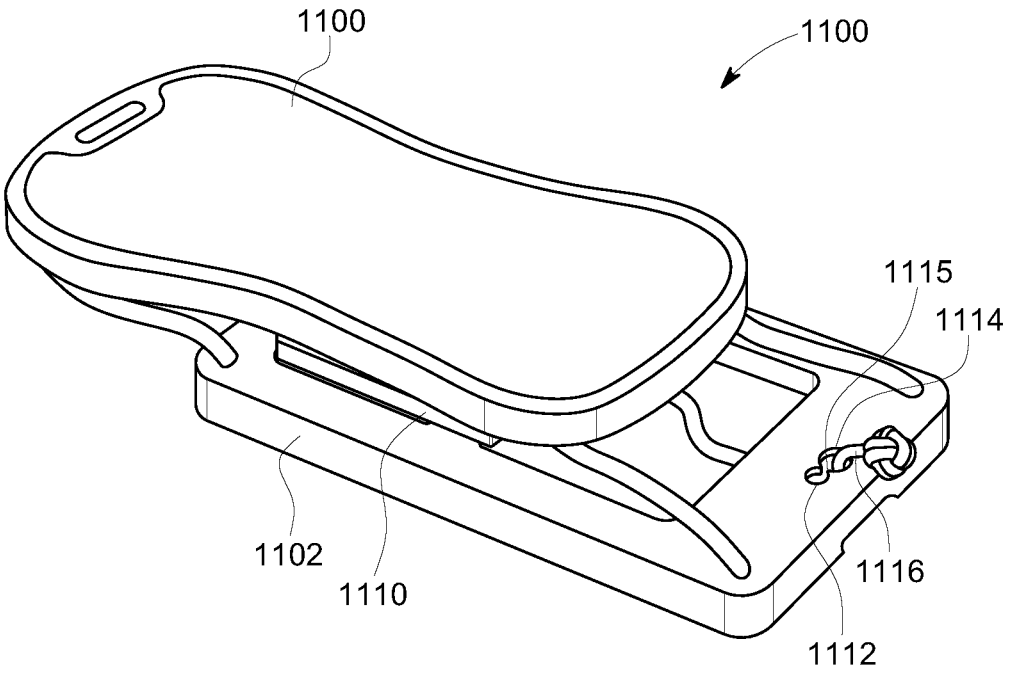
FIG. 31 is a perspective top, front view of the device of FIG. 30 in a closed configuration.

To help keep the device in the closed configuration, various embodiments of the present disclosure may also include a restraint. One exemplary embodiment may include a tie mechanism, such as, for example, a band (see, e.g., band 580 of portable exercise device 500 of FIG. 21) that is tied around the device to secure the collapsed pedal to the base. Another exemplary embodiment may include a pair of components configured to fit together in a tight manner such as in a press-fit or snap fit manner (see, e.g., components 980 and 981 of portable exercise device 900 of FIGS. 25 and 26) and that lock together when the device is in the closed configuration to secure the collapsed pedal to the base (see FIG. 26). In the exemplary embodiment, the elements comprise projection 981 and hole 980 that fit together in a press-fit or snap-fit manner. However, as will be apparent to those of ordinary skill in the art, it is possible that other configurations of objects to be connected in a press-fit or snap-fit manner may be used. For example, nesting objects which fit together in a press-fit or snap-fit manner may be used. Another exemplary embodiment may include a strap, such as, for example, a Velcro® strap that is connected to the pedal and configured to attach, for example, to a loop material on a bottom surface of the base (see, e.g., strap 1080 and material 1081 of portable exercise device 1000 of FIGS. 28 and 29) when the pedal is collapsed against the base (see FIG. 29). Another exemplary embodiment may include a magnet on a top surface of the base (see, e.g., magnet 1181 of portable exercise device 1100 of FIGS. 30 and 31) that is configured to attach to a corresponding magnet on a bottom surface of the pedal (not shown in the view of FIG. 30) when the pedal is collapsed against the base (see FIG. 31). Those of ordinary skill in the art will understand that devices in accordance with the present disclosure may comprise various types, numbers, configurations, and/or combinations of restraint mechanisms to help keep the device in the closed configuration and are not limited in any way to the components illustrated in FIGS. 21, 25, 26, and 28-31. Those of ordinary skill in the art will further understand that devices in accordance with the present disclosure may be used in conjunction with various accessory devices, for example, in which to store the device when the device is locked in the closed configuration. As illustrated in FIG. 27, for example, various embodiments of the present disclosure contemplate portable exercise devices that, when locked in the closed configuration, are stored within a sleeve, such as, for example, a cloth or neoprene sleeve (see, e.g., sleeve 1200 of FIG. 27). A storage sleeve may, for example, provide both function and aesthetics. The sleeve may (1) protect the device from damage, (2) contain dirt and other contaminants the device may pick up during use, (3) aid in the carrying of the device, and (4) provide an aesthetic means of transporting and storing the device.

Figure 34:
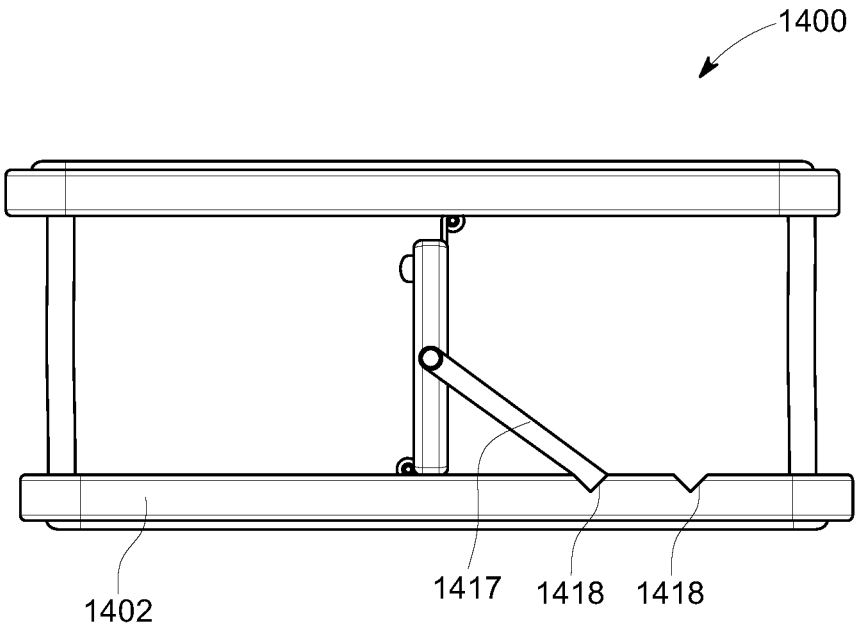
FIG. 34 is a side view of another exemplary embodiment of a portable exercise device, in an open configuration, in accordance with the present disclosure.
Figure 35:
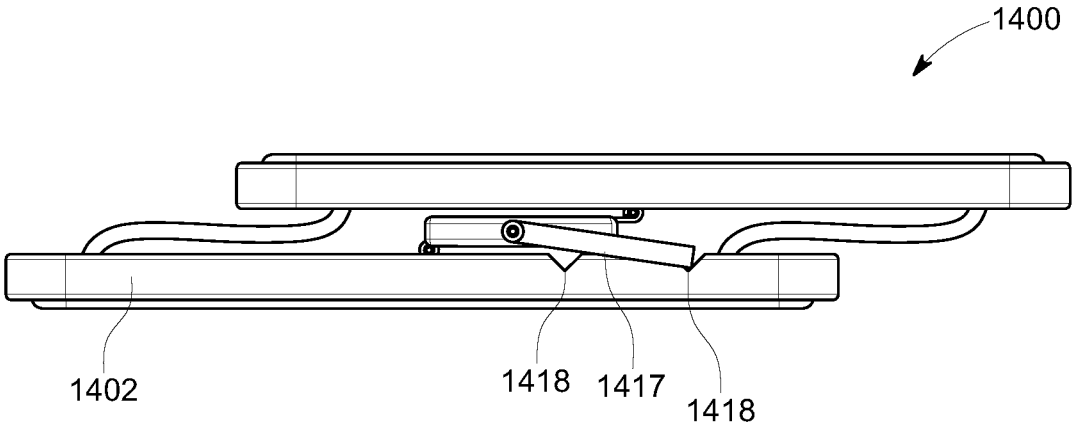
FIG. 35 is a side view of the device of FIG. 34 in a closed configuration.

Various additional embodiments of the present disclosure contemplate utilizing a single locking mechanism that functions to both (1) lock the device in the open configuration for use, and (2) lock the device in the closed configuration for storage. In one embodiment, such a locking mechanism may function, for example, similar to a conventional locking mechanism utilized by folding tables, in which the support includes a sliding arm that is spring-loaded on a pin. As will be understood by those of ordinary skill in the art, as the sliding arm gets pushed out (i.e., to open the device) and in (i.e., to close the device), the arm may slide back and forth along the pin (i.e., via a slot/track in the center of the arm). And, at either end of the track (i.e., when the device is fully open or fully closed), the arm pops out of the track and locks into place. To change the configuration of the device, the user then depresses the pin to unlock the device and move the pin back into the track. In accordance with various additional exemplary embodiments, as illustrated in FIGS. 34 and 35, an exercise device 1400 may include a similar locking mechanism comprising an arm 1417 that is configured to lock into place, in either an open configuration (see FIG. 34) or a closed configuration (see FIG. 35), for example, via notches 1418 in the base 1402 of the device 1400. In this manner, the arm 1417 functions like a kick stand that may lock into place in either an open or closed configuration. In further exemplary embodiments, as illustrated in FIGS. 36-42 and described below, exercise devices 1500 and 1600 may each include a locking mechanism 1515, 1615 comprising a strap (e.g., a soft goods strap) 1516, 1616 that is used in conjunction with a hook (e.g., a G-hook) 1517, 1617 to lock the device 1500, 1600 into place, in either an open configuration (see FIGS. 36 and 40) or a closed configuration (see FIGS. 37-39 and FIGS. 41-42).

And, in still further exemplary embodiments, the locking mechanism may be built into one of the hinges. In one embodiment, for example, as illustrated in FIGS. 45-51, exercise device 1700 may include a self-locking, foldable hinge 1711, which functions like another conventional locking mechanism utilized by folding tables. As illustrated best perhaps with respect to the enlarged views of FIGS. 46 and 47, the self-locking, foldable hinge 1711 includes a spring-loaded lever 1720 configured to move between a first notch 1721 and a second notch 1722. For example, to lock the device 1700 into place in the open configuration (see FIGS. 45 and 46), the lever 1720 is moved (i.e., by a user 123) into the first notch 1721. And, to lock the device 1700 into place in the closed configuration, the lever 1720 is moved (i.e., by the user 123) into the second notch 1722 (see FIG. 48).

As described above, those of ordinary skill in the art will understand that the disclosed portable exercise devices, including the pedal and support, may be made of various materials, including, for example, various light weight wood materials, such as, for example, plywood, medium-density fiberboard (MDF), birch wood, and balsam wood. As above, such materials may be relatively light to facilitate carrying, packing, and transporting the device, yet durable enough to withstand repetitive use/motion. FIGS. 23-31, 36-42, and 45-51 for example, illustrate several exemplary embodiments of portable exercises devices 700, 800, 900, 1000, 1100, 1500, 1600, and 1700 made from a light weight wood material.

Similar to the portable exercise device 100 described above, each of the devices 700, 800, 900, 1000, 1100, and 1700 includes a pedal 701, 801, 901, 1001, 1101, 1701; a base 702, 802, 902, 1002, 1102, 1702; and a collapsible support 710, 810, 910, 1010, 1110, 1710 connecting the pedal 701, 801, 901, 1001, 1101, 1701 to the base 702, 802, 902, 1002, 1102, 1702 (e.g., via hinges); such that the pedal 701, 801, 901, 1001, 1101, 1701 may be raised and lowered with respect to the base 702, 802, 902, 1002, 1102, 1702. As will be understood by those of ordinary skill in the art, each of these devices may also be configured to flip over (i.e., such that the device may undergo the second type of combination motion, in which the pedal travels forward and aft while also rotating about the pivot axis P) similar to the exercise device 500. FIGS. 49-51, for example, illustrate an embodiment of the device 1700 in which the device 1700 is flipped over.

Also similar to the portable exercise device 100, each of the devices 1500 and 1600 includes a pedal 1501, 1601 and a base 1502, 1602. In the exemplary embodiments of FIGS. 36-42, however, each base 1502, 1602 comprises of a pair of collapsible supports 1510*a*, 1610*a* and 1510*b*, 1610*b* that are connected to the pedal 1501, 1601 via a hinge 1509, 1609. In this manner, when the device 1500, 1600 is in the open configuration (see FIGS. 36 and 40), the supports 1510*a*, 1610*a* and 1510*b*, 1610*b* of the base 1502, 1602 form a triangular body (e.g., an A-frame or tent) that elevates the pedal 1501, 1601 with respect to the support surface. And, when the device 1500, 1600 is in the closed configuration (see FIGS. 37-39 and FIGS. 41-42), the supports 1510*a*, 1610*a* and 1510*b*, 1610*b* of the base 1502, 1602 fold (via the hinge 1509, 1609) flat against the pedal 1501, 1601.

Figure 37:
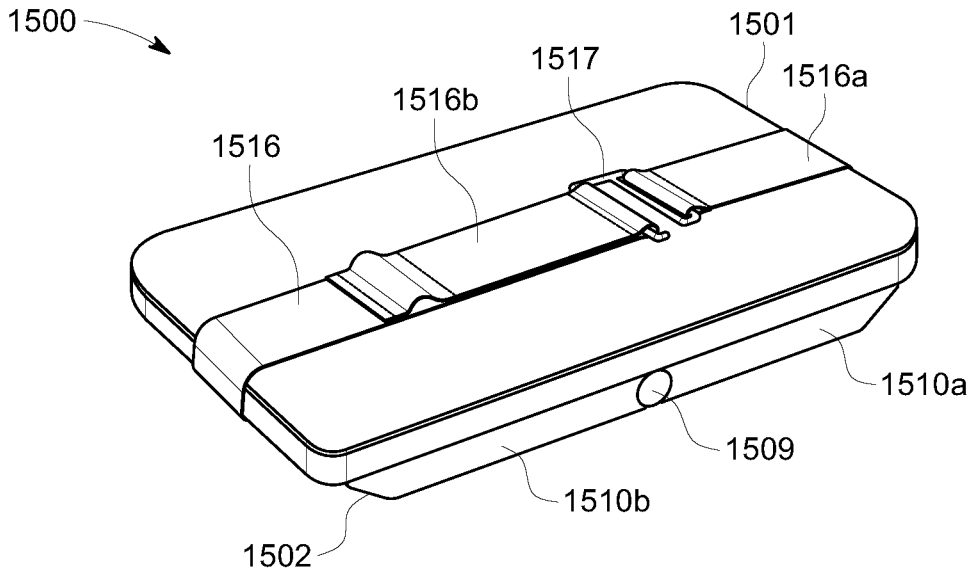
FIG. 37 is a perspective top, back view of the device of FIG. 36 in a closed configuration.
Figure 38:
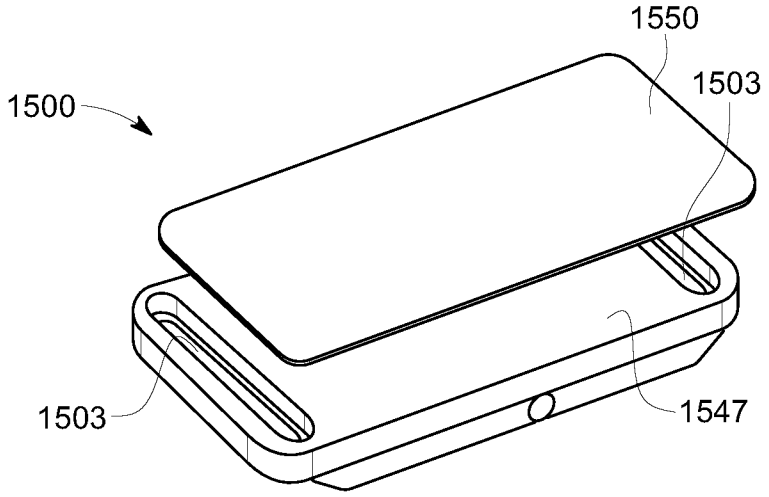
FIG. 38 is a partially exploded, perspective top, back view of the device of FIG. 36 in the closed configuration.
Figure 39:
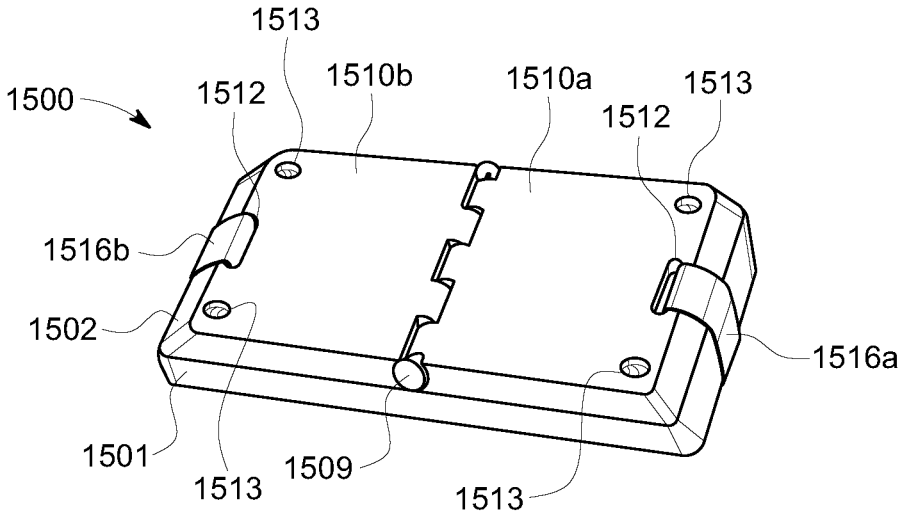
FIG. 39 is a perspective bottom view of the device of FIG. 36 in the closed configuration.

To both simplify and reduce the weight of the devices 700, 800, 900, 1000, 1100, 1500, 1600, 1700 in the present embodiments, these components are at least partly made from a wood material. In one embodiment, for example, the pedals 701, 801, 901, 1001, 1101, 1701, bases 702, 802, 902, 1002, 1102, 1702, and supports 710, 810, 910, 1010, 1110, 1710 are each made of plywood, such as, for example, a ¼ inch to a ⅜ inch plywood that is sanded and varnished to a smooth finish. In another embodiment, the pedal 1501 and the supports 1510*a* and 1510*b* are each made of MDF, with the pedal further including a birch top piece 1550. In yet another embodiment, the pedal 1601 is made of MDF with a birch top piece 1650, while the supports 1610*a* and 1610*b* are made of aluminum. In various embodiments, for example, the supports 1610*a* and 1610*b* include bent, hollow tubes. Furthermore, as illustrated in FIG. 38, in such embodiments, elastomeric bands 1503, 1603 of the resistance mechanism may be passed through an MDF support 1547, 1647 of the pedal 1501, 1601, which is covered by the birch top piece 1550, 1650, and connected to respective supports 1510*a*, 1610*a* and 1510*b*, 1610*b* (e.g., via holes 1513, 1613 (see, e.g., FIGS. 36 and 40) in the supports 1510*a*, 1610*a* and 1510*b*, 1610*b*). Those of ordinary skill in the art will understand that the wood embodiments depicted in FIGS. 23-31 and 36-42 are exemplary only and that any combination of wood/non-wood materials may be used.

Figure 23:
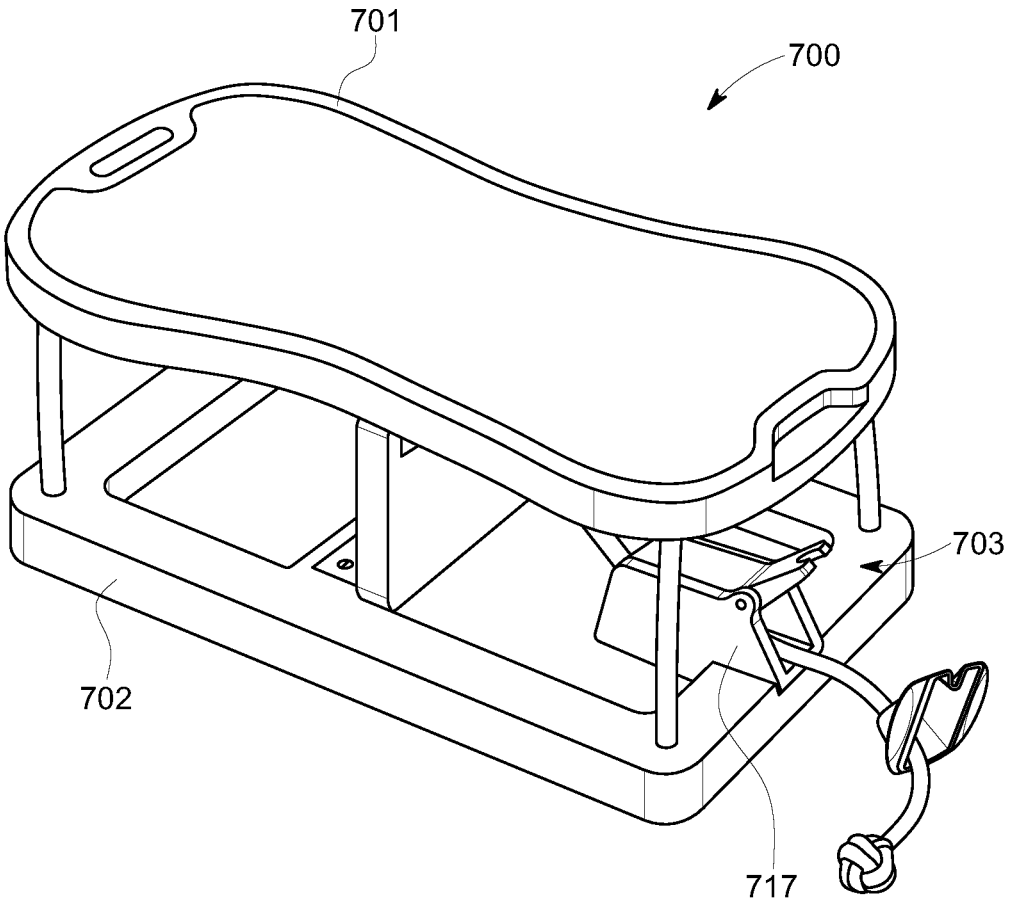
FIG. 23 is a perspective top, front view of yet another embodiment of a portable exercise device, in an open configuration, in accordance with the present disclosure.
Figure 24:
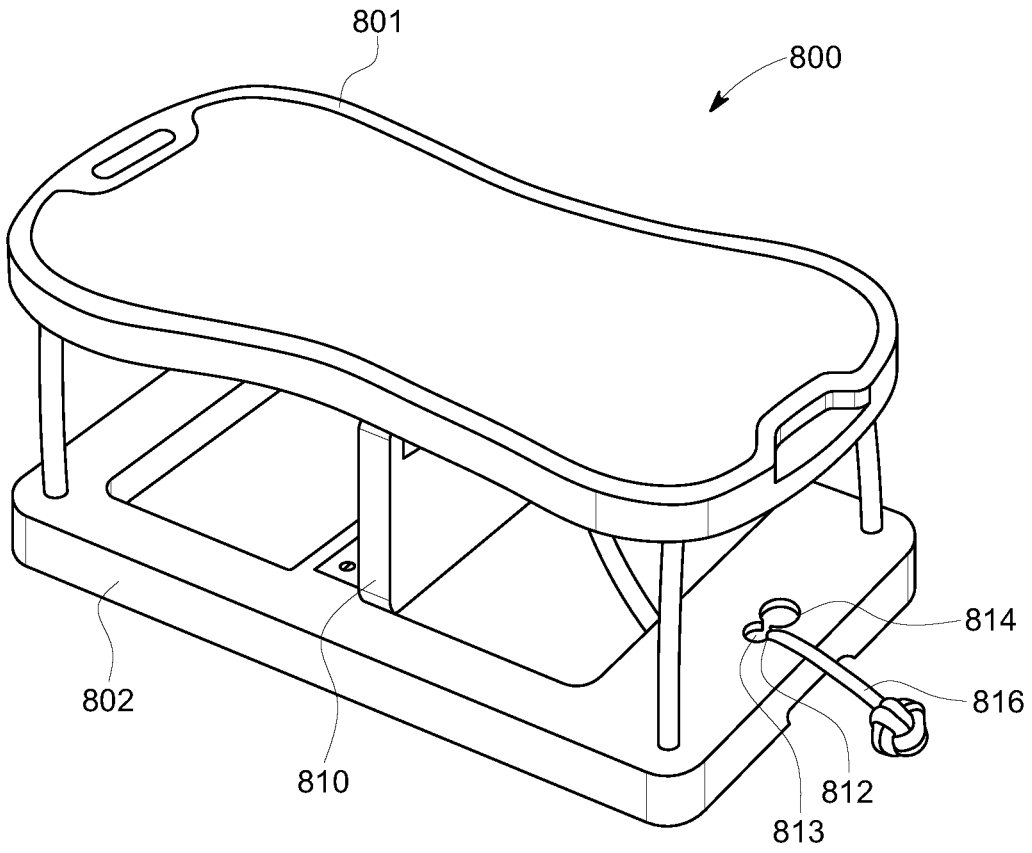
FIG. 24 is a perspective top, front view of an additional embodiment of a portable exercise device, in an open configuration, in accordance with the present disclosure.
Figure 25:
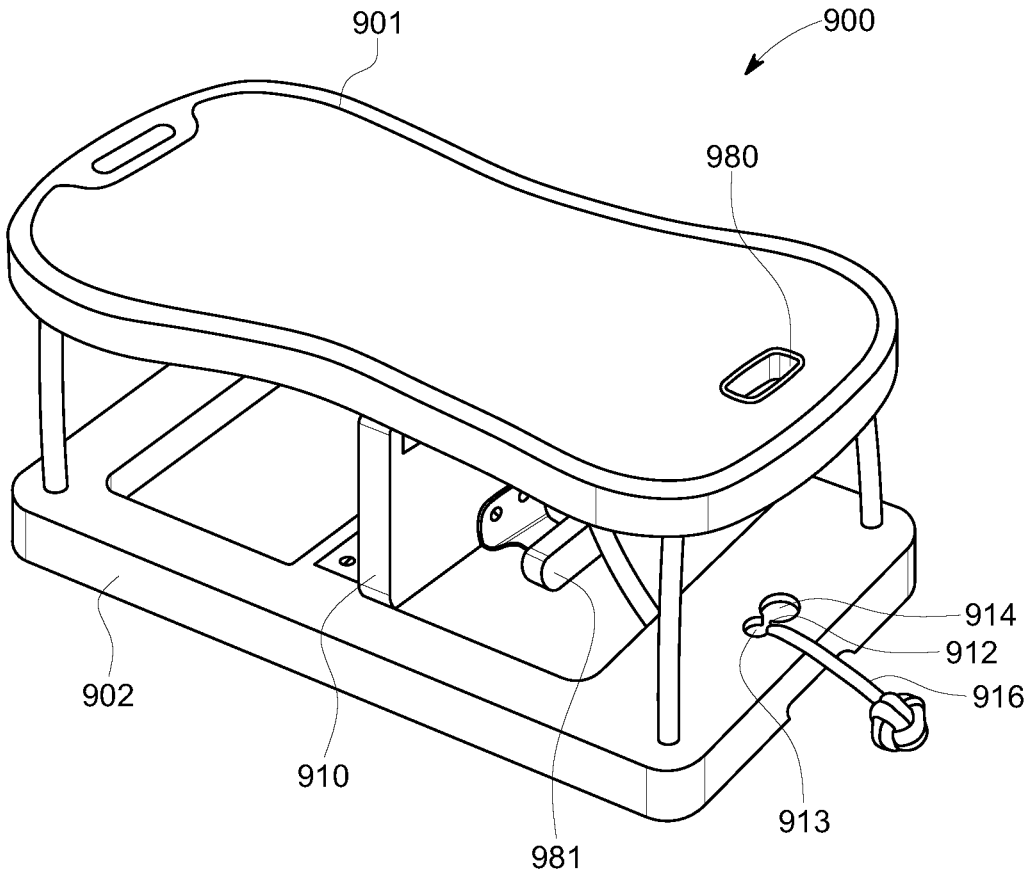
FIG. 25 is a perspective top, front view of another embodiment of a portable exercise device, in an open configuration, in accordance with the present disclosure.
Figure 26:
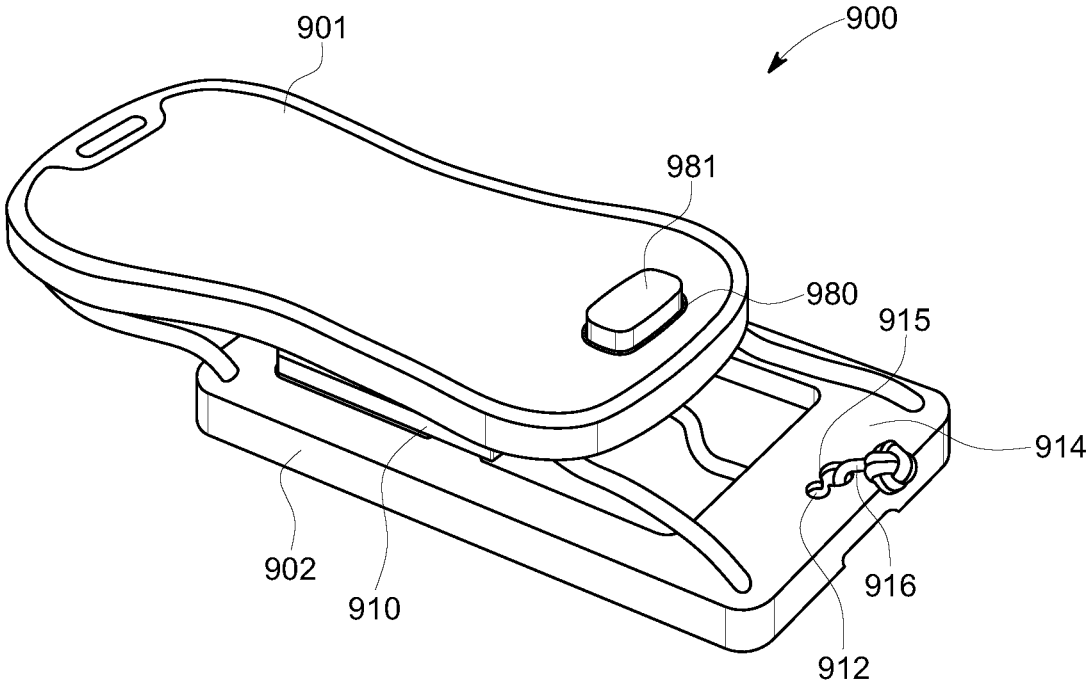
FIG. 26 is a perspective top, front view of the device of FIG. 25 in a closed configuration.
Figure 33:
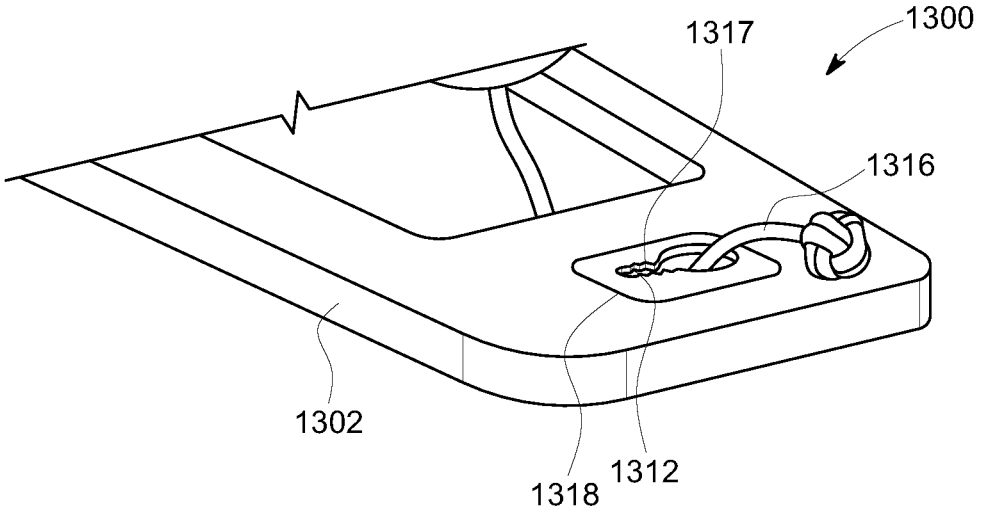
FIG. 33 is a partial, perspective top, front view of another embodiment of a portable exercise device in accordance with the present disclosure.
Figure 36:
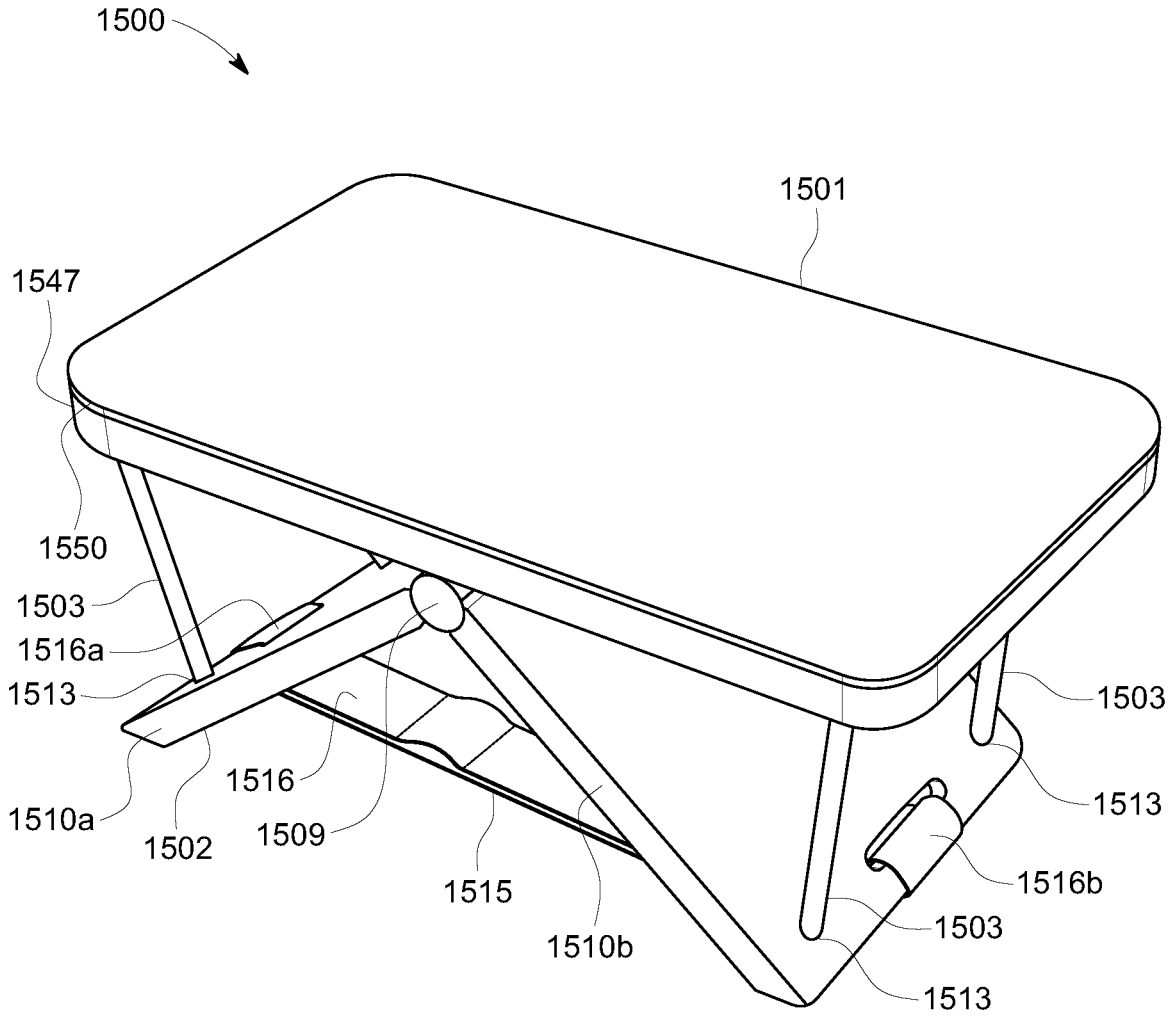
FIG. 36 is a perspective top, front view of another embodiment of a portable exercise device, in an open configuration, in accordance with the present disclosure.
Figure 40:
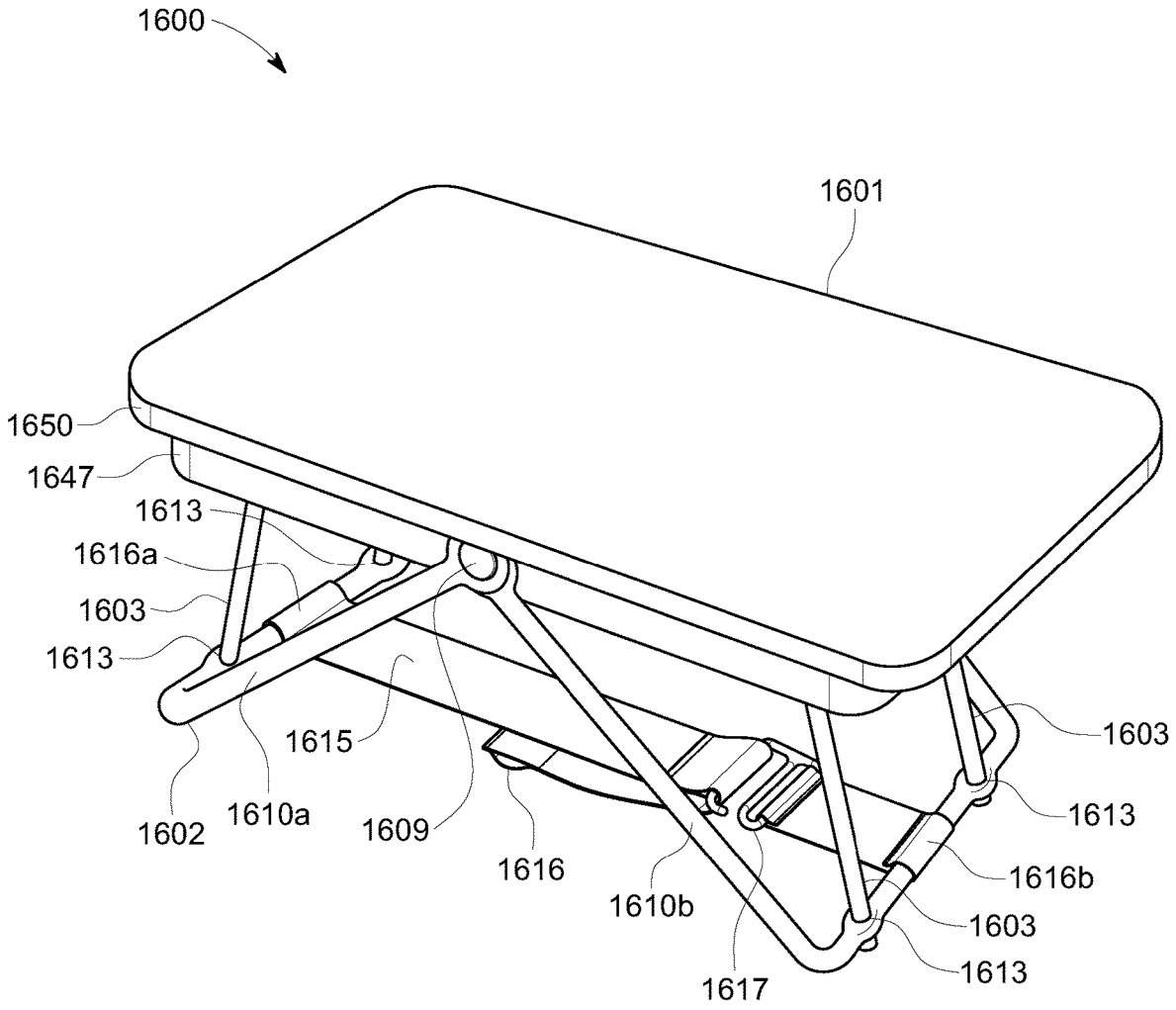
FIG. 40 is a perspective top, front view of another embodiment of a portable exercise device, in an open configuration, in accordance with the present disclosure.
Figure 41:
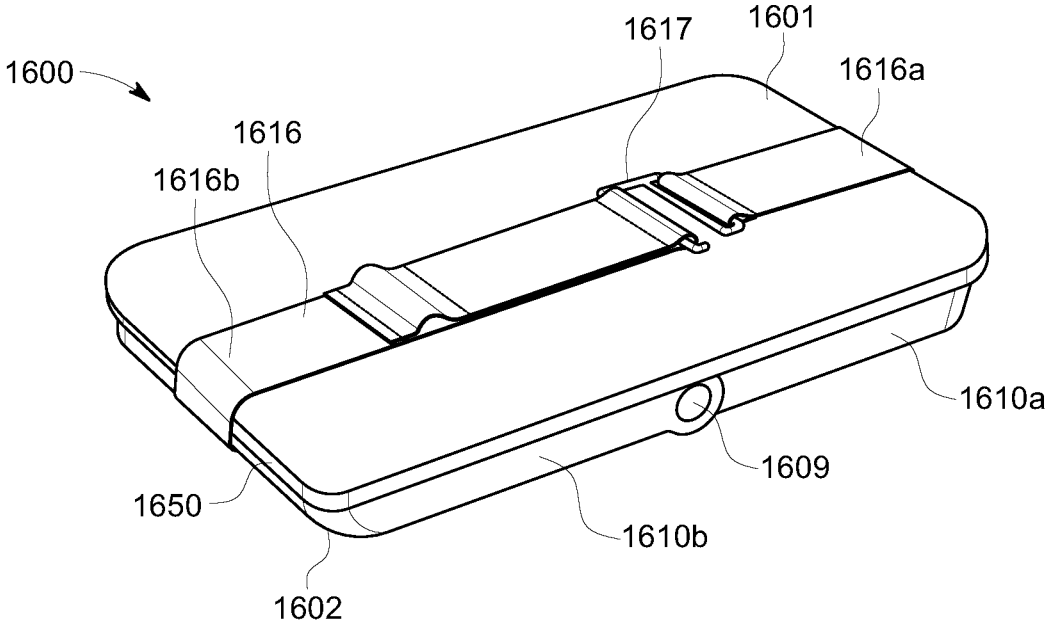
FIG. 41 is a perspective top, front view of the device of FIG. 40 in a closed configuration.
Figure 42:
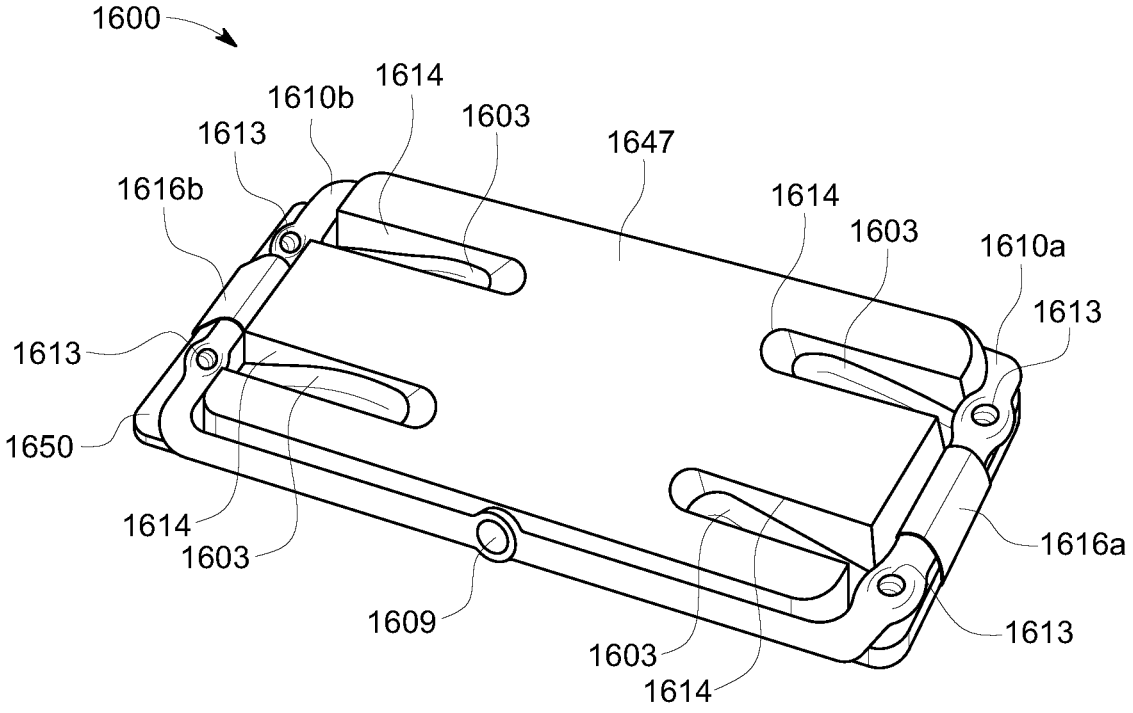
FIG. 42 is a perspective bottom view of the device of FIG. 40 in the closed configuration.

Those of ordinary skill in the art will further understand that various resistance mechanisms and locking mechanisms, as described above in FIGS. 1-22, may be used in conjunction with such wood devises. As illustrated in FIG. 23, for example, in one exemplary embodiment, similar to the embodiment of FIG. 22, the device 700 utilizes a locking mechanism comprising a plastic clamp 717. As illustrated in FIG. 33, in another exemplary embodiment, a device 1300 utilizes a locking mechanism comprising a plastic cleat 1317 that is embedded within a keyhole 1318 cut into a base 1302 of the device 1300. As will be understood by those of ordinary skill in the art, in such embodiments, to lock the device 1300 in the open configuration, the pedal may be raised and a cord 1316 may be locked within teeth 1312 of the cleat 1317. In other exemplary embodiments, similar to the embodiment of FIGS. 13A and 13B, the devices 800, 900, 1000, 1100 respectively utilize a cord 816, 916, 1016, 1116 that interconnects directly with the base 802, 902, 1002, 1102 such as, for example, with holes 812, 912, 1012, 1112 and 814, 914, 1014, 1114 or other features of the base 802, 902, 1002, 1102. For example, the device 800, 900, 1000, 1100 may have two differently sized holes 812, 912, 1012, 1112 and 814, 914, 1014, 1114 that are connected by a small channel 815 (not shown), 915 (see FIG. 26), 1015 (see FIG. 29), 1115 (see FIG. 31). The smaller of the two holes 812, 912, 1012, 1112 is configured to retain a small knot 813, 913, 1013, 1113 in the cord 816, 916, 1016, 1116 to lock the device 800, 900, 1000, 1100 in the open configuration (see FIGS. 24, 25, 28, and 30) and the larger of the two holes 814, 914, 1014, 1114 is configured to let the knot 813, 913, 1013, 1113 pass. In this manner, the device 800, 900, 1000, 1100 may be closed by tugging the cord 816, 916, 1016, 1116 through the channel 815, 915, 1015, 1115 to move the cord from the small hole 812, 912, 1012, 1112 to the large hole 814, 914, 1014, 1114. In still further exemplary embodiments, the devices 1500, 1600 utilize a locking mechanism 1515, 1615 that includes a strap (e.g., a soft goods strap) 1516, 1616 (including two strap portions) and a hook (e.g., a G-hook) 1517, 1617. The strap 1515, 1615 connects directly to each of the supports 1510*a*, 1610*a* and 1510*b*, 1610*b* and is adjusted (i.e., to lock the device 1500, 1600 in either the open or closed configuration) via the hook 1517, 1617. In the embodiment of FIGS. 36-39, for example, a respective strap portion 1516*a* and 1516*b* is connected to each support 1510*a* and 1510*b* via a notch 1512 in the base of each support 1510*a* and 1510*b*. And, in the embodiment of FIGS. 40-42, a respective strap portion 1616*a* and 1616*b* is configured to wrap around the base of each support 1610*a* and 1610*b* (i.e., around an aluminum tube forming the base of each support 1610*a* and 1610*b*). Thus, as illustrated in FIGS. 36 and 40, when the device 1500, 1600 is in the open configuration, the two strap portions 1516*a*, 1616*a* and 1516*b*, 1616*b* are connected via the hook 1517, 1617 such that the strap 1516, 1616 runs under the triangular body formed by the supports 1510*a*, 1610*a* and 1510*b*, 1610*b*. In such a configuration, a height of the device can also be adjusted by adjusting a length of the strap 1516, 1616 running between the base portions 1510*a*, 1610*a* and 1510*b*, 1610*b* (e.g., the two strap portions 1516*a*, 1616*a* and 1516*b*, 1616*b* can be connected at different points via the hook 1517, 1617 to adjust the length of the strap 1516, 1616). In other words, the pedal 1501, 1601 can be raised by shortening the length of the strap 1516, 1616 and the pedal 1501, 1601 can be lowered by lengthening the strap 1516, 1616. And, as illustrated in FIGS. 37 and 41, when the device 1500, 1600 is in the closed configuration, the two strap portions 1516*a*, 1616*a* and 1516*b*, 1616*b* are connected via the hook 1517, 1617 such that the strap 1516, 1616 runs over the birch top piece 1550, 1650 to lock the device 1500, 1600 in the closed configuration.

As above, for portability it is also advantageous for devices in accordance with the present disclosure (including the wood devices) to have a low profile when in the closed configuration (i.e., to minimize the packing profile). Accordingly, as illustrated in the embodiments of FIGS. 25-31, various embodiments further contemplate utilizing components that lock together when the device is in the closed configuration. One embodiment, for example, contemplates utilizing a pair of components 980 and 981 that fit together in a tight manner (e.g., a press-fit or snap fit manner) when the device 900 is in the closed configuration. The components may, for example, include a rubber piece 981 on the support 910 that is configured to imbed within a hole 980 in the pedal 901 when the device 900 is in the closed configuration. Another embodiment contemplates utilizing components 1080 and 1081 that stick together when the device 1000 is in the closed configuration. The components may, for example, include a "hook-type" fastener material 1080 on the pedal 1001 (e.g., a Velcro® strip) that is configured to attach to a "loop-type" fastener material 1081 on the support 1002 (e.g., on the bottom surface of the support 1002) when the device 1000 is in the closed configuration. Another embodiment contemplates utilizing components that connect magnetically when the device 1100 is in the closed configuration. The components may, for example, include a magnet 1181 on a top surface of the support 1102 that is configured to connect to a magnet (not shown) on a bottom surface of the pedal 1101 when the device 1100 is in the closed configuration.

As illustrated in the embodiments of FIGS. 36-42, various additional embodiments contemplate utilizing a pedal 1501, 1601 and base 1502, 1602 that are configured to lay flush when the device 1500, 1600 is in the closed configuration. In the embodiment of FIGS. 36-39, for example, to place the device 1500 into the closed configuration, the wood supports 1510*a* and 1510*b* may rotate (via the hinge 1509) up against the pedal 1501 (i.e., such that they lay flat against an underside of the support 1547 of the pedal 1501), and the elastomeric bands 1503 are configured to nest internally within the support 1547 of the pedal 1501 (not shown). Similarly, in the embodiment of FIGS. 40-42, to place the device 1600 into the closed configuration, the aluminum supports 1610*a* and 1610*b* may rotate (via the hinge 1609) up against the pedal 1601 (i.e., such that they frame the support 1647 and lay flat against an underside of the top piece 1650 of the pedal 1601); and the elastomeric bands 1603 are configured to nest within cutouts 1614 in an underside of the support 1647 of the pedal 1601 (see FIG. 42).

Such components and configurations may serve to minimize the packing profile of the device 900, 1000, 1100, 1500, 1600 while also helping to secure the pedal 901, 1001, 1101, 1501, 1601 to the base 902, 1002, 1102, 1502, 1602 during transport. Also, as above, to provide both protection and containment (e.g., of any dirt or contaminants that the device 900, 1000, 1100, 1501, 1601 may have picked up during use), the device 900, 1000, 1100, 1501, 1601 may also be inserted into a storage sleeve 1200 as illustrated, for example, in FIG. 27.

As above, those of ordinary skill in the art will understand that the portable exercise devices described above with reference to the wood embodiments of FIGS. 23-31 and 36-42 are exemplary only, and that portable exercise devices in accordance with the present disclosure may comprise various types, numbers, configurations, and/or combinations of the above described elements and features without departing from the scope of the present teachings and claims.

In accordance with various exemplary embodiments of the present disclosure, an exemplary method for exercising muscles in an ankle, foot, and/or leg of a user 123 using the exercise device 100, as illustrated in the embodiments of FIGS. 1-13B, will now be described with reference to FIGS. 1-14. For use, the exercise device 100 may be placed in an open configuration, as shown in FIGS. 1-7, 13A, and 13B. Alternatively, during travel or when otherwise storing and/or transporting the device 100, the exercise device 100 may be placed in a closed configuration, as shown in FIGS. 7-12. Consequently, exemplary methods for exercising in accordance with the present disclosure, contemplate that a configuration of the device 100 may be adjusted from a closed confirmation to an open configuration, wherein, as described above, in the closed configuration, the pedal 101 is collapsed against the base 102, and, in the open configuration, the pedal 101 is raised into an elevated position with respect to the base 102 to receive a foot 121 of a user 123.

The configuration of the device 100 may be adjusted from the closed configuration to the open configuration by lifting the pedal 101 off the base 102 and into a position substantially parallel to and aligned with the base 102, such that a space S is formed between the pedal 101 and the base 102. In various exemplary embodiments, the pedal 101 may be held in the open configuration position (neutral position) via the support 110, which is positioned between the pedal 101 and the base 102. As previously noted, the support 110 is connected to each of the pedal 101 and the base 102 via a respective hinge 109 and 111. The support 110 may, for example, be raised and lowered with respect to the base 102 (i.e., transitioned between an upright and collapsed configuration as described above) by respectively securing and releasing a cord 116 that is attached to the support 110. In other words, to raise the support 110 and maintain the support 110 in the upright configuration (and thereby raise the pedal 101 and maintain the device 100 in the open configuration), the cord 116 may be pulled taut and secured, for example, within a clamp 117. And, to lower the support 110 (and thereby lower the pedal 101 and place the device in the closed configuration) the cord 116 may be released from the clamp 117, such that the cord 116 is slackened to allow the support 110 to collapse against a top surface 145 of the base 102 via the hinges 109 and 111.

When in the open configuration, a foot 121 of the user 123, for example, a right foot 121 is set on the foot surface 150 of the pedal 101. Upon initial use of the exercise device 100, the pedal 101 may receive the user's 123 foot 121 in a neutral position N relative to a pivot axis P (see FIGS. 6 and 7). As shown for illustrative purposes in FIGS. 13A and 13B, using for example a right foot 121, the user 123 can rotate the pedal 101 in a first and second opposite directions, F and E respectively, about the pivot axis P against a resistive force Z exerted against the pedal 101 in a direction opposite to the rotating direction (i.e., opposite to the direction F or E). For example, the user 123 can rotate the pedal 101 in the first direction F about the pivot axis P to move a first end (e.g., the toe end portion 104) of the pedal 101 toward the base 102, while a force exerted (e.g., by a resistance mechanism 103) against a second end (e.g., the heel end portion 105) of the pedal 101 resists the pivoting motion. Likewise, the user 123 can rotate the pedal 101 in the second direction E about the pivot axis P to move the second end (e.g., the heel end portion 105) of the pedal 101 toward the base 102, while a force exerted (e.g., by the resistance mechanism 103) against the first end (e.g., the toe end portion 104) of the pedal 101 resists the pivoting motion. In this manner, rotating the pedal 101 in the first and second directions may cause a rocking movement of the pedal 101 about the pivot axis P. Thus, as illustrated in FIG. 13A, rotating the pedal 101 in the first direction F may comprise depressing a toe end portion 104 of the pedal 101 and, as shown in FIG. 13B, rotating the pedal 101 in the second direction E may comprise depressing a heel end portion 105 the pedal 101.

As explained above, in various exemplary embodiments, the amount of force exerted against the pedal 101 may vary with a degree of rotation 6 of the pedal 101 about the pivot axis P (see FIG. 14), for example, the amount of force exerted against the pedal 101 may increase with the degree of rotation 6 of the pedal 101 about the pivot axis P. In this way, the further away from the neutral position the user 123 rotates the pedal 101, the more force that is required by the user 123 to maintain the position of the pedal 101.

Although not shown, similarly, the device may be used with a left leg/left foot of the user 123. For example, in the same manner, the left foot may be set on the foot surface 150 of the pedal 101. As above, the user 123 can then rotate the pedal 101 in first and second opposite directions F and E about the pivot axis P against a force exerted against the pedal 101 in a direction opposite to the rotating direction (i.e., opposite to the direction F or E).

Various exemplary embodiments of the present disclosure, therefore, contemplate rotating the pedal 101 in the first and/or second opposite directions F and E to subject the corresponding foot of a user to both plantar flexion motion (e.g., with reference to FIG. 13A, movement of the toes of the foot 121 away from the shin, thereby contracting the calf muscle) and dorsiflexion motion (e.g., with reference to FIG. 13B, movement of the toes of the foot 121 toward the shin, thereby stretching the left calf muscle). In this manner, using the exercise devices in accordance with various exemplary embodiments of the present disclosure can exercise both dorsiflexor and plantar flexor muscle groups, providing full flexion and extension of the ankle joint to increase blood circulation in the lower extremities of the body. In other words, such exercise devices may engage both calf muscle pump and venous foot pump to enhance the return of venous blood from the lower extremities to the heart.

In various exemplary embodiments of the present disclosure, for example, rotation of the pedal 101 in the direction F may subject the corresponding foot through up to about 75 degrees of plantar flexion (e.g., rotation ranging from about neutral to 75 degrees); and rotation of the pedal 101 in the direction E may subject the corresponding foot through up to about 60 degrees of dorsiflexion (e.g., rotation ranging from about neutral to −60 degrees).

Figure 32:
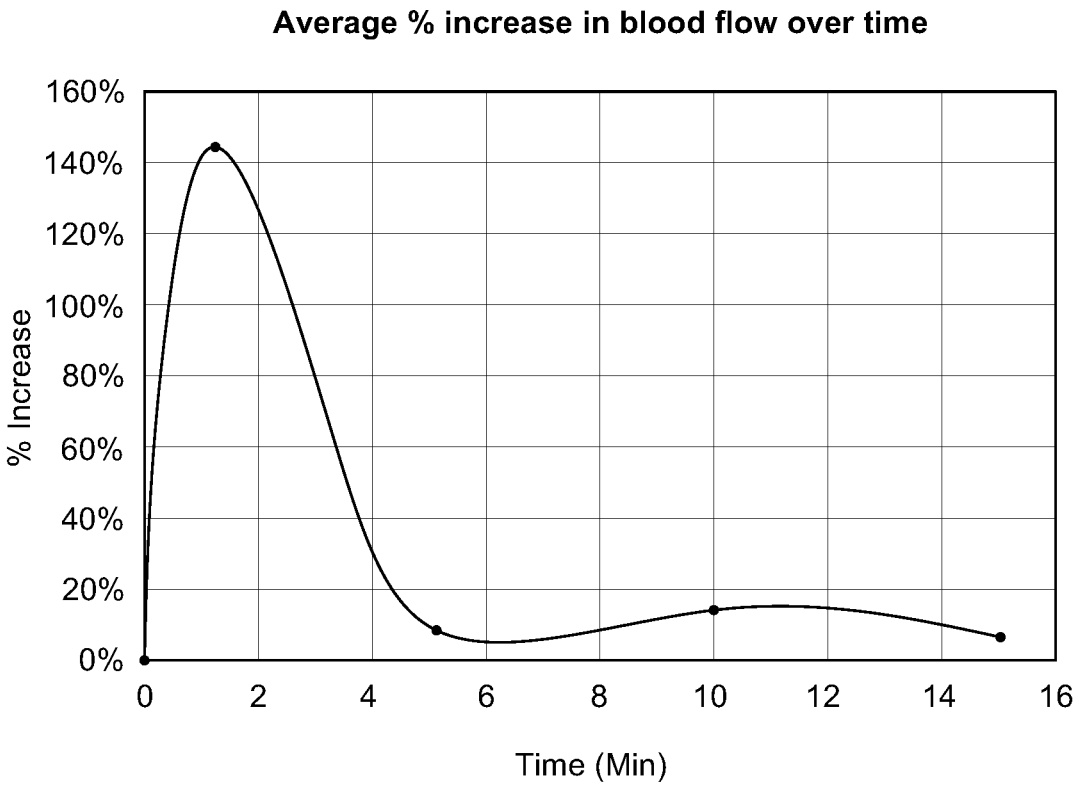
FIG. 32 is a graph illustrating the average percentage increase in blood flow over time during use of an exercise device in accordance with the present disclosure.

To demonstrate the efficacy of the devices, a clinical pilot study was performed using 12 healthy, adult volunteers. In the study, each participant used a similar device to the above device 100 to exercise, while being monitored by ultrasound Doppler using a linear probe. The subjects were seated at a sufficient height to achieve bent knees (90 degrees of flexion), with their right foot engaged with the device. Each subject rested in the seated position until blood flow parameters stabilized, after which time resting blood flow measurements were conducted. Blood vessel diameter measurements were taken using the ultrasound Doppler as visualized on the screen and the diameter was observed to remain constant before and through the exercise. Each participant then commenced with 1 minute of exercise, performing maximum effort right lower limb plantar/dorsiflexion maneuvers at 35 cycles per minute, as indicated by a metronome (i.e., wherein one cycle was defined as going from maximum dorsiflexion to maximum plantar flexion and back to the starting position). Blood flow measurements were then repeated immediately following completion of exercise, and then at 5 minutes, 10 minutes, and 15 minutes following completion of exercise. Post-exercise values for blood flow velocity and blood vessel diameter were then divided by pre-exercise values to calculate the respective ratios of each. The results of the clinical study are illustrated in FIG. 32, which plots the average percentage increase in blood flow over time for the participants. As shown in FIG. 32, on average, the participants experienced a significant improvement in blood flow velocity through the popliteal vein immediately after use, with the average increase in blood flow velocity at 1 minute being about 143%. The duration of continued increase in blood flow velocity relative to starting levels varied somewhat, but the average increase in blood flow velocity at 5 minutes was about 10%. Although the study specifically measured blood velocity, one of ordinary skill in the art, understanding the relationship between flow, velocity, and area (diameter of the vein) will understand that it is believed a corresponding increase in the volume of blood moving through the veins was realized.

Upon completion of an exercise session, exemplary methods in accordance with the present disclosure further contemplate that the configuration of the device 100 may be adjusted back from the open configuration to the closed configuration, for example, for storage, transport, or the like. In various embodiments, for example, the device 100 may be adjusted between the open configuration and the closed configuration by collapsing the pedal 101 against the base 102 to minimize the space S between the pedal 101 and the base 102. As above, the pedal 101 may be collapsed, for example, by lowering the support 110 with respect to the base 102 (i.e., transitioning the support 110 between the upright and collapsed configurations as described above) by releasing the cord 116 that is attached to the support 110.

It will be appreciated by those ordinarily skilled in the art having the benefit of this disclosure that the present disclosure provides various exemplary devices and methods for exercising muscles in an ankle, foot, and/or leg useful for increasing blood circulation in the lower extremities of the body. Furthermore, those ordinarily skilled in the art will understand that the disclosed exemplary devices and methods for exercising muscles in an ankle, foot, and/or leg may have other benefits and may treat other conditions, including, but not limited to, peripheral vascular disease, such as peripheral artery disease, PAD, and chronic venous insufficiency.

Further modifications and alternative embodiments of various aspects of the present disclosure will be apparent to those skilled in the art in view of this description. For example, although the particular examples and embodiments set forth herein contemplate an exercise device that receives one foot at a time, various additional exemplary embodiments in accordance with the present disclosure contemplate an exercise device that receives both feet at once, thereby simultaneously exercising muscles in both ankles, feet and/or legs.

Furthermore, the devices and methods may include additional components or steps that were omitted from the drawings for clarity of illustration and/or operation. Accordingly, this description is to be construed as illustrative only and is for the purpose of teaching those skilled in the art the general manner of carrying out the present disclosure. It is to be understood that the various embodiments shown and described herein are to be taken as exemplary. Elements and materials, and arrangements of those elements and materials, may be substituted for those illustrated and described herein, parts and processes may be reversed, and certain features of the present disclosure may be utilized independently, all as would be apparent to one skilled in the art after having the benefit of the description herein. Changes may be made in the elements described herein without departing from the spirit and scope of the present disclosure and following claims, including their equivalents.

It is to be understood that the particular examples and embodiments set forth herein are non-limiting, and modifications to structure, dimensions, materials, and methodologies may be made without departing from the scope of the present disclosure.

Furthermore, this description's terminology is not intended to limit the present disclosure. For example, spatially relative terms—such as "beneath", "below", "lower", "above", "upper", "bottom", "right", "left" and the like—may be used to describe one element's or feature's relationship to another element or feature as illustrated in the figures. These spatially relative terms are intended to encompass different positions (i.e., locations) and orientations (i.e., rotational placements) of a device in use or operation in addition to the position and orientation shown in FIGS. 1-12.

For the purposes of this specification and appended claims, unless otherwise indicated, all numbers expressing quantities, percentages or proportions, and other numerical values used in the specification and claims, are to be understood as being modified in all instances by the term "about" if they are not already. Accordingly, unless indicated to the contrary, the numerical parameters set forth in the following specification and attached claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the present disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

It is noted that, as used in this specification and the appended claims, the singular forms "a," "an," and "the," and any singular use of any word, include plural referents unless expressly and unequivocally limited to one referent. As used herein, the term "include" and its grammatical variants are intended to be non-limiting, such that recitation of items in a list is not to the exclusion of other like items that can be substituted or added to the listed items.

It should be understood that while the present disclosure have been described in detail with respect to various exemplary embodiments thereof, it should not be considered limited to such, as numerous modifications are possible without departing from the broad scope of the appended claims, including the equivalents they encompass.

We claim:

1. A portable exercise device comprising:

a pedal pivotably connected to a pair of supports, the pedal having a neutral position relative to a pivot axis, wherein, the pedal is configured to rotate about the pivot axis in a first direction toward one support and in a second direction, opposite the first direction, toward the other support; and a resistance mechanism configured to exert a force on the pedal about the pivot axis in a direction opposite to the respective direction of rotation of the pedal about the pivot axis, wherein the exercise device is movable between an open, in-use configuration, where the pedal is disposed in the neutral position to receive a foot of a user and the pair of supports together form a triangular base, and a closed configuration, where the pair of supports are flush against the pedal.

2. The exercise device of claim 1, wherein the pivot axis is located between the pair of supports.

3. The exercise device of claim 1, wherein the resistance mechanism comprises one or more of an elastomeric band, a spring, a friction device, and/or a torsion bar.

4. The exercise device of claim 1, wherein the pedal comprises a toe end portion and a heel end portion, the pedal being pivotably mounted to the pair of supports substantially midway between the toe end portion and the heel end portion.

5. The exercise device of claim 4, wherein the pedal is pivotably mounted to the pair of supports via at least one hinge.

6. The exercise device of claim 5, wherein the pedal is pivotably mounted to the pair of supports via first and second hinges, the first and second hinges being positioned adjacent to one another, on opposite sides of the pedal, along the pivot axis.

7. The exercise device of claim 6, wherein each of the first and second hinges comprises a respective resistance mechanism integrally formed with the respective hinge.

8. The exercise device of claim 6, wherein the resistance mechanism extends along the pivot axis between the first and second hinges.

9. The exercise device of claim 1, wherein the exercise device is made from wood, injection molded, or 3D printed.

10. The exercise device of claim 1, further comprising a locking mechanism configured to lock the exercise device in the open, in-use configuration.

11. The exercise device of claim 10, wherein the locking mechanism is further configured to lock the exercise device in the closed configuration.

12. The exercise device of claim 10, wherein the locking mechanism comprises a strap configured to span between the pair of supports when the device is in the open, in-use configuration, the strap including a first strap portion connected to one support of the pair of supports and a second strap portion connected to the other support of the pair of supports, the first and second strap portions being configured to connect to lock the device in the open, in-use configuration.

13. The exercise device of claim 10, wherein the locking mechanism comprises a brace pivotably connected to one support of the pair of supports, the brace being configured to span between the pair of supports when the exercise device is in the open, in-use configuration, the brace including at least one slot, the at least one slot being configured to engage a rod on the other support of the pair of supports to lock the exercise device in the open, in-use configuration.

14. The exercise device of claim 13, wherein the at least one slot includes a plurality of slots, the plurality of slots being configured to adjust a height of the exercise device when the exercise device is in the open, in-use configuration.

15. The exercise device of claim 1, wherein a height of the exercise device, when the exercise device is in the open, in-use configuration, varies based on a configuration of the triangular base.

16. The exercise device of claim 1, wherein the resistance mechanism comprises one or more elastomeric bands extending between the pedal and at least one of the pair of supports.

17. The exercise device of claim 16, wherein the pedal includes a plurality of catches, each catch being configured to receive and retain the at least one of the one or more elastomeric bands extending between the pedal and the at least one of the pair of supports.

18. The exercise device of claim 17, wherein the plurality of catches comprises a set of catches configured to change a length of the at least one of the one or more elastomeric bands extending between the pedal and the at least one of the pair of supports.

19. The exercise device of claim 18, wherein increasing the length of the at least one of the one or more elastomeric bands decreases the force exerted by the elastomeric band on the pedal about the pivot axis, and wherein decreasing the length of the at least one of the one or more elastomeric bands increases the force exerted by the elastomeric band on the pedal about the pivot axis.

20. A kit for exercising muscles in an ankle, foot, and/or leg of a user, the kit comprising:

the portable exercise device of claim 1;

a plurality of elastomeric bands connected to the pedal and the pair of supports, the elastomeric bands being configured to resist movement of the pedal toward each support of the pair of supports; and at least one set of replacement elastomeric bands.

21. The kit of claim 20, further comprising a storage case configured to receive the portable exercise device when the device is in the closed configuration.

22. The kit of claim 21, wherein the storage case is a cloth or neoprene sleeve.

23. The kit of claim 20, wherein the at least one set of replacement elastomeric bands includes a plurality of sets of elastomeric bands, each set of the plurality of sets of elastomeric bands providing a different amount of elasticity.

24. The kit of claim 23, wherein each set of the plurality of sets of elastomeric bands has a different color, the respective color of each set corresponding to an amount of resistive force provided by the respective set.

25. A method of exercising an ankle, foot, and/or leg of a user, the method comprising:

positioning a foot of a user onto a pedal of an exercise device, the pedal being pivotably connected to a pair of supports and having a neutral position relative to a pivot axis of the exercise device;

rotating the pedal about the pivot axis in a first direction, toward a first support of the pair of supports, with the foot, against a first resistive force;

rotating the pedal about the pivot axis in a second direction, toward a second support of the pair of supports and away from the first support, with the foot, against a second resistive force; and moving the exercise device from a closed configuration to an open configuration prior to positioning the foot of the user, wherein moving the exercise device to an open configuration includes moving the first support from a position flush against the pedal to a position extending from the pedal and moving the second support from a position flush against the pedal to a position extending from the pedal, wherein the first and second supports form a triangular support for the pedal when in the extended position.

26. The method of claim 25, further comprising adjusting a height of the pedal relative to a support surface of the exercise device.

27. The method of claim 26, wherein adjusting a height of the pedal relative to the support surface of the exercise device includes increasing or decreasing a distance between the first and second supports.

* * * * *